US010107008B2

(12) United States Patent
Waugh et al.

(10) Patent No.: US 10,107,008 B2
(45) Date of Patent: Oct. 23, 2018

(54) LOCK DEVICE

(71) Applicant: Pacific Lock Company, Valencia, CA (US)

(72) Inventors: Gregory Waugh, Stevenson Ranch, CA (US); Matthew Watson Yuen, Los Angeles, CA (US); Joshua Fleagane, Pasadena, CA (US)

( * ) Notice: Subject to any disclaimer, the term of this patent is extended or adjusted under 35 U.S.C. 154(b) by 239 days.

(21) Appl. No.: 14/485,703

(22) Filed: Sep. 13, 2014

(65) Prior Publication Data

US 2015/0075231 A1 Mar. 19, 2015

Related U.S. Application Data

(60) Provisional application No. 61/877,997, filed on Sep. 15, 2013.

(51) Int. Cl.

| | |
|---|---|
| ***E05B 13/00*** | (2006.01) |
| ***E05B 67/36*** | (2006.01) |
| ***E05B 83/12*** | (2014.01) |
| ***E05C 3/04*** | (2006.01) |
| ***E05C 19/18*** | (2006.01) |
| *E05B 83/10* | (2014.01) |

(52) U.S. Cl.

CPC ..... *E05B 13/002* (2013.01); *E05B 67/36* (2013.01); *E05B 83/12* (2013.01); *E05C 3/045* (2013.01); *E05C 19/18* (2013.01); *E05B 83/10* (2013.01); *Y10T 70/30* (2015.04); *Y10T 70/40* (2015.04)

(58) Field of Classification Search

CPC ..... E05B 67/38; E05B 67/24; E05B 67/383; E05B 65/48; E05B 67/02; E05B 17/002; E05B 65/00; E05B 65/0021; E05B 9/04; Y10T 70/489; Y10T 70/443; Y10T 70/30; Y10T 70/40; Y10T 70/493; Y10T 29/49778; Y10T 292/31; Y10T 70/439; Y10T 70/5867; Y10T 70/7915; Y10T 70/441; Y10T 70/35; Y10T 70/508; Y10T 70/8541

USPC ..... 70/2–14, 32–34, 56, 212, 417

See application file for complete search history.

(56) References Cited

U.S. PATENT DOCUMENTS

| | | | | |
|---|---|---|---|---|
| 695,347 | A | 3/1902 | Soley | |
| 1,490,987 | A | 4/1924 | Soref | |
| 1,564,463 | A | 12/1925 | Best | 70/380 |
| 1,788,396 | A | 1/1931 | Johnson | |

(Continued)

FOREIGN PATENT DOCUMENTS

WO WO 2012054839 A1 * 4/2012 ..... E05B 67/383

OTHER PUBLICATIONS

Brouchure—4000D-X Dry Van Series; Utitlity Manurfacturing Company; 2005.

(Continued)

*Primary Examiner* — Suzanne L Barrett

(74) *Attorney, Agent, or Firm* — Peter Ganjian; Patent Law Agency, LLC

(57) ABSTRACT

A casing that has a generally cylindrical configuration having a bottom side that includes a bottom side cavity. The bottom side has a topography that is generally a negative topography of a surface of an article with which the bottom side associates. The topography of the bottom side is defined by a plurality of offset surfaces that define raised edges, with the offset surfaces and resulting raised edges forming reliefs.

11 Claims, 85 Drawing Sheets

(56) References Cited

U.S. PATENT DOCUMENTS 1,921,434 A 8/1933 Stone
2,460,615 A 2/1949 Andrew ..... 70/369
3,143,872 A 8/1964 Check ..... 70/38 A
3,172,279 A 3/1965 Patriquin ..... 70/38 A
3,404,549 A 10/1968 Best
3,690,130 A 9/1972 Eutzler
3,817,062 A * 6/1974 Randel ..... E05B 67/36 70/11
3,820,360 A 6/1974 Best
3,882,699 A 5/1975 Flack et al. ..... 70/38 A
3,901,058 A * 8/1975 Best ..... E05B 67/36 70/32
3,996,774 A 2/1976 Best
4,068,510 A 1/1978 Neary ..... 70/379 R
4,075,878 A 2/1978 Best ..... 70/49
4,102,161 A * 7/1978 Proefrock ..... E05B 67/14 70/360
4,109,496 A 8/1978 Allemann et al. ..... 70/380
4,112,716 A 9/1978 Wippich
4,228,669 A 10/1980 Bischoff ..... 70/379 R
4,254,648 A 3/1981 Dietrich ..... 70/380
4,328,690 A 5/1982 Oliver ..... 70/369
4,347,720 A 9/1982 Kenyon
4,672,828 A 6/1987 Theriault
4,793,166 A 12/1988 Marks
4,926,670 A 5/1990 Deforrest, Sr. ..... 70/374
5,121,618 A 6/1992 Scott ..... 70/367
5,127,244 A 7/1992 Myers
5,174,136 A 12/1992 Thwing ..... 70/38 A
5,193,372 A 3/1993 Sieg et al. ..... 70/369
D336,030 S 6/1993 Falk et al.
5,233,851 A 8/1993 Florian
5,345,794 A 9/1994 Jenks
5,361,611 A * 11/1994 Hisler ..... A01K 97/00 211/4
5,765,408 A * 6/1998 Sanseverino ..... B60R 25/02147 70/14
5,878,604 A * 3/1999 Stone ..... E05B 13/002 292/148
6,005,306 A 12/1999 Pickard
6,009,731 A 1/2000 Emmons et al.
6,109,080 A 8/2000 Chen et al.
6,146,356 A 11/2000 Wang et al. ..... 604/96.01
6,233,984 B1 * 5/2001 Blehi, III ..... E05B 13/002 70/2
6,338,261 B1 * 1/2002 Liu ..... E05B 67/36 70/14
6,374,653 B1 4/2002 Gokcebay et al.
6,425,274 B1 7/2002 Laitala et al. ..... 70/394
6,467,317 B1 10/2002 Hillabush
6,581,419 B1 6/2003 Strodtman
6,606,890 B1 8/2003 Widen
6,609,739 B1 8/2003 Avganim
6,634,196 B2 10/2003 Huang
6,758,075 B1 7/2004 Thwing ..... 70/389
6,766,671 B2 7/2004 Haczynski et al. ..... 70/23
6,854,303 B2 2/2005 Shiao
6,883,356 B1 4/2005 Wu ..... 70/379 R
6,915,670 B2 7/2005 Gogel
6,948,345 B1 9/2005 Ruan ..... 70/370
RE38,832 E 10/2005 Thwing
7,003,994 B2 2/2006 Ruan ..... 70/416
7,047,774 B1 5/2006 Gogel ..... 70/32
D526,557 S 8/2006 Falconer et al.
7,210,316 B1 5/2007 Falconer et al.
7,278,284 B1 * 10/2007 James ..... E05B 13/002 292/205
7,412,855 B2 8/2008 Dolev
7,543,466 B2 6/2009 Loughlin et al.
7,770,422 B1 8/2010 Sierra
7,836,736 B2 11/2010 Humphris
7,946,142 B2 5/2011 Matyko
8,004,393 B2 8/2011 Haber
8,281,624 B2 10/2012 Rizzi
8,776,557 B2 7/2014 Wang
8,935,944 B2 * 1/2015 Boesel ..... E05B 65/48 292/285
8,938,998 B2 1/2015 Haber
8,978,426 B2 3/2015 Wang
9,212,508 B2 12/2015 Loughlin
2004/0083777 A1 * 5/2004 Vito ..... E05B 67/36 70/32
2004/0093914 A1 5/2004 Vito
2004/0144141 A1 7/2004 Ng
2004/0221626 A1 * 11/2004 Palzkill ..... E05B 13/002 70/34
2004/0244442 A1 * 12/2004 Shiao ..... E05B 67/38 70/56
2005/0199027 A1 9/2005 Mannella
2005/0252257 A1 * 11/2005 Woods ..... E05B 67/04 70/33
2006/0144100 A1 7/2006 Thomsen
2006/0236730 A1 10/2006 Wyers
2008/0105004 A1 * 5/2008 Wang ..... E05B 67/36 70/2
2008/0105005 A1 * 5/2008 Wang ..... E05B 67/36 70/32
2011/0316291 A1 * 12/2011 Loughlin ..... E05B 13/001 292/101
2012/0011682 A1 * 1/2012 Boonstra ..... E05B 67/383 16/384
2012/0210754 A1 * 8/2012 Thomsen ..... E05B 13/002 70/14
2013/0276488 A1 10/2013 Haber
2014/0223974 A1 8/2014 Dolev
2015/0075231 A1 3/2015 Waugh

OTHER PUBLICATIONS

Brouchure—The Enforcer High Security Locking Systems; Cargoard 8075 ; Transport Security, Inc. www.transportsecurity.comk.
Polar Steel Cam Type Clok on; Polar Hardware Manuractuirng Co., Inc. ; www.polarmfg.com.
Photo of Pad Lock—1.
Photo of Pad Lock—2.
THPXL Internal Shackle Door Lock; www.trimaxlocks.com.
U.S. Appl. No. 11/907,149, filed Oct. 10, 2007 ; File History.
Letter from Mr. John Ulaszek to Mr, Gregory Waugh, President of Pacific Lock Company, the Assignee of the current application, 3 pages, Jan. 22, 2007.
Letter from Mr. John Ulaszek to Mr. Gregory Waugh, President of Pacific Lock Company, the Assignee of the current application, 3 pages, Feb. 9, 2007.
Provisional application cover sheet for U.S. Appl. No. 60/220,416, filed Jul. 24, 2000 and an attached page with a figure.
Security Padlock Uses IC Gore Cylinders, Gale Johnson, Locksmith Ledger, vol. 60, No. 13 (4 pages).
Pacific Lock, Gregory B. Waugh, The National Locksmith, Jan. 2006, 6 pages.
Pacific Lock Introduces the World's First Hockey-Pucks for SFIC's and KiK Cylinders, The National Locksmith, Jan. 2007, 6 pages.
Lynk, William M., "Interchangeable Cores Small Format," The National Locksmith, 2000, 44 pages.
Johnson, Gale, Xperinetix Has a Better Idea, The Locksmith Ledger, Dec. 2000, 5 pages, San Diego, CA.
Digital Seal From Babaco; www.babaco.com ; 2011.
Truk Lok III ; www.babaco.com ; 2011 .
Truk Lok II ; www.babaco.com ; Jul. 29, 2013 .
Lock-Style Pull Solenoid—12VDC ; https://www.adafruit.com/product/1512 ; https://www.youtube.com/watch?v=92kwSeiwl3U; 2013.
Lockitron Motoorized Door Lock Body; https://www.adafruit.com/product/2579 ; 2011.
U.S. Appl. No. 14/718,023 Office Action dated Sep. 11, 2017.

* cited by examiner

100

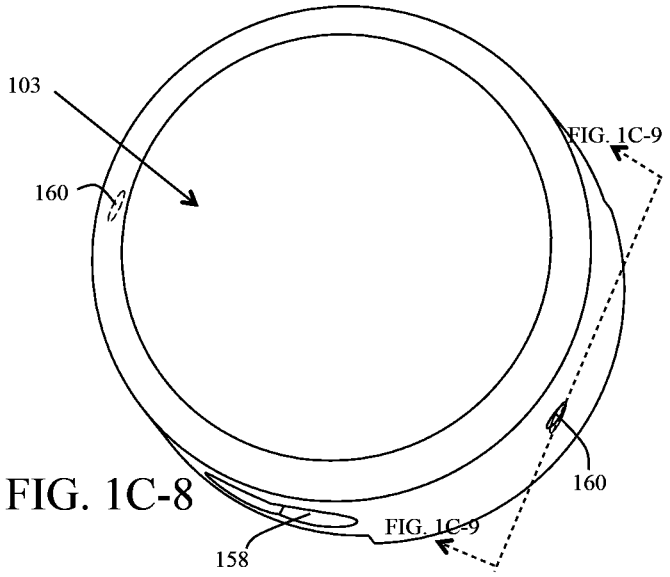
FIG. 1C-8
FIG. 1C-9
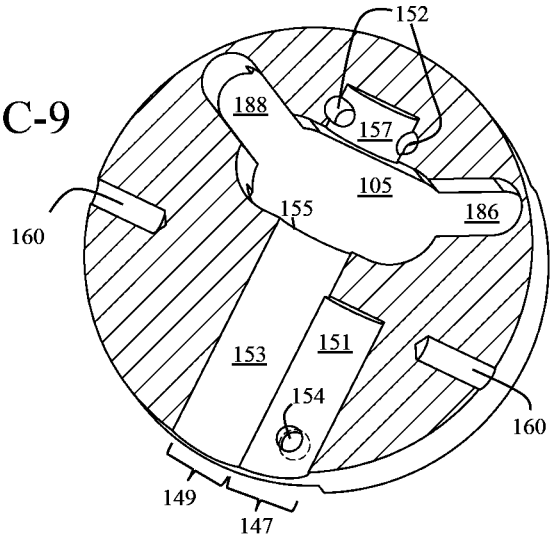

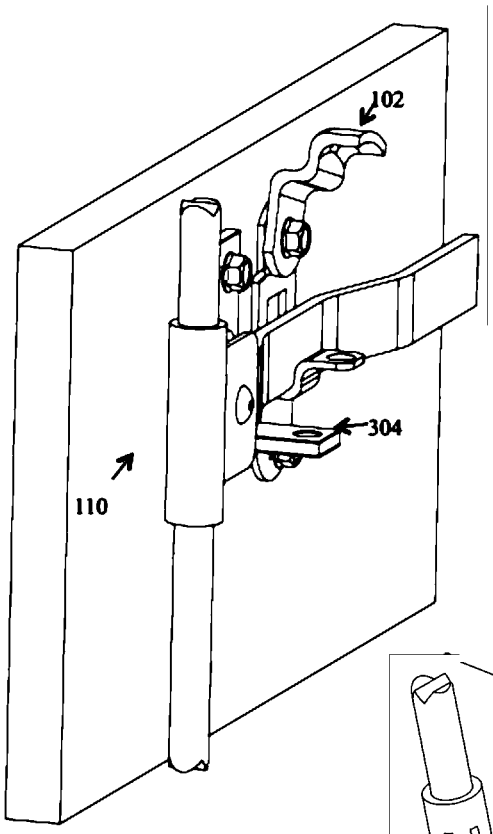
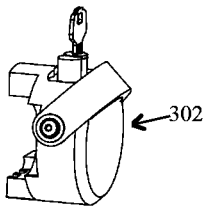
FIG. 3A-5
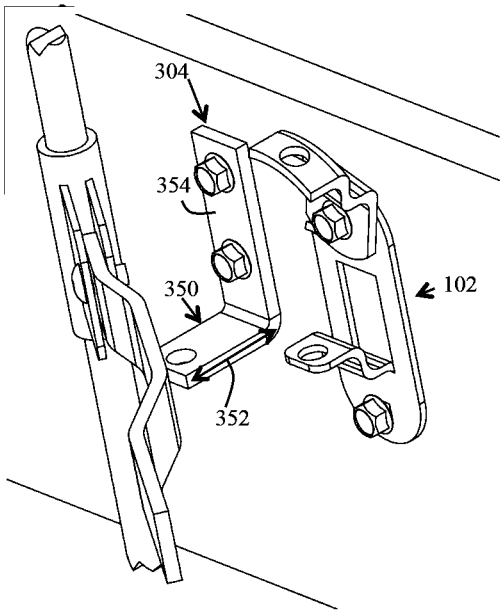
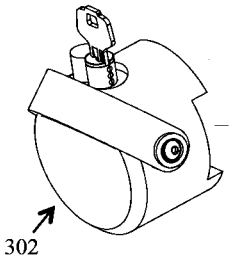
FIG. 3A-6

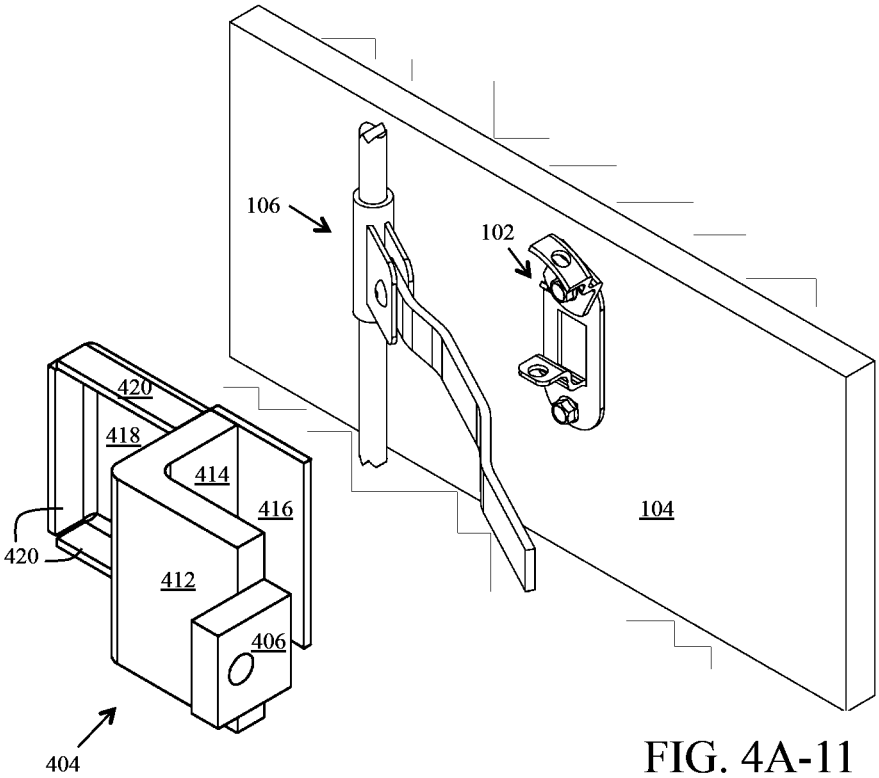
FIG. 4A-11
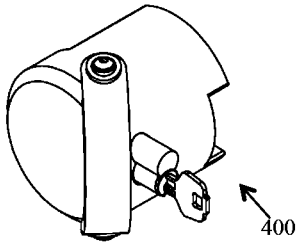

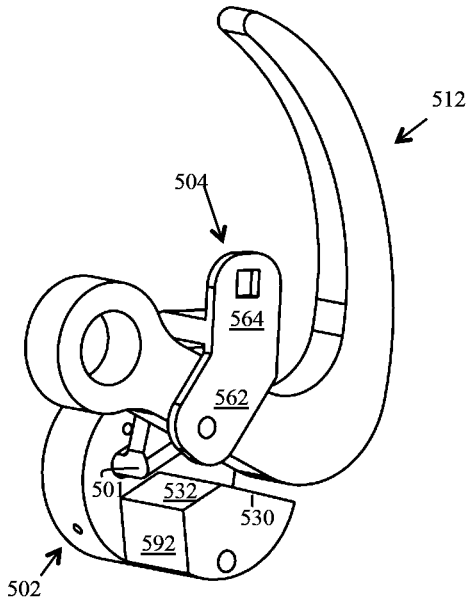
FIG. 5B-1
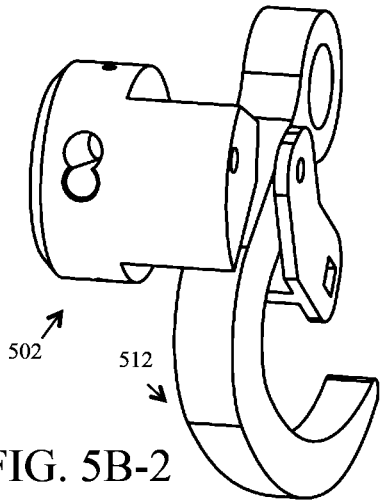
FIG. 5B-2
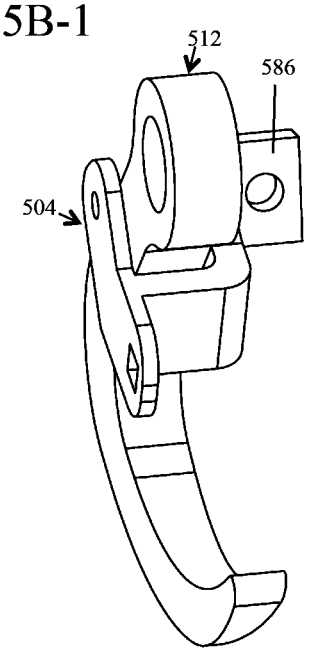
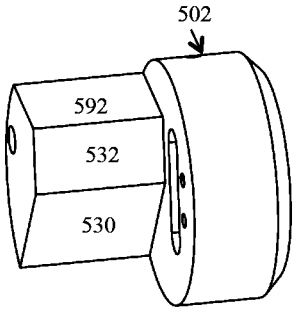
FIG. 5B-3

LOCK DEVICE

CROSS-REFERENCE TO RELATED APPLICATIONS

This application claims the benefit of priority of the U.S. Utility Provisional Patent Application No. 61/877,997, filed 15 Sep. 2013, the entire disclosure of which is expressly incorporated by reference.

It should be noted that where a definition or use of a term in the incorporated patent application is inconsistent or contrary to the definition of that term provided herein, the definition of that term provided herein applies and the definition of that term in the incorporated patent application does not apply.

BACKGROUND OF THE INVENTION

Field of the Invention

The present invention relates to a lock device and, more particularly, to a casing that may accommodate an interchangeable lock cartridge (a lock cylinder and shackle, also known in the industry as cylinder core, or simply "core") that interlocks with a structure. Non-limiting examples of a structure may include a hasp assembly and or a lock assembly that may comprise of a lock handle, a hinge of the lock handle, etc.

Description of Related Art

Most enclosures such as a cargo door are secured by a lock assembly, which may include a lock handle that is moveably associated with the enclosure. Conventional enclosure may further include a hasp assembly where a lock device such as a conventional "hockey puck" padlock may be mounted onto the hasp assembly to lock and prevent the movement of the lock handle of the lock assembly.

Conventional hockey puck padlocks have zero tolerance for accommodating any variations in the hasp assembly that may exceed the hockey puck padlock parameters, making them incompatible with most of the existing hasp assemblies, which limits the use of hockey puck padlocks. Additionally, even if fully compatible, the lock assembly of the enclosure such as the lock handle, lock hinge, lock hinge pin, etc. remain exposed and vulnerable to tampering. Conventional covers may be used in addition to the use of a lock device with the hinge assembly to cover over the entire lock assembly and the mounted lock device and hinge assembly, but the known covers are bulky, time consuming to install and remove, and obviously add weight and cost for securing an enclosure.

A further issue related to securing a cargo door is that in general, the cargo container may be operated by an entity that does not own the container and therefore, may not have the permission to install additional security features to better secure the cargo by further securing the cargo door (which may require drilling holes or other modifications that may damage or permanently alter the door).

Accordingly, in light of the current state of the art and the drawbacks to current lock devices mentioned above, a need exists for a lock device that would be used with most types of conventional lock assembly, that would have tolerances for accommodating variations in hasp assembly, and that would lock and provide protective cover for the handle and hinge portions of the lock assembly. Further, a need exists for a lock device that would be portable and that would secure an enclosure without altering, damaging, or requiring modifications of the enclosure and without being fixedly mounted onto the enclosure.

BRIEF SUMMARY OF THE INVENTION

A non-limiting, exemplary aspect of one or more embodiments of the present invention provide a casing, that may comprise:

a generally cylindrical configuration having a bottom side that may include a bottom side cavity;

the bottom side has a topography that may be a generally negative topography of a surface of an article with which the bottom side associates;

the topography of the bottom side may be defined by a plurality of offset surfaces that define raised edges, with the offset surfaces and resulting raised edges forming reliefs.

Another non-limiting, exemplary aspect of one or more embodiments of the present invention provide a casing that may comprise:

a generally cylindrical configuration having a bottom side that may include a bottom side cavity;

the bottom side cavity includes a first distal section that is oriented at an angle in relation to a second distal section.

Another non-limiting, exemplary aspect of one or more embodiments of the present invention provide a casing that may comprise:

a generally cylindrical configuration having a bottom side that may include a bottom side cavity; and a member that protrudes from the bottom side that obstructs a movement of a lock assembly.

Another non-limiting, exemplary aspect of one or more embodiments of the present invention provide a hasp that may comprise:

an accommodating section, a locking section, and may include a connection section.

Another non-limiting, exemplary aspect of one or more embodiments of the present invention provide a portable locking component that may comprise:

a portable hasp that may include:

an accommodating section;

a locking section; and an anti-tamper section.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

FIGS. 1D-1 to 1D-6 are non-limiting, exemplary illustrations of a cover in accordance with one or more embodiments of the present invention;

FIG. 2A-1 to 2B-16 are non-limiting, exemplary illustrations of a lock device, including various views of a casing thereof in accordance with one or more embodiments of the present invention;

FIG. 3A-1 to 3D are non-limiting, exemplary illustrations of a lock device, including various views of a casing thereof in accordance with one or more embodiments of the present invention;

FIG. 4A-1 to 4D-11 are non-limiting, exemplary illustrations of a lock device, including various views of a casing thereof in accordance with one or more embodiments of the present invention;

FIG. 5A-1 to 5E-15 are non-limiting, exemplary illustrations of a lock device, including various views of a casing thereof in accordance with one or more embodiments of the present invention; and FIGS. 6A to 6D-12 are non-limiting, exemplary illustrations of a lock assembly and hasp assembly in accordance with one or more embodiments of the present invention.

DETAILED DESCRIPTION OF THE INVENTION

Figures 1, 1A:
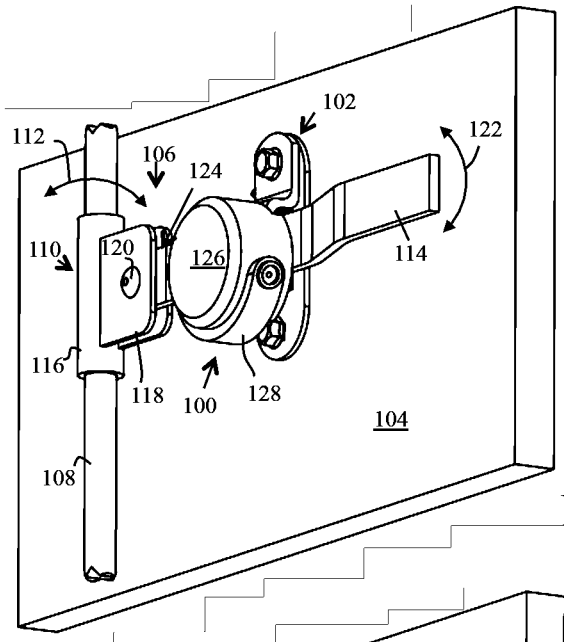
FIGS. 1A-1 to 1C-12 are non-limiting, exemplary illustrations of a lock device, including various views of a casing thereof in accordance with one or more embodiments of the present invention.

The detailed description set forth below in connection with the appended drawings is intended as a description of presently preferred embodiments of the invention and is not intended to represent the only forms in which the present invention may be constructed and or utilized.

One or more embodiments of the present invention provide a lock device (casing and core) that may be used with most types of conventional locking assembly. Further, one or more embodiments of the present invention provide a lock device that has wider margins of tolerances for accommodating variations in lock hasps used. Additionally, one or more embodiments of the present invention provide a lock device that locks and provides a protective cover for the handle and hinge portions of the locking assembly without the requirement of an additional lock mechanism such as a cover. Further, one or more embodiments of the present invention provide a portable lock device and portable hasp that lock and provide a protective cover for the handle and hinge portions of the locking assembly but without altering, damage, or requirement for modification of the enclosure and without being fixedly mounted onto the enclosure.

One or more embodiments of the present invention provide a casing, which is a protective cover or shell that protects or encloses a lock cartridge ("core") comprised of a lock cylinder with an enclosed shackle. The casing, in accordance with one or more embodiments of the present invention, may comprise a generally cylindrical configuration having a bottom side. The bottom side of the casing may include a surface that has a topography that is generally a negative topography of another surface (e.g., a surface of an article such as a lock assembly, hasp assembly, etc.) with which the bottom side associates. In general, the present invention defines a "negative topography" as one where there is a general inverse or negative correlation between elevation, relief, and mean slope of two surfaces. For example, an inverse or negative correlation of a protuberance on a first surface (e.g., of a hasp assembly) may be a generally corresponding relief on a second surface (e.g., of the bottom side of the casing) or vice versa.

FIGS. 1A-1 to 1C-12 are non-limiting, exemplary illustrations of a lock device, including various views of a casing thereof in accordance with one or more embodiments of the present invention. In particular, FIGS. 1A-1, 1A-2, 1A-4, 1A-5, 1A-6, 1A-7, and 1B-1 are non-limiting, exemplary illustrations of a fully assembled lock device 100 in accordance with the present invention that is associated with a hasp assembly 102 of an exemplary cargo door 104 that has a lock assembly that is generally designated as reference 106.

Referring to FIGS. 1A-5 and 1A-6, as is illustrated, lock assembly 106 and hasp assembly 102 are very well known and conventional. Further, the manner of associating lock assembly 106 and hasp assembly 102 with cargo door 104 is also very well known and conventional and therefore, not illustrated in detail. The illustrated cargo door 104 and the manner of association of lock and hasp assemblies 106 and 102 with cargo door 104 throughout the disclosure are very much simplified illustrations of an actual cargo door and lock and hasp assemblies for discussion purposes only. For example, as shown in FIGS. 1A-5 and 1A-6, an actual cargo door 104 is associated with a body or fixed portion of an actual truck or container via a door hinge 104*a* (illustrated as a mere dashed line), which allows the moving door 104 to swing open along reciprocating path 144 at the door hinge 104*a*. As another example, the lock assembly 106 (and in particular a lock bar 108) is associated (in well known manner, but simply shown as an arrow line 146) with cargo door 104. It is only for simplicity and discussion purposes that the illustrations of lock and hasp assemblies and their connection with a typical cargo door 104 are very much simplified, as they are very much conventional and well known.

As illustrated in FIGS. 1A-1 to 1A-6, lock assembly 106 includes lock bar 108 and a pivoting, single piece hinge mechanism 110 that rotates around lock bar 108 along a reciprocating path 112 from the illustrated closed (FIG. 1A-1) to open position (FIG. 1A-5) in well known and conventional manner. Lock assembly 106 also includes a well known lock handle 114. Hinge mechanism 110 functions as a hinge "adapter" in that it allows the lock handle 114 of lock assembly 106 to be pivotally associated with lock bar 108 of lock assembly 106. Single piece hinge mechanism 110 is comprised of a cylindrical portion 116 that is pivotally associated with lock bar 108, allowing hinge mechanism 110 to rotate (so to rotate lock bar 108) and swing away to an open position (FIG. 1A-5) or towards cargo door 104 (to closed position as shown in FIG. 1A-1). Hinge mechanism 110 also includes a hinging portion 118 that hinges a distal end 124 of lock handle 114 onto hinging portion 118 via a hinge pin 120. As is well known, lock handle 114 has a horizontal rotational motion (along path 112) and a vertical rotational motion (along reciprocating path 122).

Figures 1, 1A, 2:
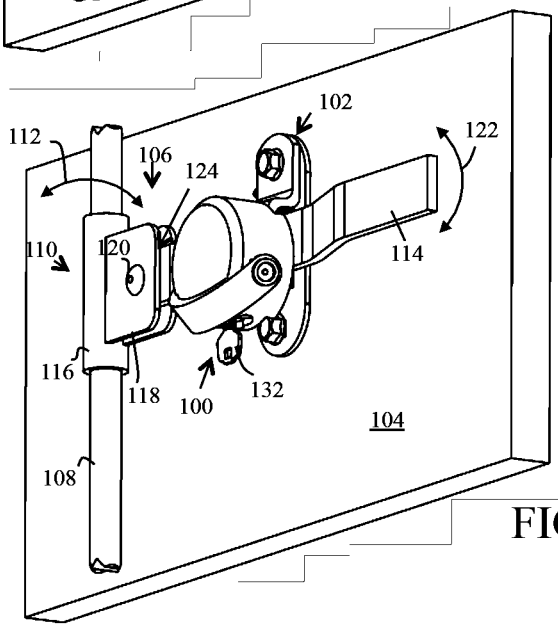
Figures 1, 1A, 2, 3:
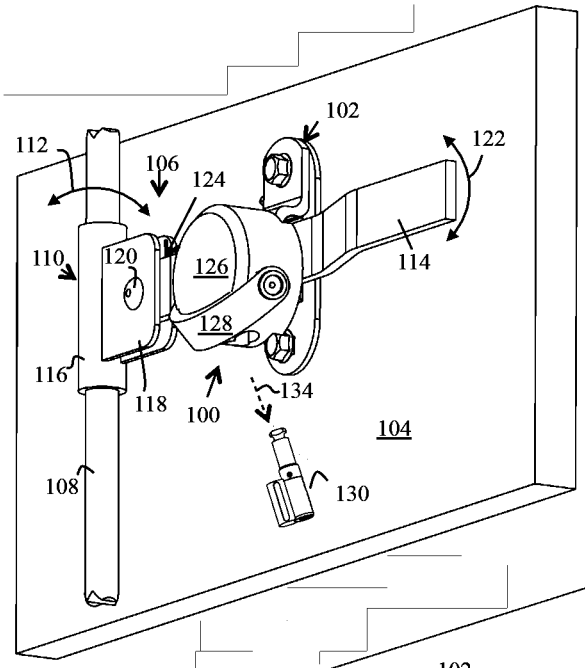
Figures 1, 1A, 2, 3, 4:
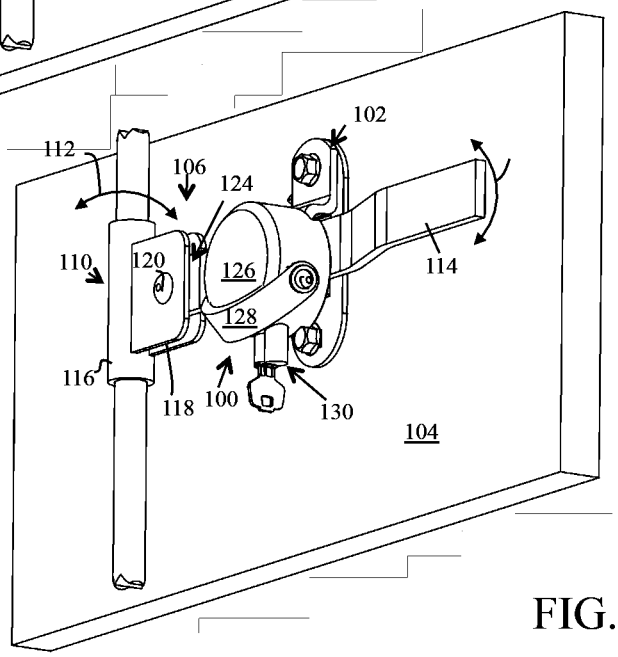
Figures 1, 1A, 2, 3, 4, 5, 6, 7:
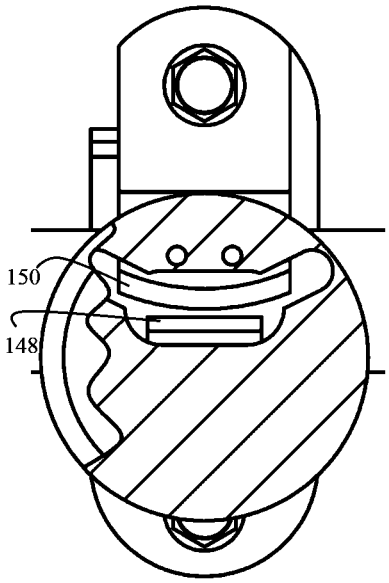
Figures 1, 1A, 2, 3, 4, 5:
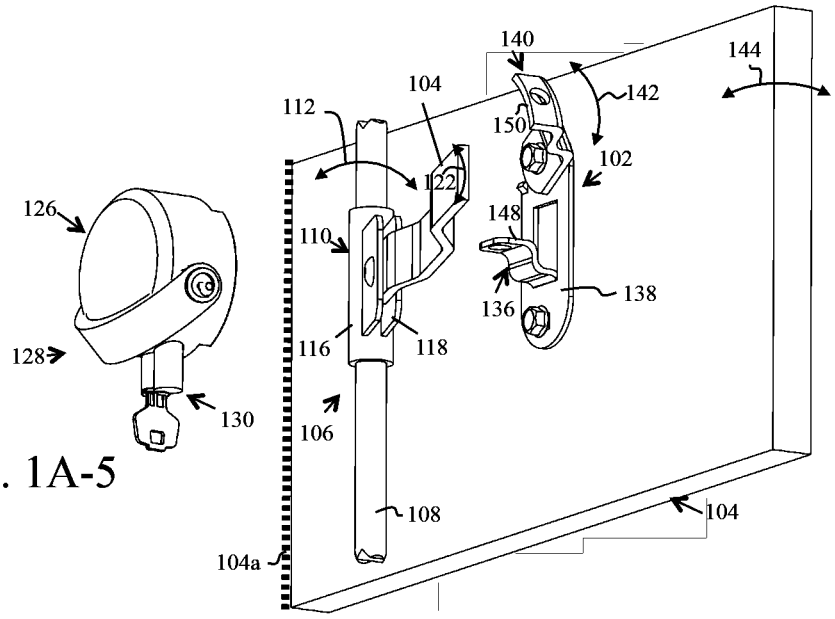
Figures 1, 1A, 2, 3, 4, 5, 6:
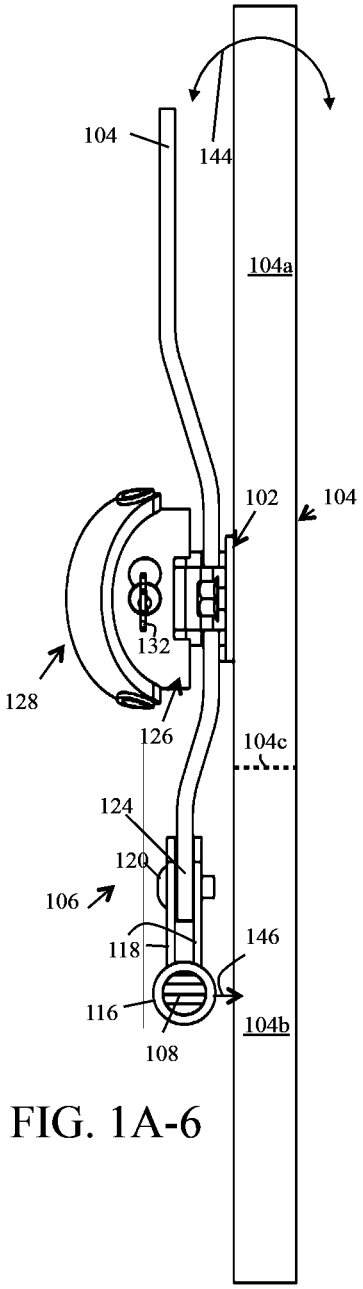
Figures 1, 1B:
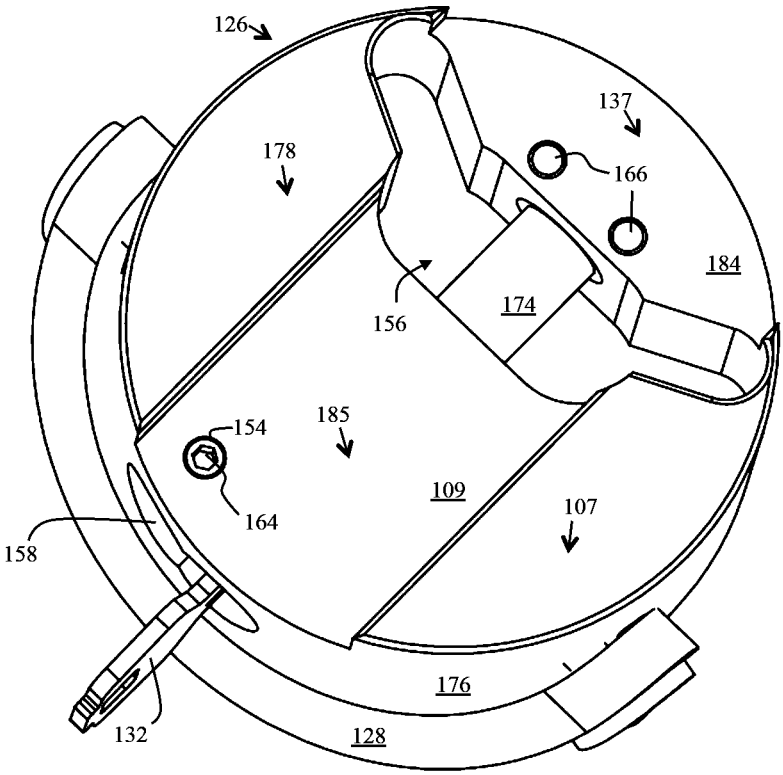
Figures 1, 1B, 2:
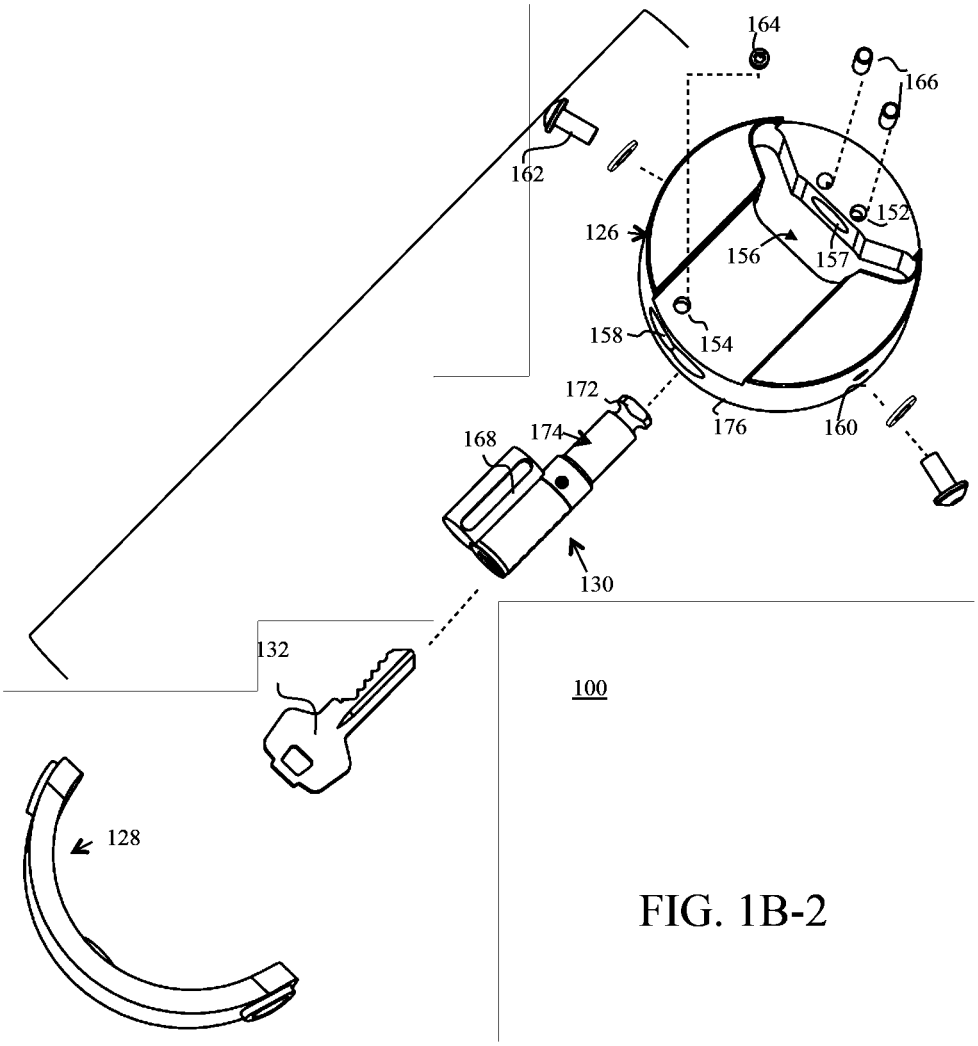

As further illustrated in FIGS. 1A-1 to 1B-1, lock device 100 includes a casing 126 and an optional cover 128 that covers over a core 130 associated with casing 126. Cover 128 may be moved to open position (FIG. 1A-2) to allow access to core 130 of casing 126 for insertion of a key 132 of core 130 to lock or unlock lock device 100. It should be noted that core 130 and its associated key 132 are very well known and conventional.

In order to unlock casing 126 from hasp assembly 102 to unlock and open lock assembly 106 to open cargo door 104 (FIG. 1A-4), cover 128 is first moved to open position (FIG. 1A-2), core 130 is unlocked from casing 126 using key 132, and as best illustrated in FIG. 1A-3, the core 130 may be removed (shown by dashed arrow 134) from casing 126 or, alternatively and as detailed below, slide out only partially while still remain within casing 126 as shown (FIG. 1A-4). Once core 130 partially slides out or is removed, casing 126 may be removed away from hasp assembly 102 to open cargo door 104 (FIG. 1A-5).

As illustrated in FIG. 1A-5, once casing 126 is removed, lock handle 104 is first rotated vertically along path 122 to clear a first member 136 of hasp assembly 102. As is well known, this also vertically moves and clears a locking distal end of the lock bar 108 from a lock position within keeper (also known as "strike," but not shown for simplicity) of the cargo door 104. Next, the lock handle 104 is rotated horizontally along path 112, which also rotates the lock bar 108 to rotate its locking distal end from the keeper. This horizontal rotation also rotates and moves lock handle 114 completely away from cargo door 104 to allow the cargo door 104 open along path 144 to open access to the container (not shown). The illustrated hasp assembly 102 is well known and includes a base 138 that may physically connect to cargo door 104, a first member 136 that is generally stationary and has a first interlock section 148 that is generally flat, and a second member 140 that has a second interlock section 150 that is generally curved, with the second member 140 rotating along reciprocating path 142 to swing into open position shown in FIG. 1A-5, which allows the lock handle 104 to first rotate along path 122 to clear first member 136, and then along path 112 to open position.

FIGS. 1B-1 to 1C-12 are non-limiting, exemplary illustrations of an embodiment of a lock device shown in FIGS. 1A-1 to 1A-7 in accordance with the present invention. As illustrated, lock device 100 in accordance with the illustrated embodiment shown in FIGS. 1B-1 to 1C-12 is comprised of casing 126 that detachably accommodates a well-known and conventional core 130, and may optionally include cover 128 (detailed below). Casing 128 includes at least one pin slot 152 through which interlock pins 166 may be inserted. A portion of the inserted interlock pins 166 may pass through blind-hole cavity 157 (FIG. 1C-1) on opposite sides. The portion of the interlock pins 166 passing though the blind-hole cavity 157 may serve as locking bars. The locking bars formed by interlock pins 166 in the blind-hole cavity 157 receive mating flanges 172 of a shackle 174 of core 130 to lock the locking device 100 in well known manner.

As further illustrated in FIGS. 1B-1 and 1B-2, the casing 128 further includes a retaining hole 154 through which a retaining member 164 passes. The retaining member 164 may be threaded on its external surface. The internal surface of the retaining hole 154 may also be threaded to mate with threads on the retaining member 164. The longitudinal axis of the retaining hole 154 may perpendicularly intersect the longitudinal axis of a side hole 158 located on the side surface 176 of the casing 128 (FIG. 1C-3). When the retaining member 164 is screwed into the retaining hole 154, a portion of the retaining member 164 may protrude into the side hole 158.

Core 130 may be inserted into the side hole 158 such that a longitudinal axis of core 130 is substantially collinear with the longitudinal axis of side hole 158. Core 130 may have any shape and shape of the internal surface of the side hole 130 may resemble the shape of the external surface of the core 130, such that the external surface of the core 130 and the internal surface of the side hole 158 form substantially associated surfaces. The term "associated surfaces" within the context of the above sentence only, refers to surfaces that, at any location, may be substantially parallel to each other. That is, the tangent at any point on one surface is substantially parallel to a tangent from the corresponding point of the other surface (for example, a hand and glove relationship). The external dimensions of core 130 and the internal dimensions of the side hole 158 may be such that core 130 may be able to slide freely within the side hole 158 without interference. It is also contemplated that portions of the external surface of the core 130 may be in contact with the internal surface of the side hole 158.

Core 130 may also include an outer surface with a keyway 168. Keyway 168 may be a slot formed on the surface that extends part way through the thickness of the surface. The keyway 168 may extend longitudinally over part of the length of the core 168 as illustrated. When the core 130 is inserted into the side hole 158 of the casing 128 and the retaining member 164 fastened to the retaining hole 154, the retaining member 164 may extend into the keyway 168. The dimensions of the retaining member 164 may be such that it permits the core 130 to slide freely (travel) a certain distance within the side hole 158 while preventing the core 130 from being pulled out of the side hole 158. As further illustrated in FIGS. 1B-1 and 1B-2, lock device 100 may optionally include cover 128 that may be connected to side surface 176 of casing 126 using fasteners 162 that are fastened within holes 160 on curved side 176 of case 126—the cover 128 is further detailed below.

Figure 1C:
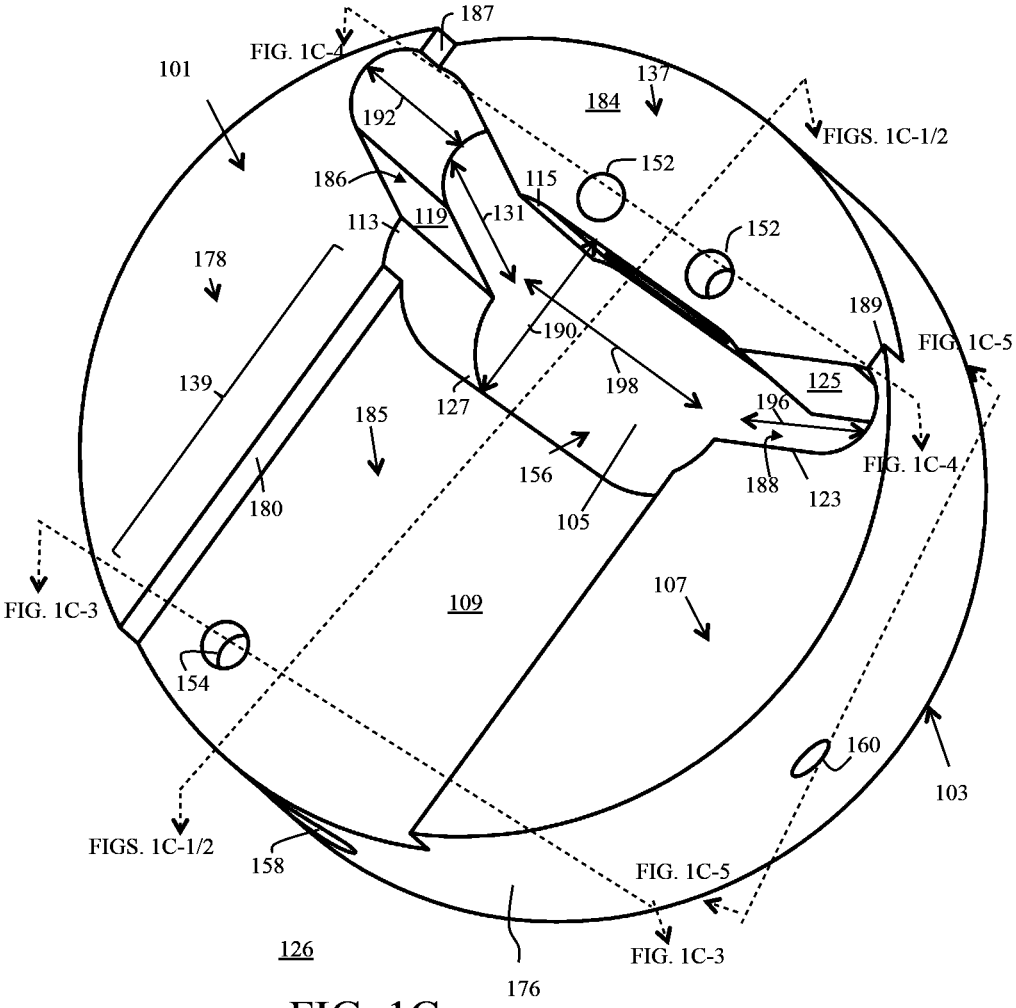
Figures 1, 1C:
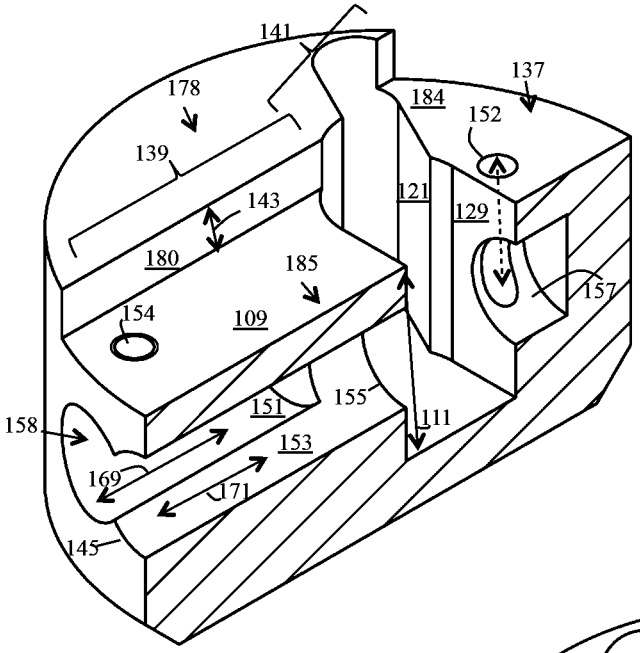
Figures 1, 1C, 2:
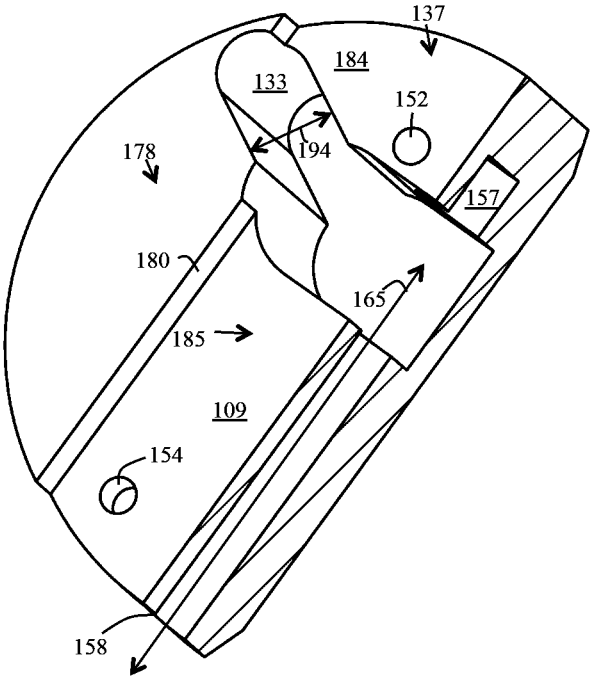
Figures 1, 1C, 2, 3:
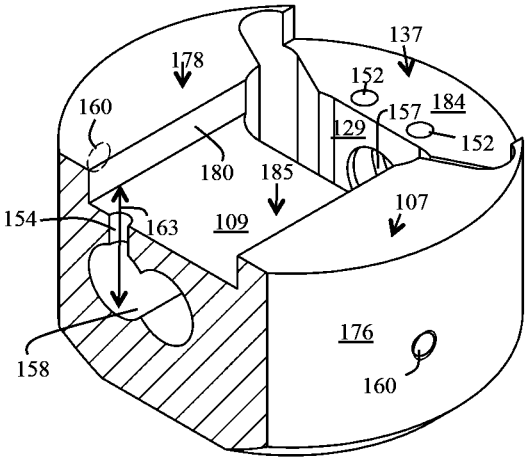
Figures 1, 1C, 2, 3, 4:
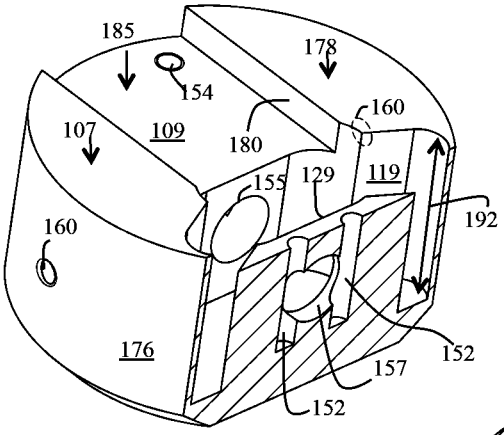
Figures 1, 1C, 2, 3, 4, 5:
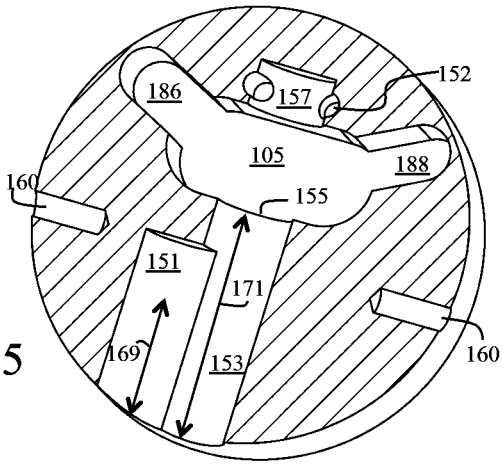
Figures 1, 1C, 2, 3, 4, 5, 6:
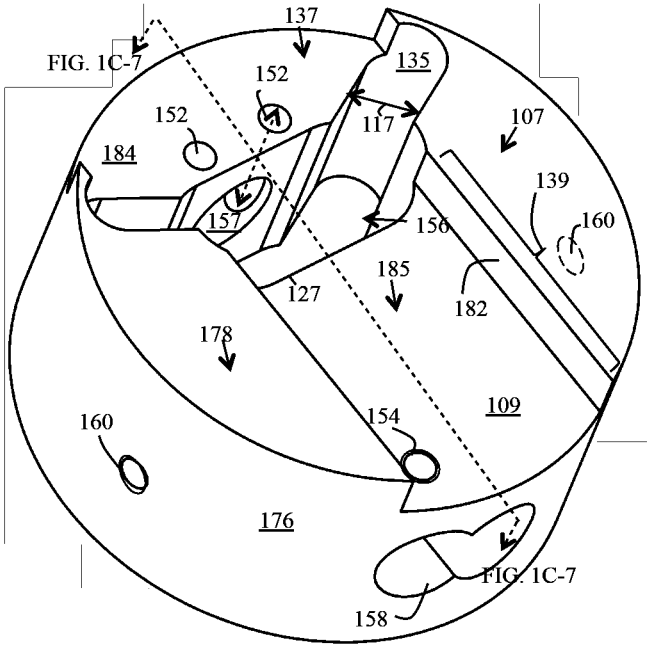
Figures 1, 1C, 2, 3, 4, 5, 6, 7:
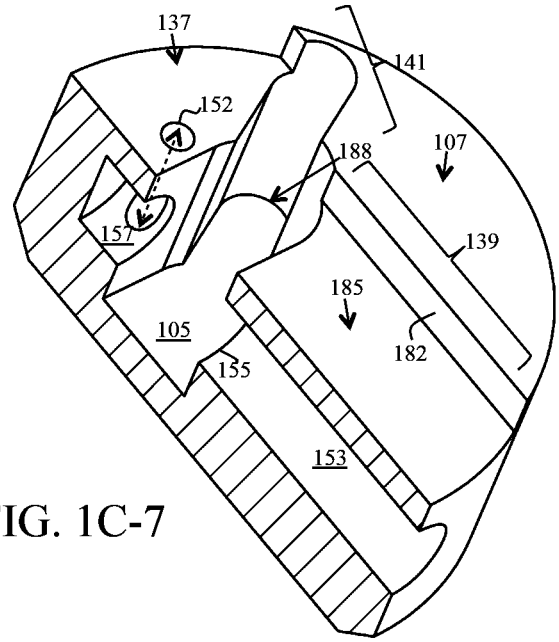
Figures 1, 1C, 2, 3, 4, 5, 6, 7, 8, 9, 10:
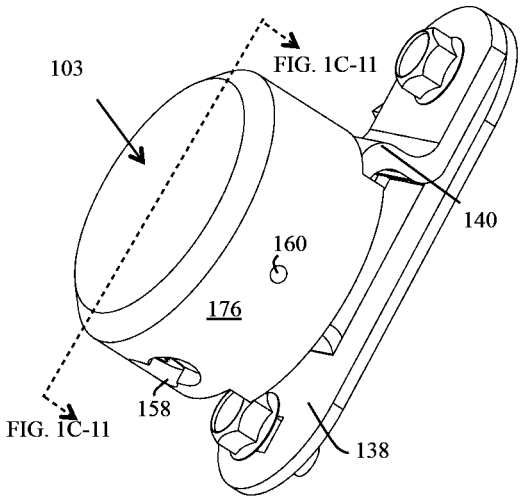
Figures 1, 1C, 2, 3, 4, 5, 6, 7, 8, 9, 10, 11:
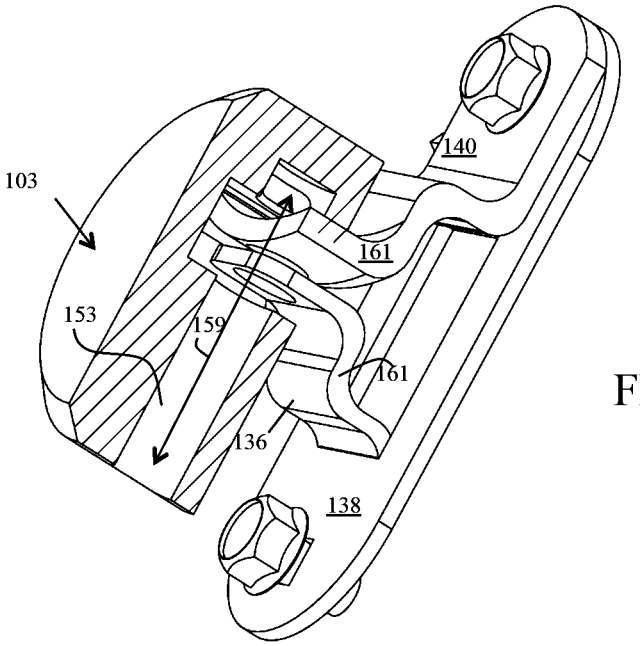
Figures 1, 1C, 2, 3, 4, 5, 6, 7, 8, 9, 10, 11, 12:
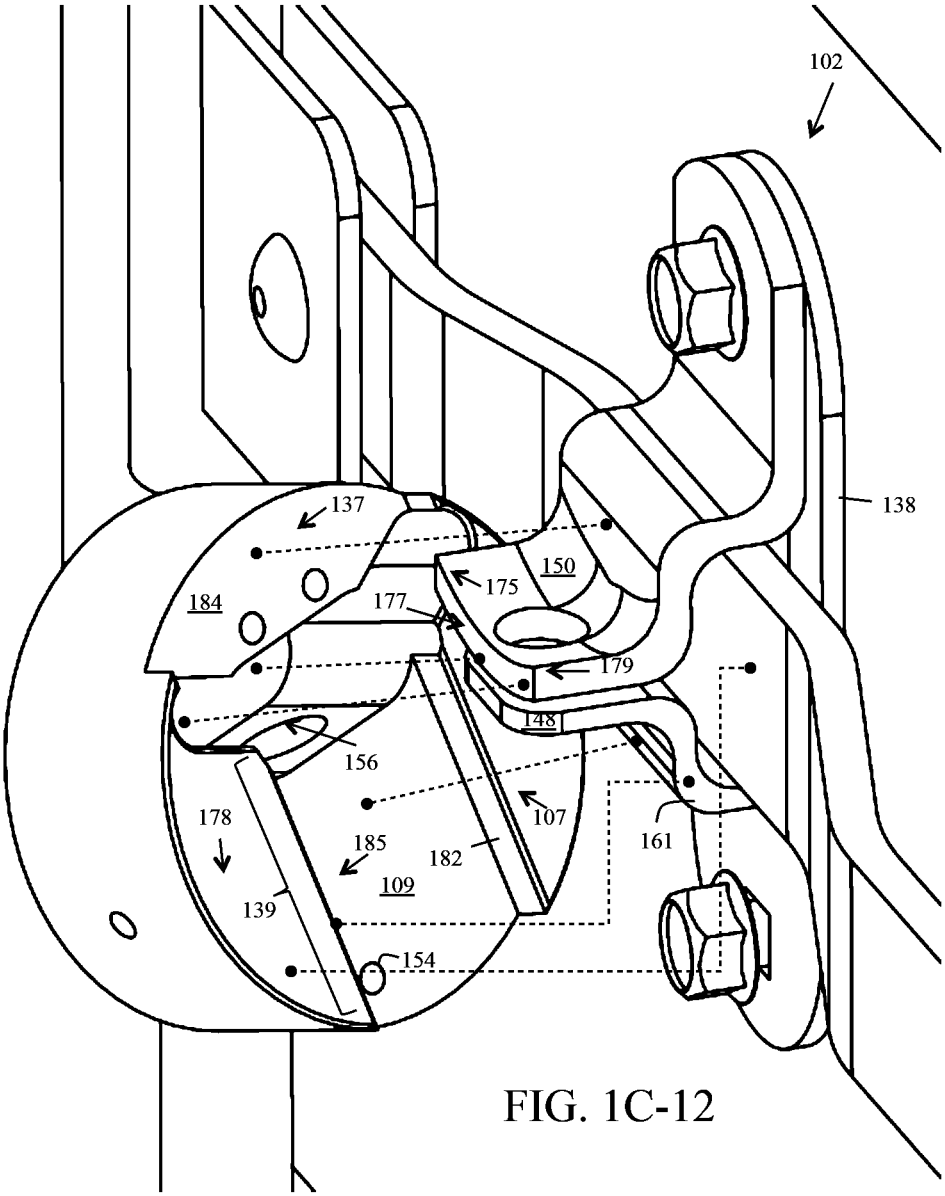
Figures 1, 1D:
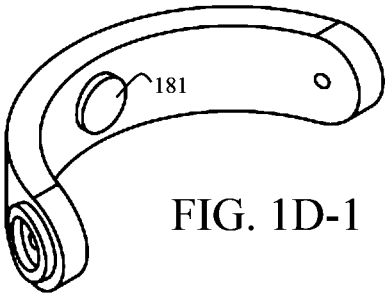
Figures 1, 1D, 2:
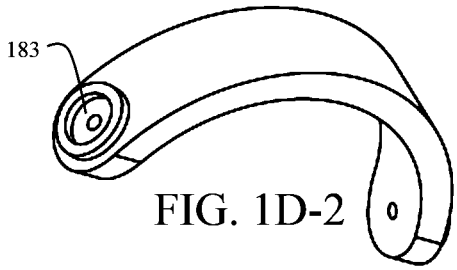
Figures 1, 1D, 2, 3:
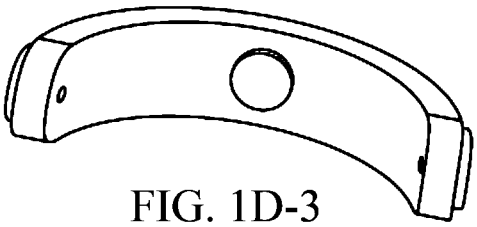
Figures 1, 1D, 2, 3, 4:
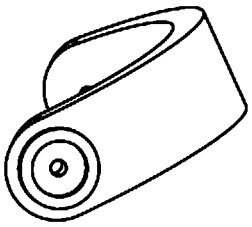
Figures 1, 1D, 2, 3, 4, 5:
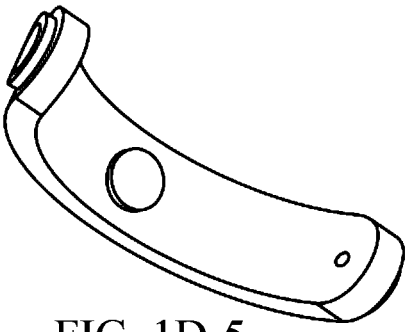
Figures 1, 1D, 2, 3, 4, 5, 6:
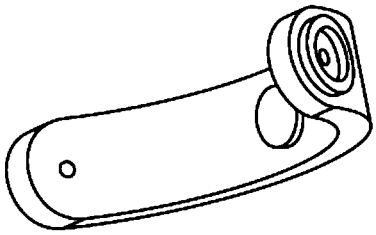

FIGS. 1C to 1C-12 are a non-limiting, exemplary illustration of various views, including sectional views of a casing of a lock device shown in FIGS. 1B-1 and 1B-2. As illustrated, the casing 126 is comprised of a generally circular cross-section with a generally circular front (top side) portion 103 (FIG. 1C-8), a generally circular back (bottom side) portion 101, and a generally cylindrical side surface 176. It is also contemplated that the top side 103, the back side 101, and the side surface 176 may have other shapes. The top side portion 103 and the back side 101 may be planar or may be made up of multiple planar surfaces. The side surface 176 of locking device 100 may include a side hole 158 to insert core 130 of the locking device 100. In some embodiments, the cross-section of the side hole 158 (along a plane perpendicular to the top side 103) has a rounded rectangular shape. However, the cross-section of the side hole 158 may have other shapes, such as a square or an oval shape. One or more keys 132 may also accompany the locking device 100.

Casing 126 has a generally cylindrical configuration having bottom side 101 that includes a bottom side cavity 156, which is generally situated away from a geometric center of casing 126, away from a radial center and towards a periphery curved side 176 of casing 126. Bottom side cavity 156 includes a general mid-section 105 and a first distal section 186 and a second distal-section 188. First and second distal sections 186 and 188 of bottom side cavity 156 are oriented at an angle in relation to the mid-section 105 of bottom side cavity 156. Stated otherwise, first distal section 186, second distal section 188, and mid-section 105 include respective first, second, and third mid-points that are not aligned.

The geometry of bottom side cavity 156 can accommodate several types of hasp assemblies. For example, mid-section 105 alone can accommodate a hasp assembly with flat interlocking sections only, and the combination of mid-section 105 and distal sections 186 and 188 can accommodate hasps such as the hasp assembly 102 with both curved interlocking section 150 and flat interlocking section 148 (best shown in FIGS. 1C-11 and 1C-12).

As further illustrated in FIGS. 1C to 1C-12, the bottom side 101 further includes an offset surface 185 that forms raised edges 180 and 182 in relation to the highest elevation offset surfaces 178 and 107, with the offset surface 185 and the resulting raised edges 180 and 182 forming a relief 109.

As further illustrated, the bottom side 101 also includes offset surface 137 (preferably at the same elevation as the offset surface 185) in relation to the highest elevation surfaces 178 and 107, with offset surface 137 and the resulting raised edges 187 and 189 forming relief 184. In other words, the bottom side 101 may be made of two planar surfaces. However, it is contemplated that the bottom side 101 may be made of one planar surface.

Bottom side cavity 156 has a general depth with a height that extends part way along a thickness (height) of the casing 126. That is, first and second distal sections 186 and 188 have a depth with a height 192 that may be equal but are generally longer than height 111 (FIG. 1C-1) of the depth of the mid-section 105 because height 192 of the first and second distal sections 186 and 188 is measured from higher elevation surfaces 178 and 107 whereas height 111 of the depth of the mid-section 105 is measured from offset surface 137, which is at a lower elevation.

Bottom side cavity 156 has a general bottom side cavity longitudinal axis that extends from first distal-section 186 through mid-section 105, ending at second distal-section 188, defining a length of bottom side cavity 156. In particular, first distal section 186 of bottom side cavity 156 has a first longitudinal axis 131 that extends at a first angle from interior surface wall 133 of curved side 176 of case 126 towards the mid-section 105, forming a first length of first distal section 188. Second distal section 188 of bottom side cavity 156 has a second longitudinal axis 196 that extends at a second angle from interior surface wall 135 of curved side 176 of case 126 towards mid-section 105, forming a second length of second distal section 188. Mid-section 105 of bottom side cavity 156 has a third longitudinal axis 198 that extends from an end of first distal section 186 to an end of second distal section 188, forming a third length. As illustrated, the third length has a longer span than the first and second lengths.

As further illustrated, bottom side cavity 156 has one or more transverse axis 194, 190, and 117 that extend from a general first bottom side cavity wall 113 of bottom side cavity 156 to a second, opposite general bottom side cavity wall 115. In particular, a first transverse axis 194 extends from first side wall 119 of first distal section 186 of bottom side cavity 156 to a second side wall 121 of first distal section 186 of the bottom side cavity 156. Second transverse axis 117 extends from a first side wall 123 of second distal section 188 of bottom side cavity 156 to a second side wall 125 of second distal section 188 of bottom side cavity 156. A mid transverse axis 190 extends from a first side wall 127 of mid-section 105 of bottom side cavity 156 to a second side wall 129 of mid-section 105 of bottom side cavity. As illustrated, both first and second transverse axes 194 and 117 have a different length from that of mid-transverse axis 190.

In this non-limiting, exemplary embodiment, a first combination of first distal-section 186 of bottom side cavity 156 and a first half of mid-section 105 of bottom side cavity 156 may be a mirror image of a second combination of second distal-section 188 of bottom side cavity 156 and a second half of mid-section 105 of bottom side cavity 156. It should be noted that in general, the symmetry is a limitation for the hasp with which casing 126 may be associated so to accommodate the hasp.

As indicated above, bottom side 101 of casing 126 may be made of two planar surfaces. In other words, bottom side 101 may include a first offset surface 185 that forms raised edges 180 and 182 in relation to the highest elevation offset surfaces 178 and 107, with the offset surface 185 and the resulting raised edges 180 and 182 forming relief 109. Further, bottom side 101 may include a second offset surface 137 (preferably at the same elevation as that of offset surface 185) that forms raised edges 187 and 189 in relation to the highest elevation offset surfaces 178 and 107, with the offset surface 137 and the resulting raised edges 187 and 189 forming relief 184. In general, a first portion 139 of raised edges 180 and 182 form an anti-tampering edge, oriented perpendicular the length (or longitudinal axis) of the bottom side cavity 156. A second portion 141 (FIG. 1C-1) of raised edges 180 and 182 partially surrounds the opening of bottom side cavity 156. First portion 139 of the raised edges 180 and 182 define lateral walls of relief 109, forming a channel like section. Second portion 141 of raised edges 180 and 182 surround the opening of the bottom side cavity 156, with relief 184 of the offset surface 137 accommodating interlocking pins 166.

As further illustrated in FIGS. 1B-1 to 1C-12, casing 126 also includes top side 103, and curved side 176 that has side hole 158 for receiving core 130 (FIG. 1C-1). The side hole 158 is comprised of first 147 and second 149 parallel sections (FIG. 1C-9), with the first section 147 of the side hole 158, along a first longitudinal portion of the side hole 158 forms a side cavity 151. Second section 149 of side hole 158 is a through-hole 153, which includes a first distal opening 145 and a second distal opening 155 of side hole 158 that leads into bottom side cavity 156. Through-hole 153 has a central longitudinal axis 171 that is parallel, coincides, and is aligned with a central longitudinal axis of a blind-hole 157 that is positioned within side wall 115 of bottom side cavity 156 (i.e., through-hole 153 and blind hole 157 are collinear 159), and their elevation is at a generally mid-level thickness below the reliefs 109 and 184.

As further illustrated, longitudinal axis 163 of retaining hole 154 (FIG. 1C-3) may perpendicularly intersect the longitudinal axis 165 of the side hole 158 (that is, axis 163 more specifically intersects longitudinal axis 169 of side cavity 151 of side hole 158). When the retaining member 164 is fastened into the retaining hole 154, a portion of the retaining fastener 164 may protrude into the side hole 158 to engage with the keyway 168 of core 130.

As best illustrated in FIGS. 1C-11 and 1C-12, reliefs 109/184 have sufficient depth to accommodate protruding portions of surfaces of hasp assembly 102 with which the bottom side 101 associates (with the associations illustrated as dotted-end dashed lines in FIG. 1C-12). Further, first portion 139 of raised edges 180 and 182 have sufficient height 143 to abut against and block access to lateral edges 161 of surfaces of hasp assembly 102, which prevent tampering.

The depths of the reliefs 109/184 to accommodate various sections of the surfaces of an article such as a locking assembly allow the casing to correctly mount onto the lock assembly. That is, the various elements of the lock assembly are fully accommodated within the reliefs so that lock device properly "hangs" due to gravity vertically, parallel an enclosure for a correct mounting with the lock assembly. More specifically, the depths allow casing 126 to mount in a proper orientation (best illustrated in FIG. 1C-11) onto the hasp where the interlock sections holes 161 and 163 of the hasp and the side hole 158 and blind hole 157 are all aligned (or collinear 159).

As further illustrated in FIGS. 1C-11 and 1C-12, casing 126 includes bottom side cavity 156 with first distal section 186 that accommodates a first curved end 175 of second interlock section 150, mid-section 105 that accommodates the mid-portion 177 of second interlock section 150 and first interlock section 148, and second distal section 188 that accommodates a second curved end 179 of second interlock section 150.

Accordingly, unlike the conventional lock devices, the casing of the present invention is no longer dependent on the configuration of the front facing surface of the body of the hasp as it has sufficient depth to accommodate most variations. Further, unlike the conventional "anti-tampering" mechanism to prevent torque attack, the casing of the present invention does not require having a special mating surface on the front facing surface of the body of the hasp, but the raised edges of the casing function as anti-tampering by simply abutting against the lateral edges of the hasp members. Accordingly, the present invention provides a lock device that may be used with most types of conventional hasp assemblies and has wider margins of tolerances for accommodating variations in hasp assemblies.

FIGS. 1D-1 to 1D-6 are non-limiting, exemplary illustrations of a cover in accordance with one or more embodiments of the present invention. As illustrated, distal ends of cover 128 include coupling schemes 183 that allow cover 128 to be associated with the casing 126, with an enclosure portion 181 of cover 128 resting within the opening of side hole 158. Non-limiting, examples of material from which cover 128 may comprise of may include silicone, robber, etc.

FIG. 2A-1 to 2B-16 are non-limiting, exemplary illustrations of a lock device, including various views of a casing thereof in accordance with one or more embodiments of the present invention. Lock device 200 illustrated in FIGS. 2A-1 to 2B-16 includes similar corresponding or equivalent components, interconnections, functional, and or cooperative relationships as lock device 100 that is shown in FIGS. 1A-1 to 1D-6, and described above. Therefore, for the sake of brevity, clarity, convenience, and to avoid duplication, the general description of FIGS. 2A-1 to 2B-16 will not repeat every corresponding or equivalent component, interconnections, functional, and or cooperative relationships that has already been described above in relation to lock device 100 that is shown in FIGS. 1A-1 to 1D-6.

Figures 1, 2A:
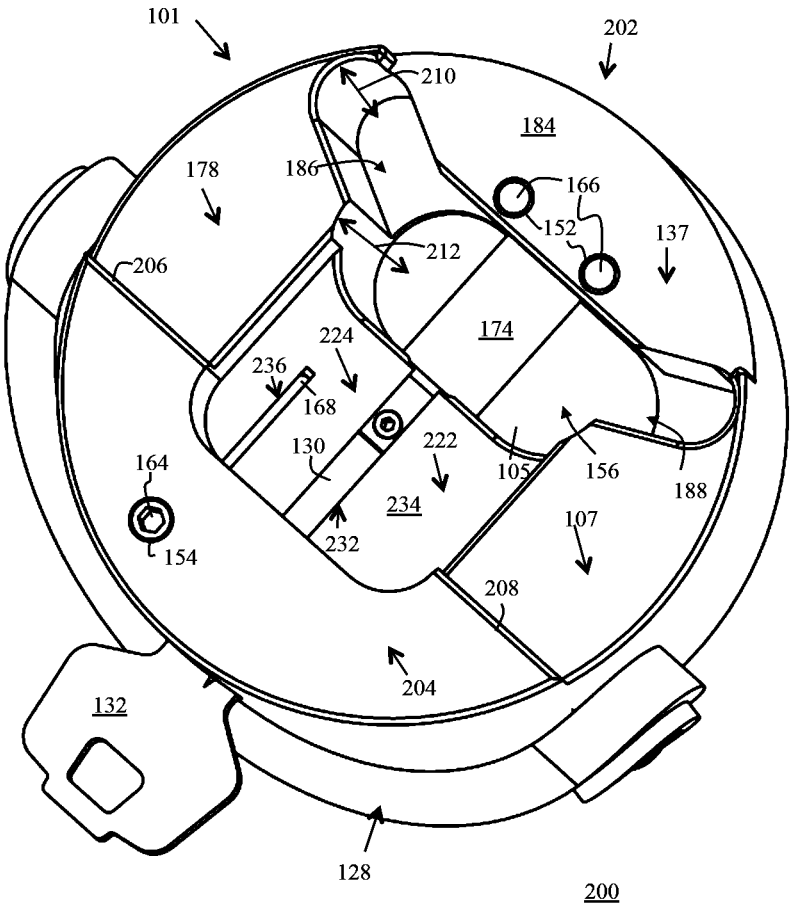
Figures 2, 2A:
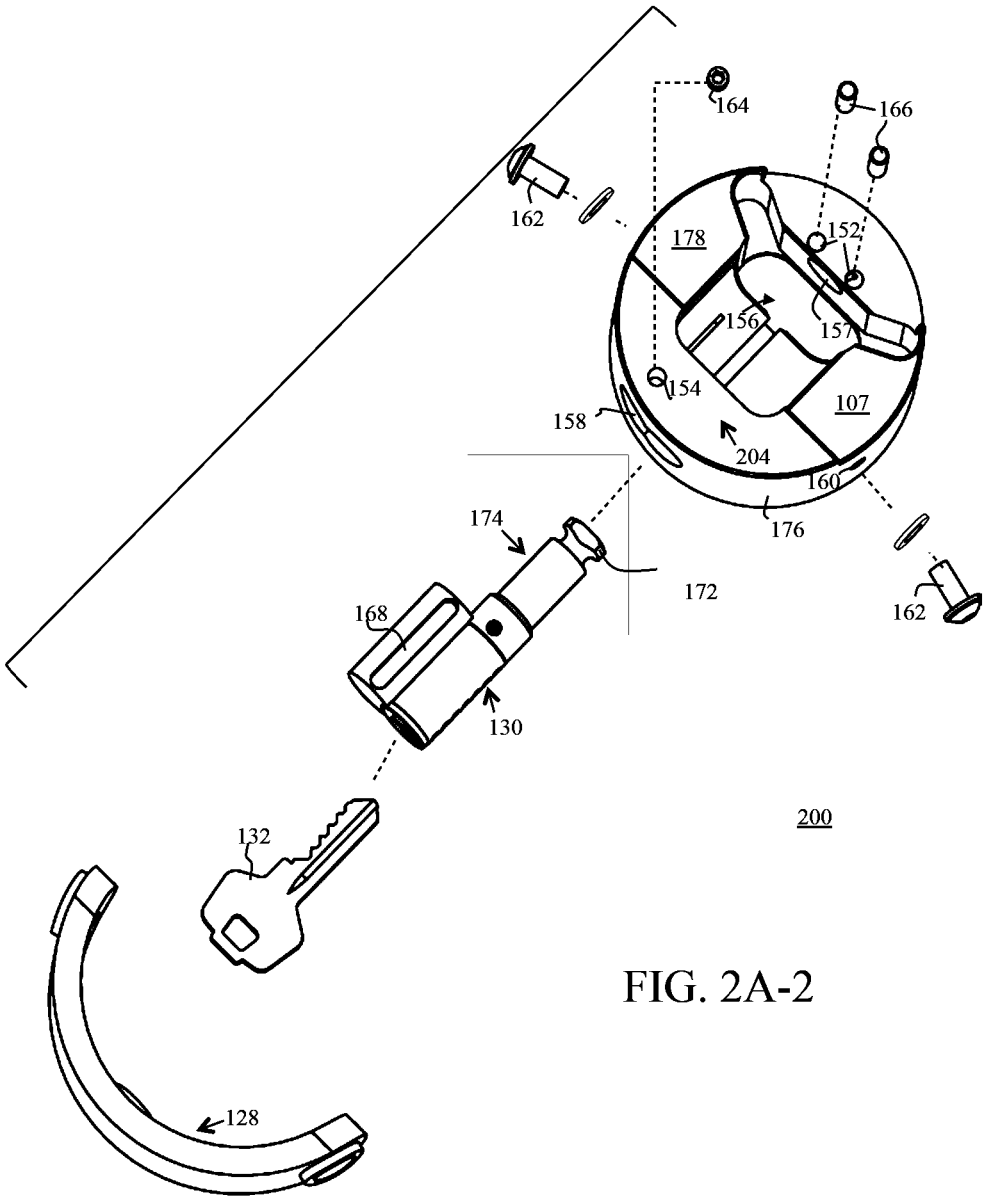
Figures 1, 2B:
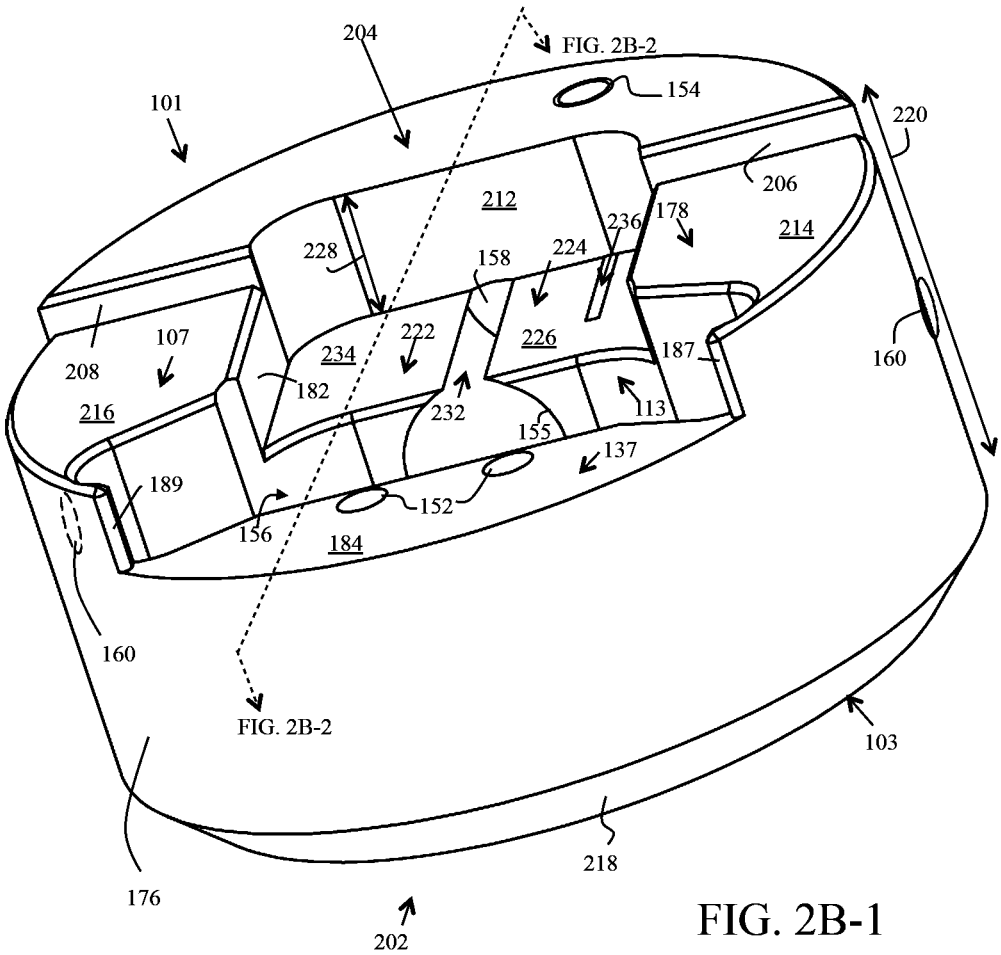
Figures 2, 2B:
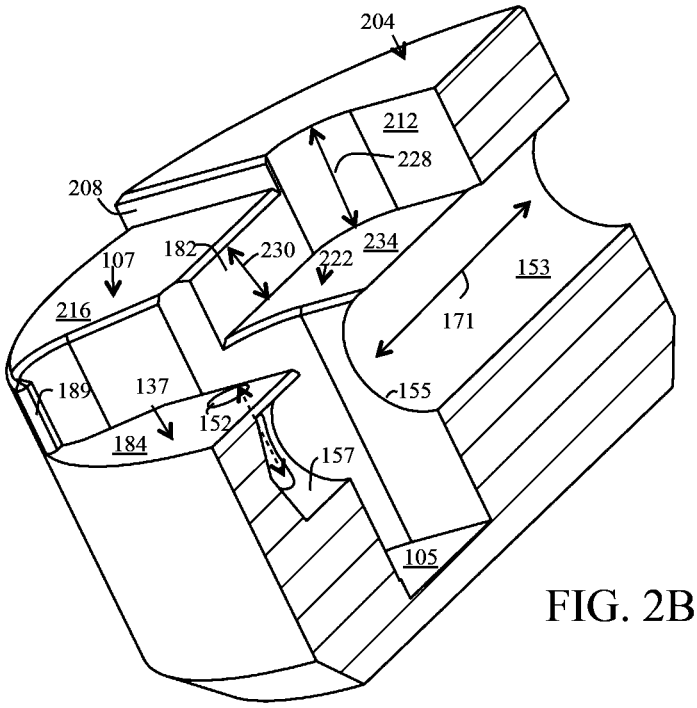
Figures 2, 2B, 3:
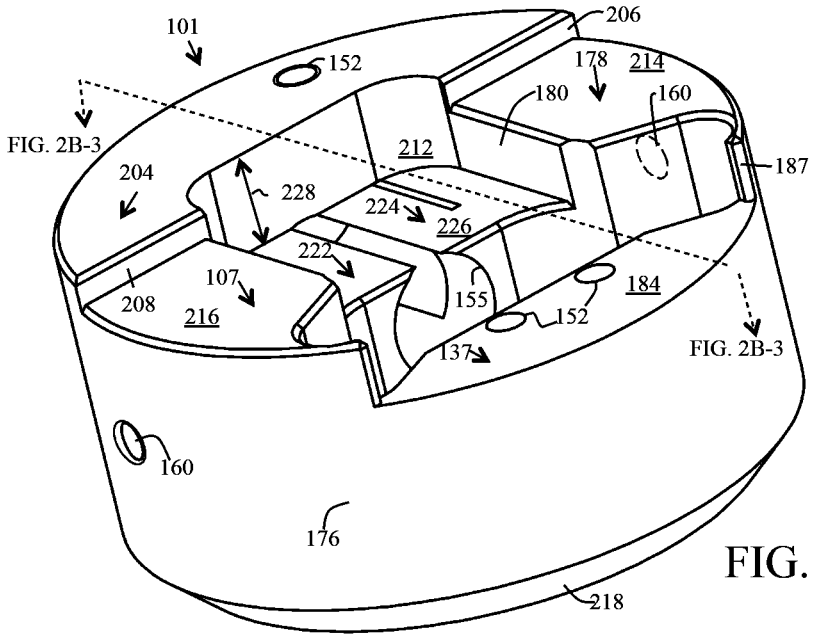
Figures 2, 2B, 3, 4:
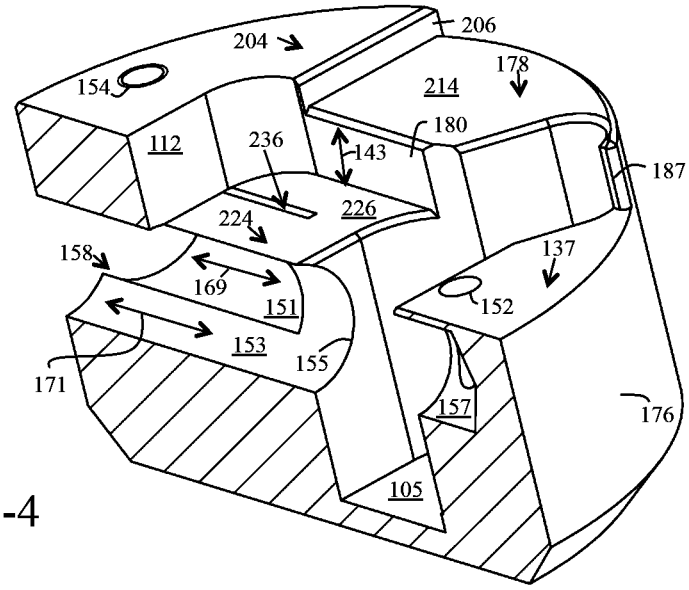
Figures 2, 2B, 3, 4, 5:
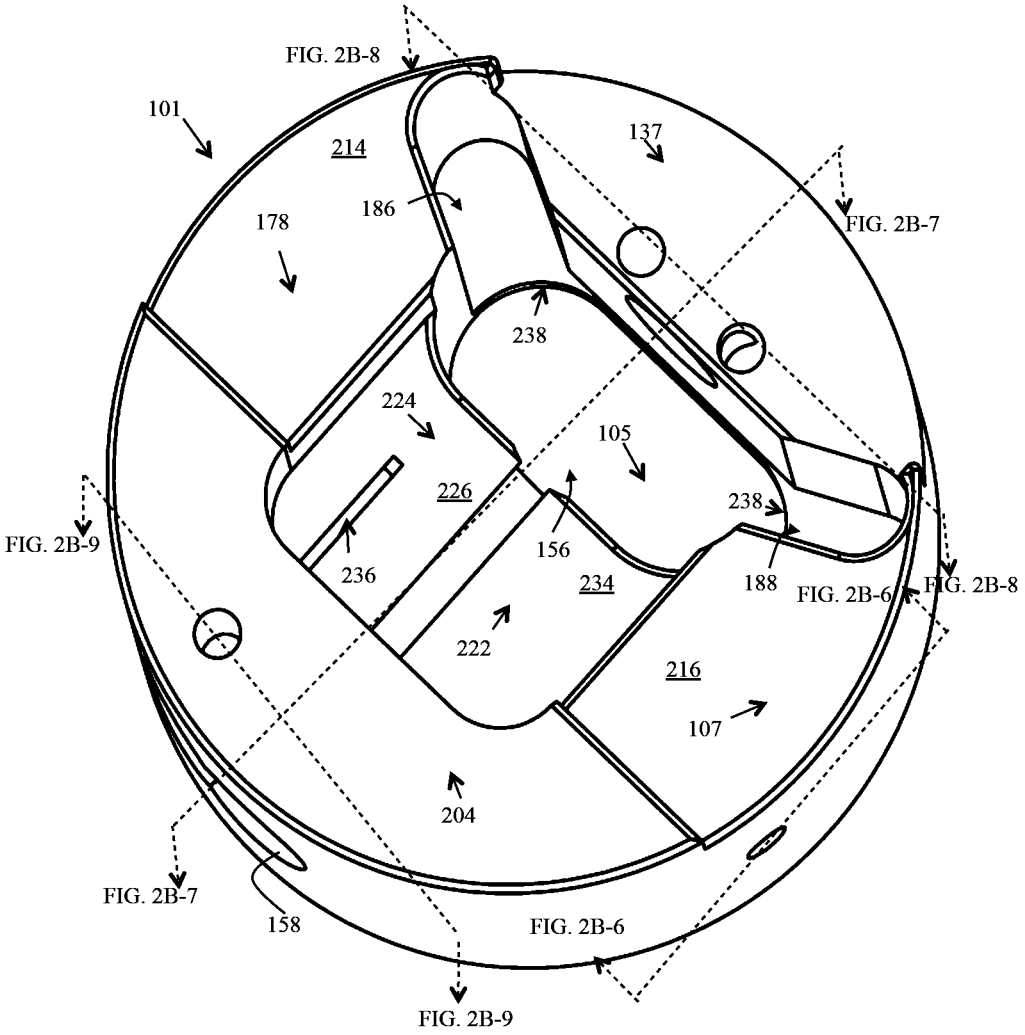
Figures 2, 2B, 3, 4, 5, 6:
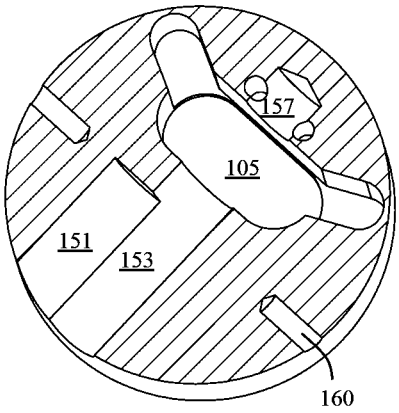
Figures 2, 2B, 3, 4, 5, 6, 7:
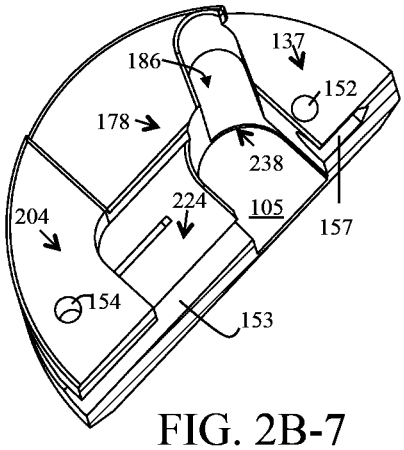
Figures 2, 2B, 3, 4, 5, 6, 7, 8:
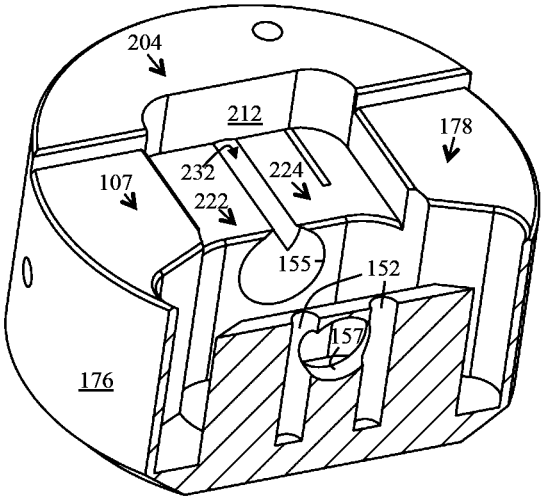
Figures 2, 2B, 3, 4, 5, 6, 7, 8, 9:
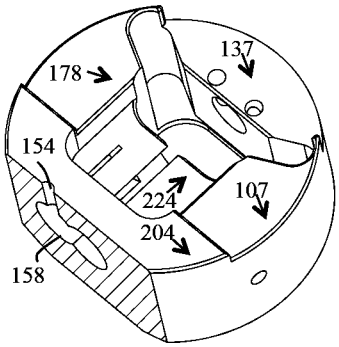
Figures 2, 2B, 3, 4, 5, 6, 7, 8, 9, 10:
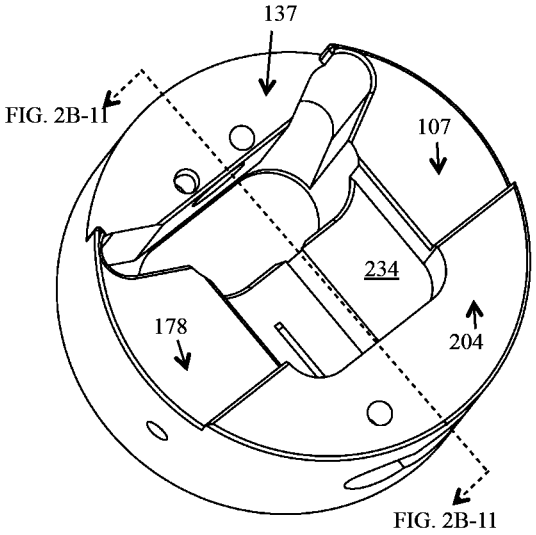
Figures 2, 2B, 3, 4, 5, 6, 7, 8, 9, 10, 11, 12:
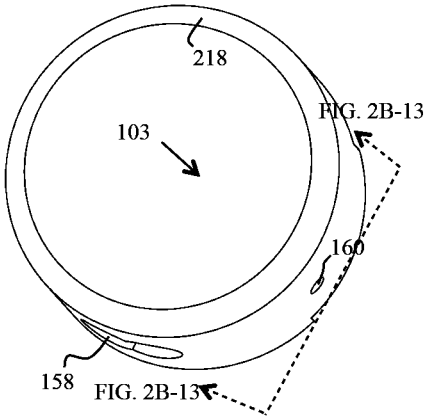
Figures 2, 2B, 3, 4, 5, 6, 7, 8, 9, 10, 11:
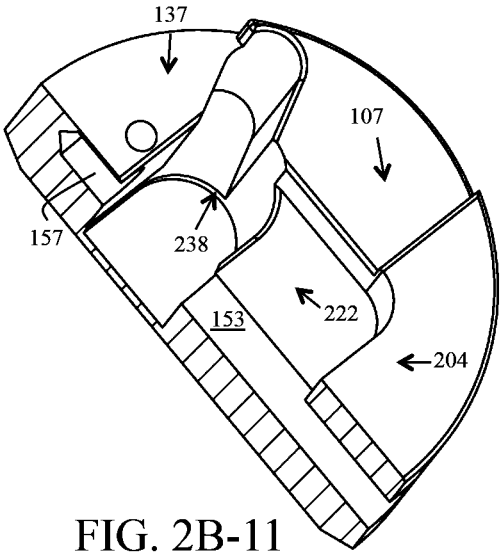
Figures 2, 2B, 3, 4, 5, 6, 7, 8, 9, 10, 11, 12, 13:
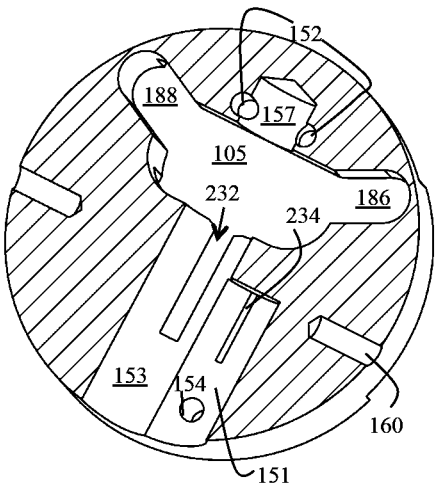
Figures 2, 2B, 3, 4, 5, 6, 7, 8, 9, 10, 11, 12, 13, 14:
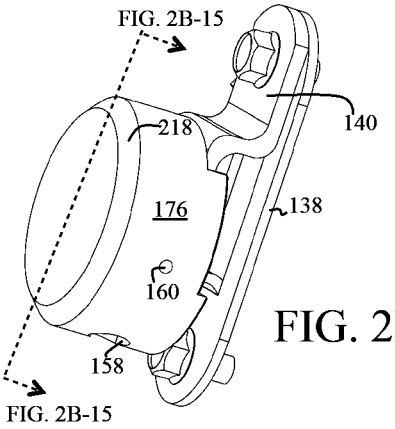
Figures 2, 2B, 3, 4, 5, 6, 7, 8, 9, 10, 11, 12, 13, 14, 15:
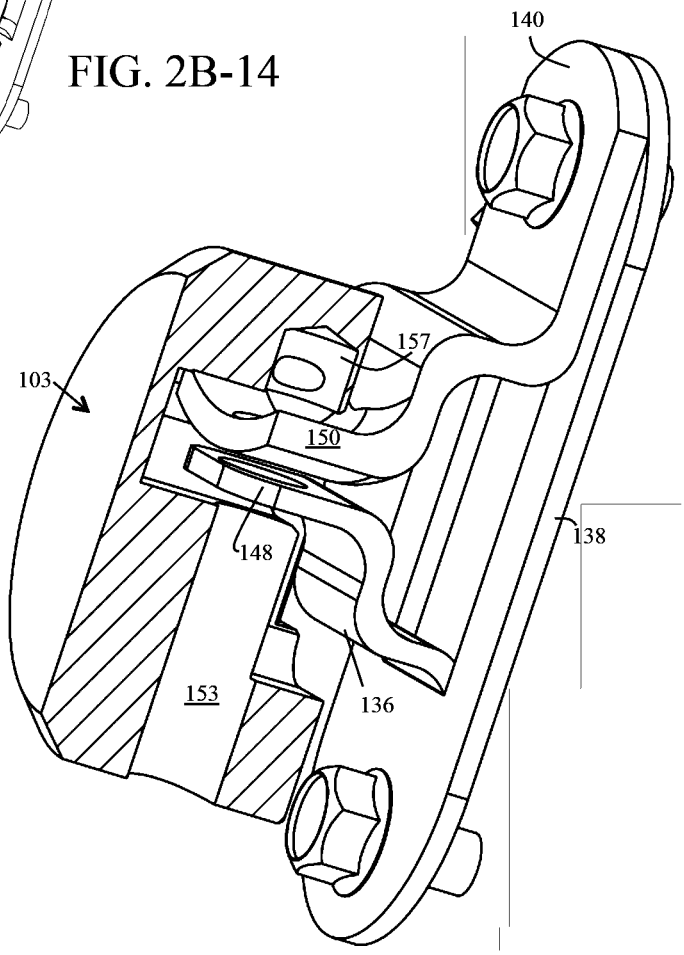
Figures 2, 2B, 3, 4, 5, 6, 7, 8, 9, 10, 11, 12, 13, 14, 15, 16:
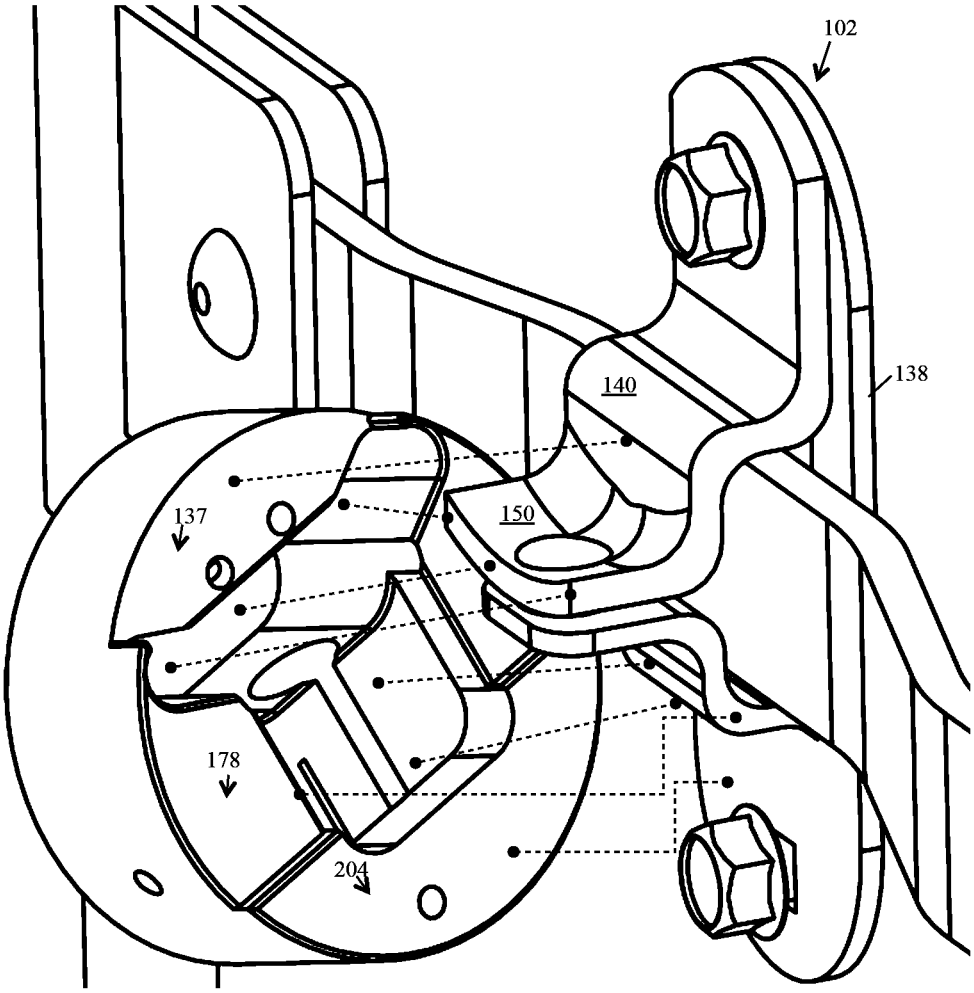

FIG. 2A-1 is a non-limiting exemplary illustration of a fully assembly lock device 200 in accordance with the present invention, with FIG. 2A-2 illustrating an exploded view thereof. FIGS. 2B-1 to 2B-16 are various view of casing 202 of lock device 200, including various sectional views thereof. Securing operations of lock device 200 in relation to lock and hasp assemblies are generally shown in FIGS. 1A-1 to 1A-6, which are similar to those described and shown for lock device 100.

As illustrated in FIGS. 2A-1 to 2B-16, in this non-limiting, exemplary embodiment of the present invention, casing 202 of lock device 200 may have a generally cylindrical configuration having a bottom side 101 that has a topography that is generally a negative topography of a surface of an article such as hasp assembly 102 with which the bottom side 101 associates. The topography of the bottom side 101 is defined by a plurality of offset surfaces (204, 107, 178, 137, 222, 224) that define raised edges (206, 208, 212, 180, 182) with the offset surfaces and resulting raised edges forming reliefs (214, 216, 234, 226, 184). The reliefs have sufficient depth to accommodate protruding portions of the surface of the article with which the bottom side 101 associates and to allow casing 202 to mount in a proper orientation onto the locking assembly. The resulting raised edges having sufficient height to abut against and block access to lateral edges of the surface of the article, and cover over one or more protruding portions of the surface of the article. In this non-limiting, exemplary instance, the article may be hasp assembly 102.

As with lock device 100, non-limiting, exemplary instance of casing 202 of lock device 200 includes a bottom side cavity 156 for accommodating a hasp or the like to allow shackle 174 of the core 130 to engage casing 202 with a hasp. Bottom side cavity 156 extends in part way along a height of the casing 202, commencing from one or more of the offset surfaces (in this non-limiting exemplary instance, from offset surface 137, 234, and 226) for accommodating a hasp assembly. Bottom side cavity 156 includes side walls, with a general first side wall 113 having through-hole 153 of side hole 158, and a second, opposite side wall 115 a blind hole cavity 157. Mid-section 105 of the bottom side cavity 156 has a depth with a loner span than a depth of the distal sections 188 and 186, forming a small "step" 238 between mid-section 105 and distal sections 188/186 (or almost as a slight "second, lower compartment mid-section 105 compared with distal sections 188/186") due in part to the exterior beveled edge 218 of the casing 202, which are merely for esthetics. The esthetical beveled exterior edges 218 take away material from casing 202 and hence, provide less material for distal sections 186 and 188 to have depths that are similar to that of mid-section 105. Regardless, the depth of bottom side cavity 156 as a whole must be sufficient in span to accommodate the interlock sections of a hasp.

As indicated above, bottom side 101 of casing 202 includes plurality of offset surfaces (204, 178, 107, 137, 222, 224) at varying elevations along a height 220 of casing 202 that define variations in thickness of casing 202 and form a plurality of raised edges 206, 208, 212, 180, and 182. The offset surfaces and the resulting raised edges form a plurality of reliefs 214, 216, 234, 226, and 184 at varying elevations along height 220 of casing 202.

In particular, a first offset surface 107 of the plurality of offset surfaces in relation to highest elevation offset surface 204 forms first raised edge 208 of the plurality of raised edges, defining a first anti-tampering edge 208 and a first relief 216 of the plurality of reliefs. A second offset surface 178 of the plurality of offset surfaces in relation to highest elevation surface 204 forms a second raised edge 206 of the plurality of raised edges, defining a second anti-tampering edge 206 and a second relief 214 of the plurality of reliefs. It should be noted that optionally, highest elevation offset surface 204 may be milled off completely, but it is preferably included because it may block and prevent a pry or physical attack on hasp or shackle 174 from bottom side 101. As illustrated, highest elevation offset surface 204 and respective first and second anti-tampering edges 208 and 206 are situated away from a geometric center of casing 202, away from a radial center and towards a periphery curved side 176 of casing 202. That is, highest elevation offset surface 204 and respective first and second anti-tampering edges 208 and 206 are positioned opposite, but parallel longitudinal axis of bottom side cavity 156 (perpendicular to side hole 158).

A third offset surface 222 of the plurality of offset surfaces in relation to highest elevation offset surface 204 and first offset surfaces 107 form a first portion of third raised edge 212 and fourth raised edges 182 of the plurality of raised edges, defining third and fourth anti-tampering edges 212 and 182, and third relief 234 of the plurality of reliefs. As illustrated, a continuous portion of fourth raised edges 182 partially surrounds an opening of bottom side cavity 156, similar to casing 126 of lock device 100.

A fourth offset surface 224 of the plurality of offset surfaces in relation to highest elevation offset surface 204 and second offset surfaces 178 form second portion of third raised edge 212 and fifth raised edges 180 of the plurality of raised edges, defining third and fifth anti-tampering edges 212 and 180, and fourth reliefs 226 of the plurality of reliefs. As illustrated, a continuous portion of fifth raised edges 180 partially surrounds the opening of bottom side cavity 156, similar to casing 126 of lock device 100. The third and fourth reliefs 234 and 226 have sufficient depth to accommodate protruding portions of surfaces of a lock hasp with which bottom side 101 of casing 202 associates and to allow casing 202 to mount in a proper orientation onto lock hasp assembly. Further, respective third, fourth, and fifth raised edges 212, 182, and 180 have sufficient height to abut against and block access to lateral edges 161 of surfaces of lock hasp assembly, which prevent tampering.

In general, highest elevation offset surface 204 and third raised edge 212 are situated away from a geometric center of casing 202, away from a radial center and towards a periphery curved side 176 of casing 202, opposite bottom side cavity 156. Third raised edge 212 has a height 228 that is longer than respective heights 143 and 230 of fourth and fifth raised edges 182 and 180, which block access to lateral edges 161 of the surfaces of the lock hasp assembly, preventing tampering.

As further illustrated, there is a first gap, opening, or slot 232 between third offset surface 222 and fourth offset surface 224 and further, there is a second gap, opening, or slot 236 partway on fourth offset surface 224. The gaps 232 and 236 are openings that lead to the side hole 158, which are the result of milling off sufficient material from casing 202 so that portions of the offset surfaces 222 and 224 become very thin and other portions are fully removed, forming the gaps to reach or lead to side hole 158. Accordingly, the milling off of the offset surfaces 222 and 224 decreases their thickness and hence, the distance from the top of the offset surfaces 222 and 224 to the center of side hole 158 (and its corresponding blind hole cavity 157). The amount by which the offset surfaces 222, 224, and 137 are milled off is related to the dimensions of protruding surfaces of hasp assembly to allow proper alignment (or "collinearity"). That is, when casing 202 is brought into locking position with the hasp assembly 102, the center point of the locking hole of the interlock sections 150/148 of hasp assembly 102 is inserted into bottom side cavity 156 should in general be collinear with the center of the through-hole 153 and blind-hole 157 to allow shackle 174 to pass through the through-hole 153, the interlocking holes of hasp, and into the blind-hole 157. Accordingly, the reliefs 234, 226, and 184 in this embodiment have a low elevation to accommodate hasp connection sections with longer spans. Therefore, the amount by which the elevation of the relief 234, 226, and 184 is lowered (milled off) is commensurate with amount of distance of the hasp hole from the cargo door 104. In other words, the distance of the general horizontal span and the amount by which the generally vertical span is positioned away from the base of hasp dictates the elevation level of the relief 234, 226, and 184 in relation to the center of the blind hole to align the locking holes of the hasp with the general centers of the thought-hole and the blind hole.

Figures 1, 3A:
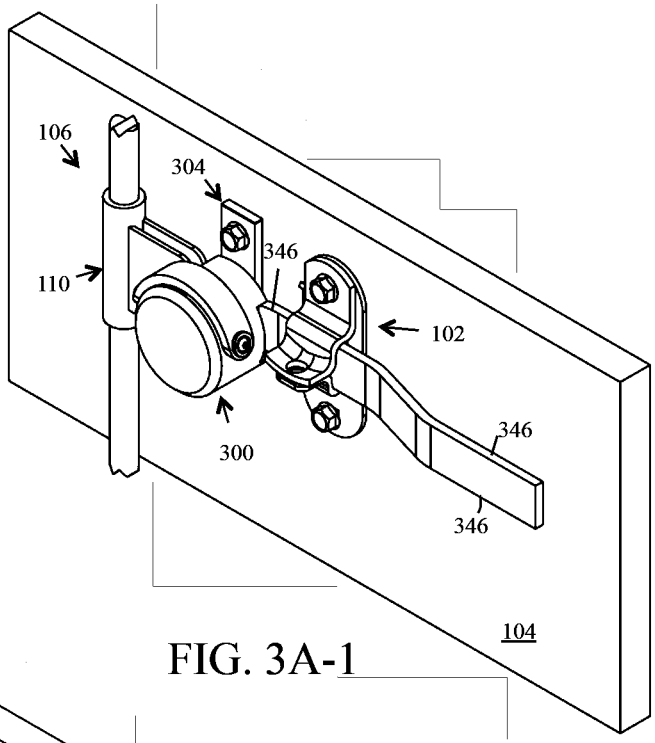
Figures 2, 3A:
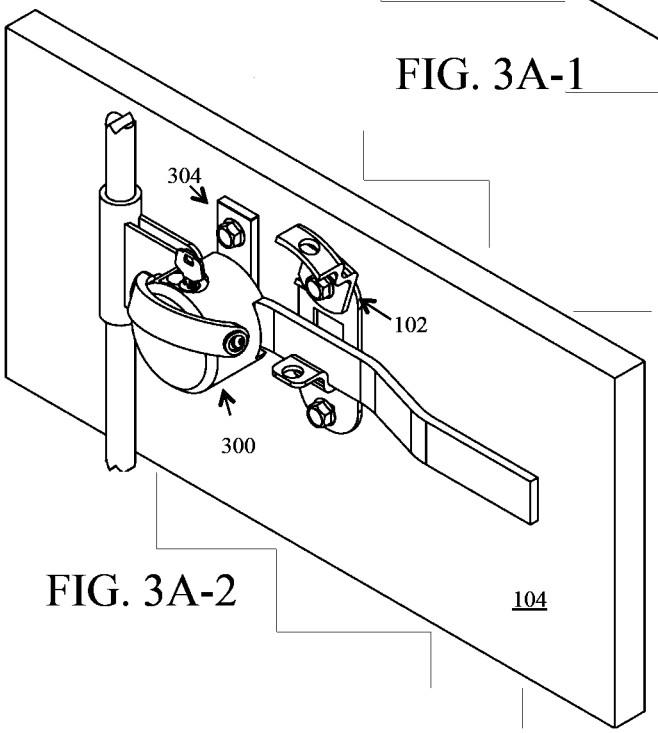
Figures 3, 3A:
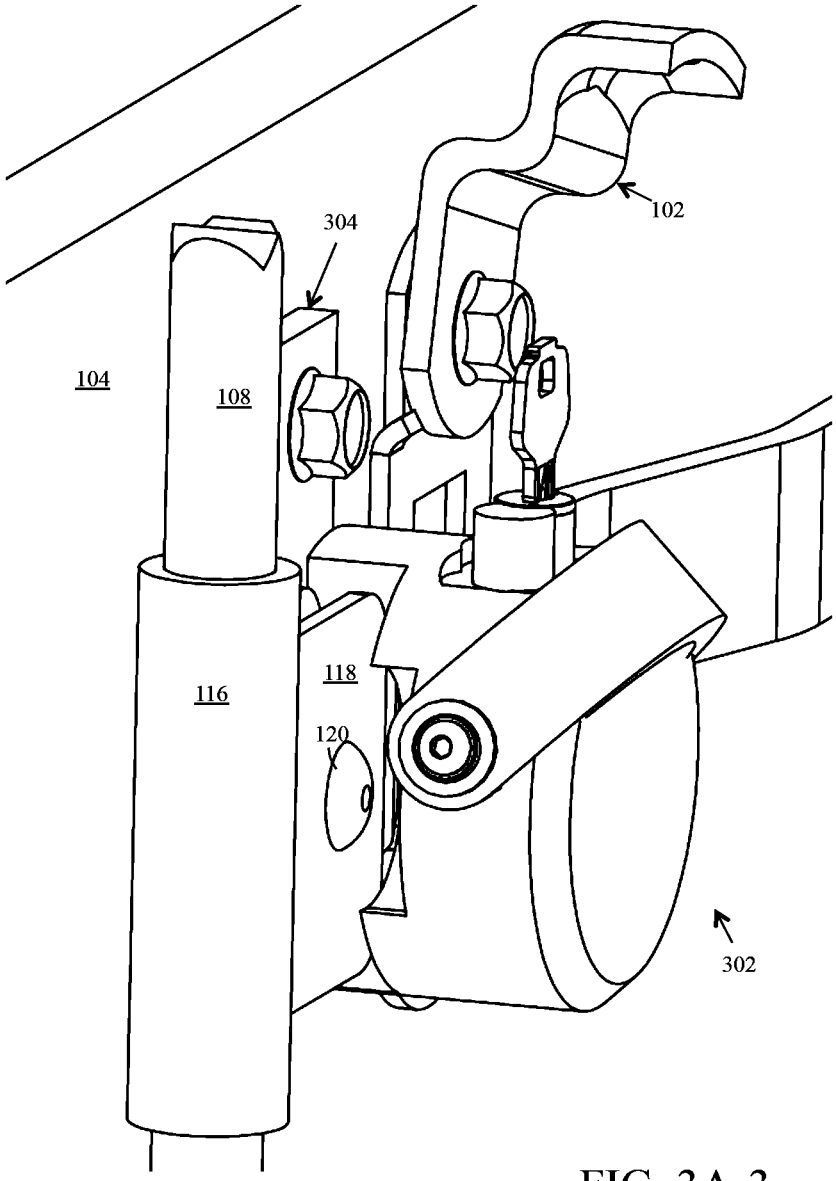
Figures 3, 3A, 4:
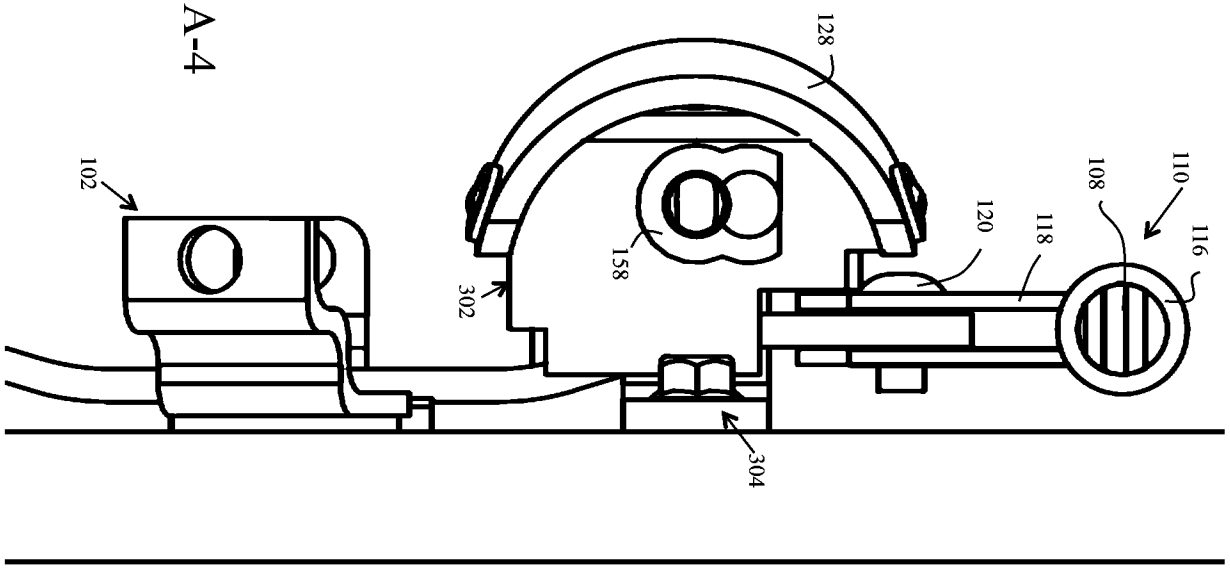
Figures 1, 3B:
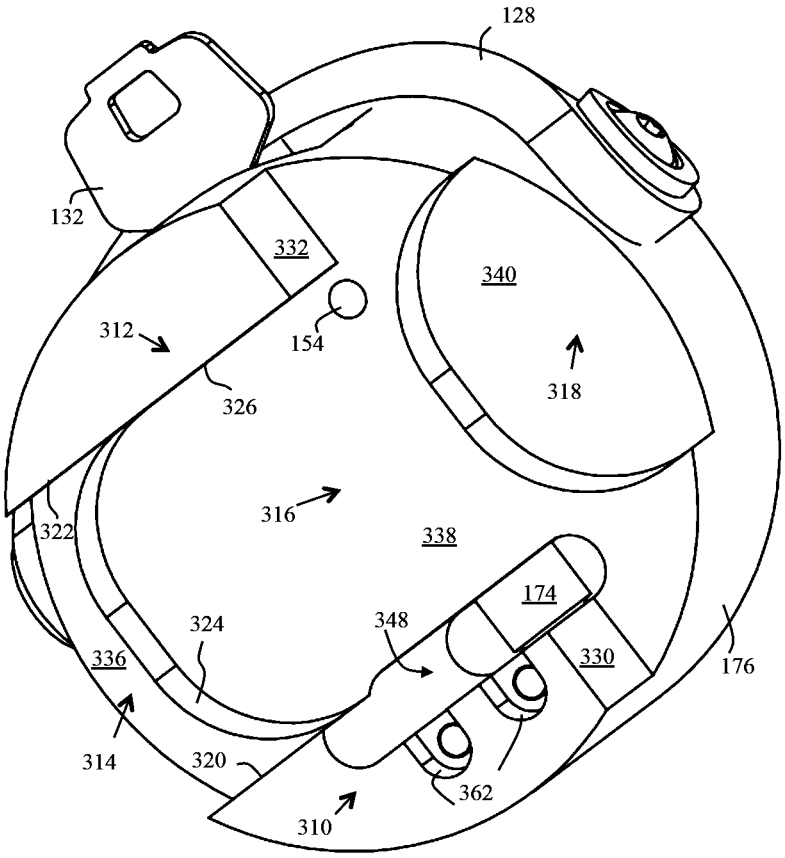
Figures 2, 3B:
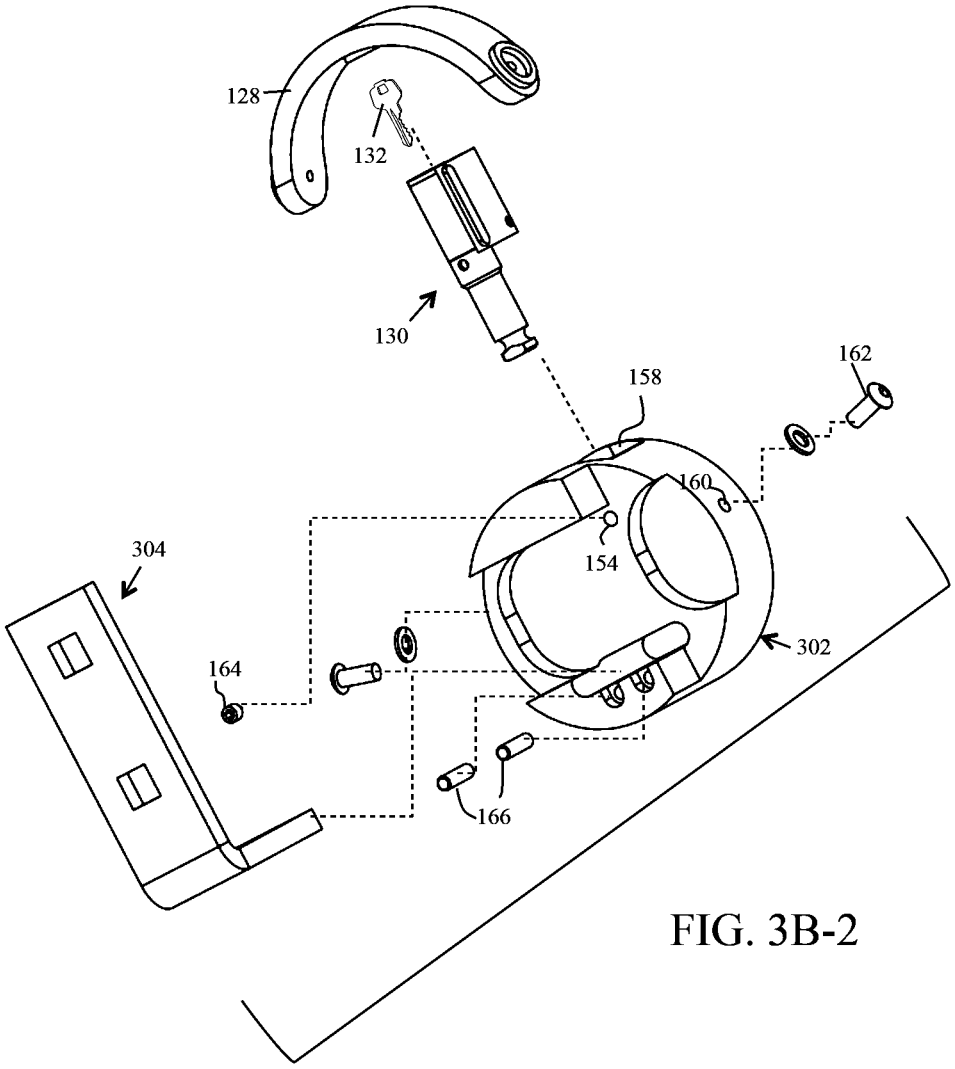
Figures 1, 3C:
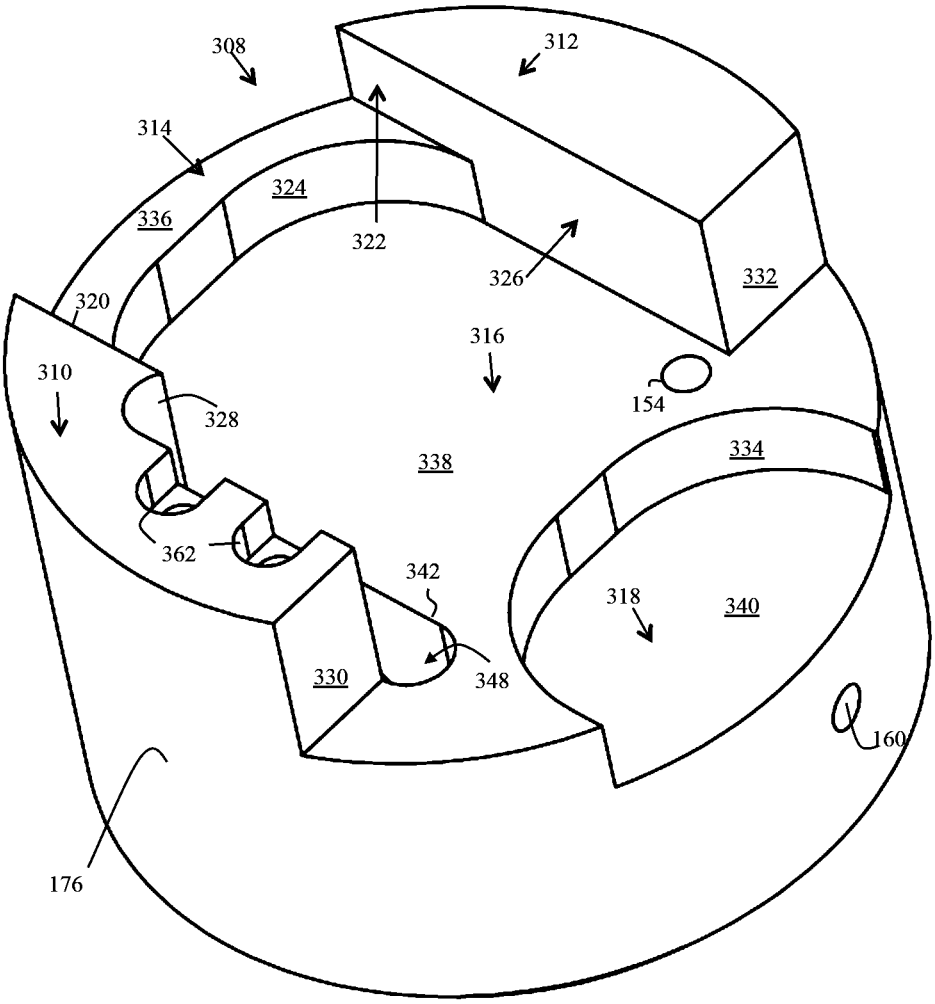
Figures 2, 3C:
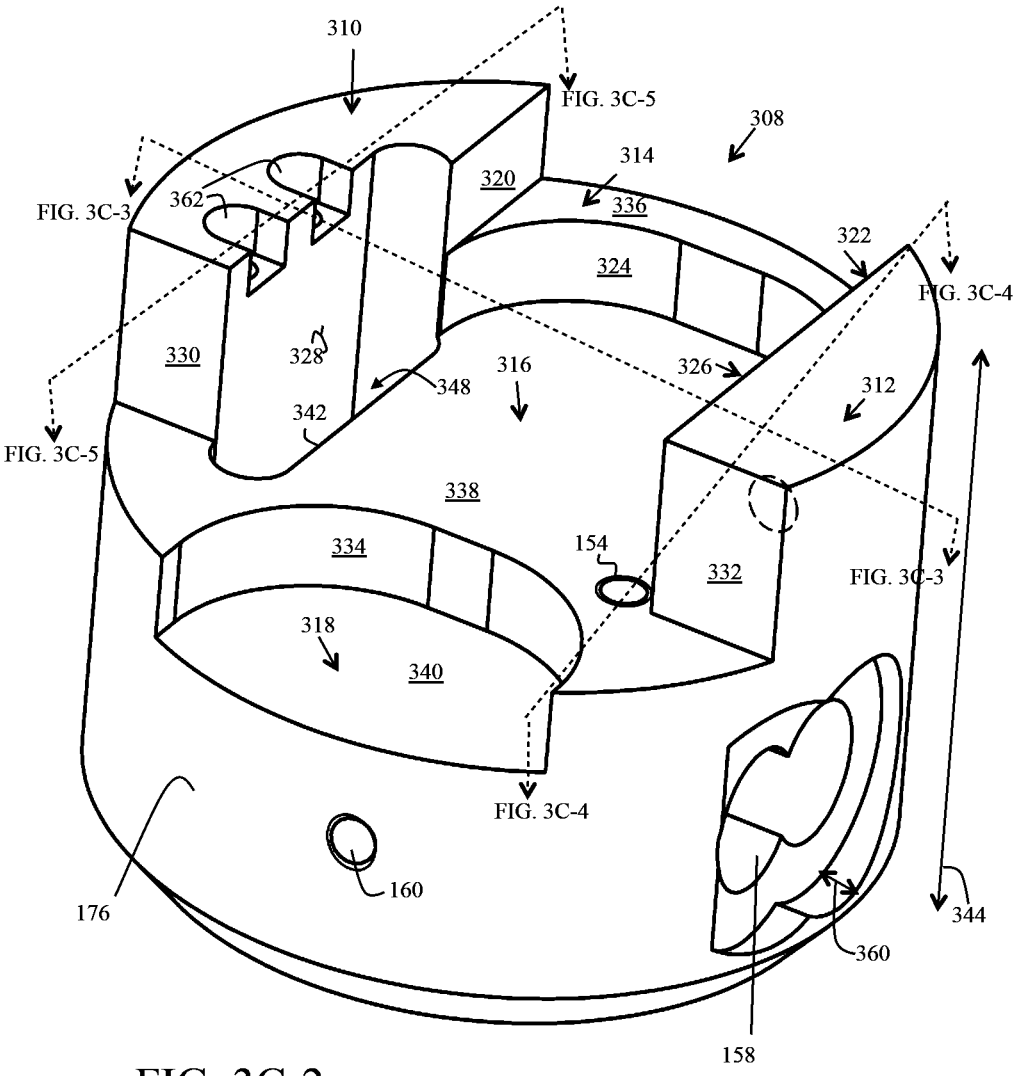
Figures 3, 3C:
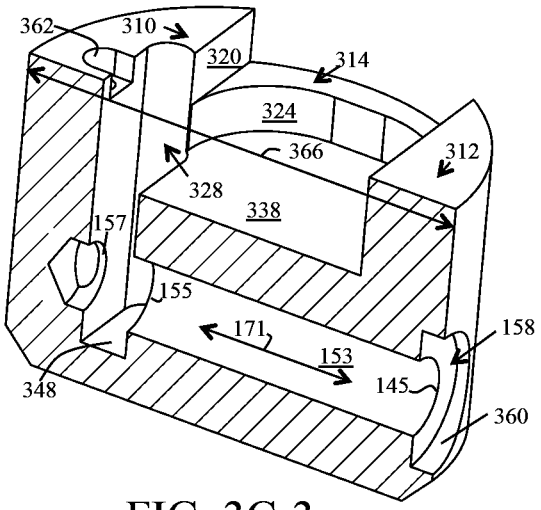
Figures 3, 3C, 4:
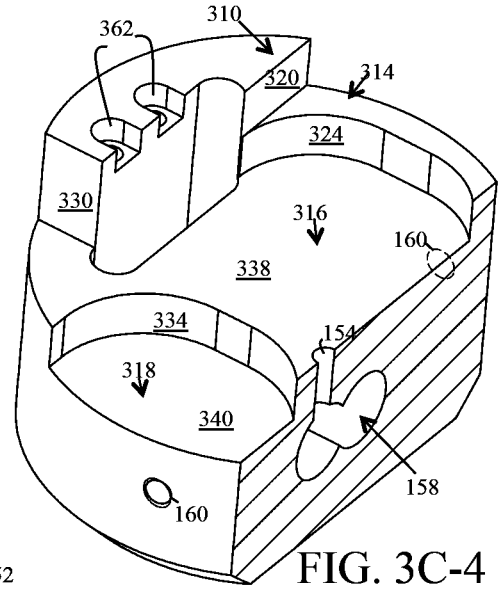
Figures 3, 3C, 4, 5:
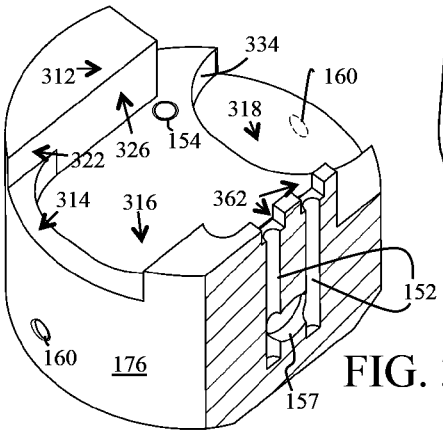
Figures 3, 3C, 4, 5, 6:
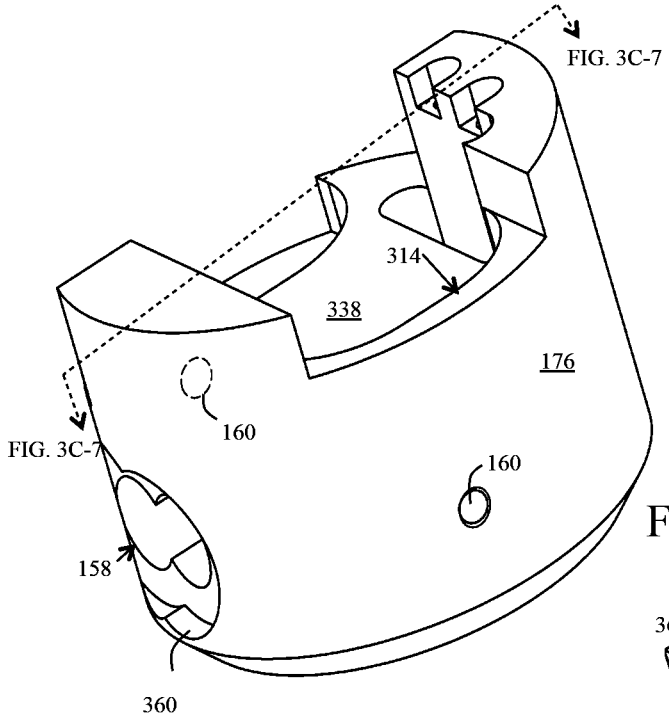
Figures 3, 3C, 4, 5, 6, 7:
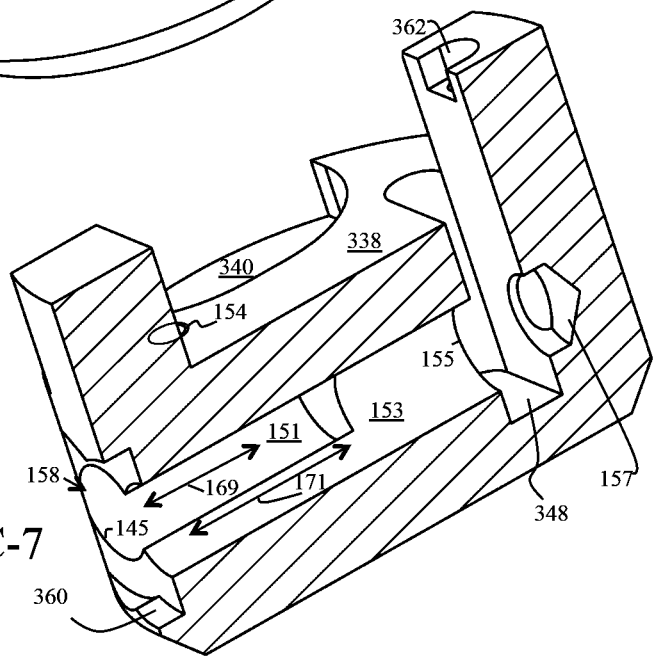
Figures 3, 3C, 4, 5, 6, 7, 8:
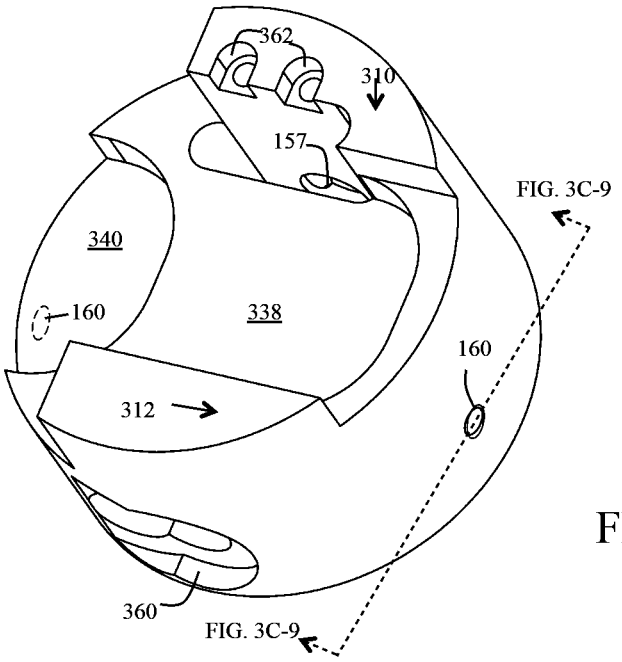
Figures 3, 3C, 4, 5, 6, 7, 8, 9:
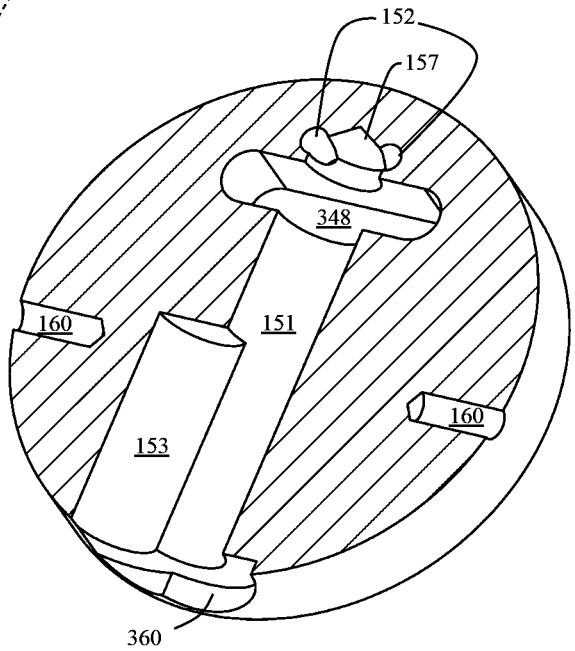
Figures 3, 3C, 4, 5, 6, 7, 8, 9, 10:
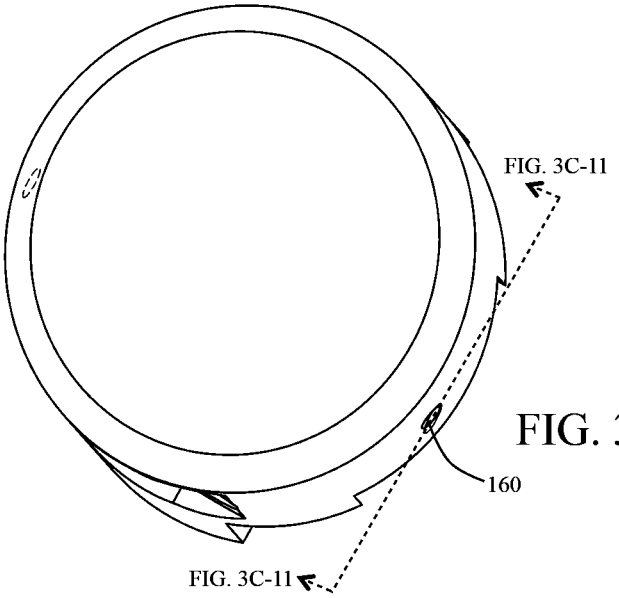
Figures 3, 3C, 4, 5, 6, 7, 8, 9, 10, 11:
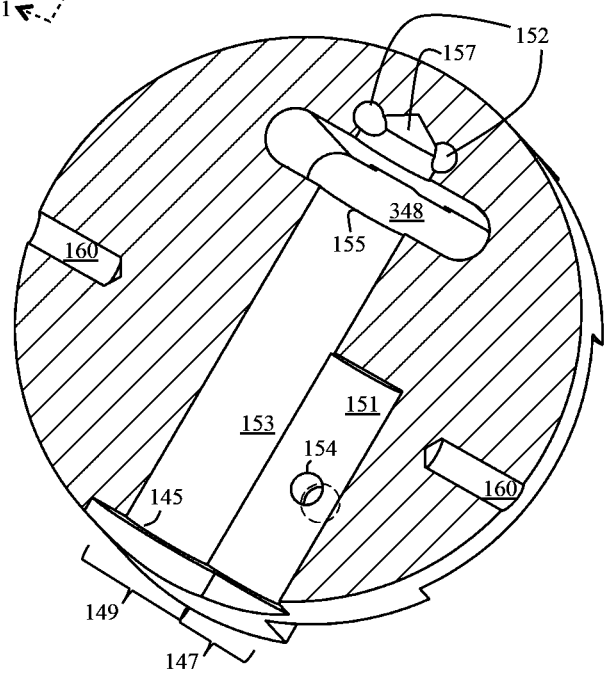
Figures 3, 3C, 4, 5, 6, 7, 8, 9, 10, 11, 12:
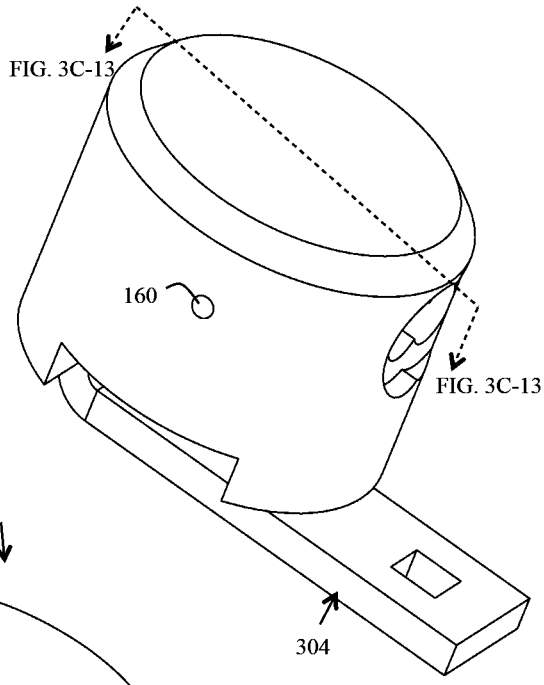
Figures 3, 3C, 4, 5, 6, 7, 8, 9, 10, 11, 12, 13:
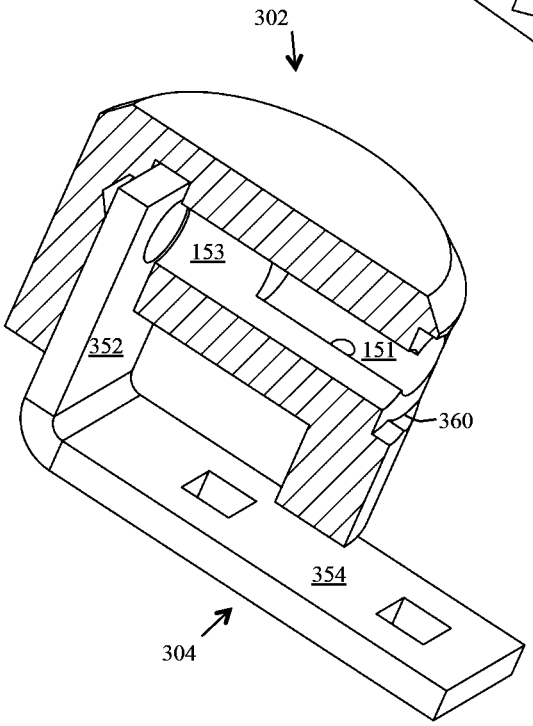
Figures 3, 3C, 4, 5, 6, 7, 8, 9, 10, 11, 12, 13, 14:
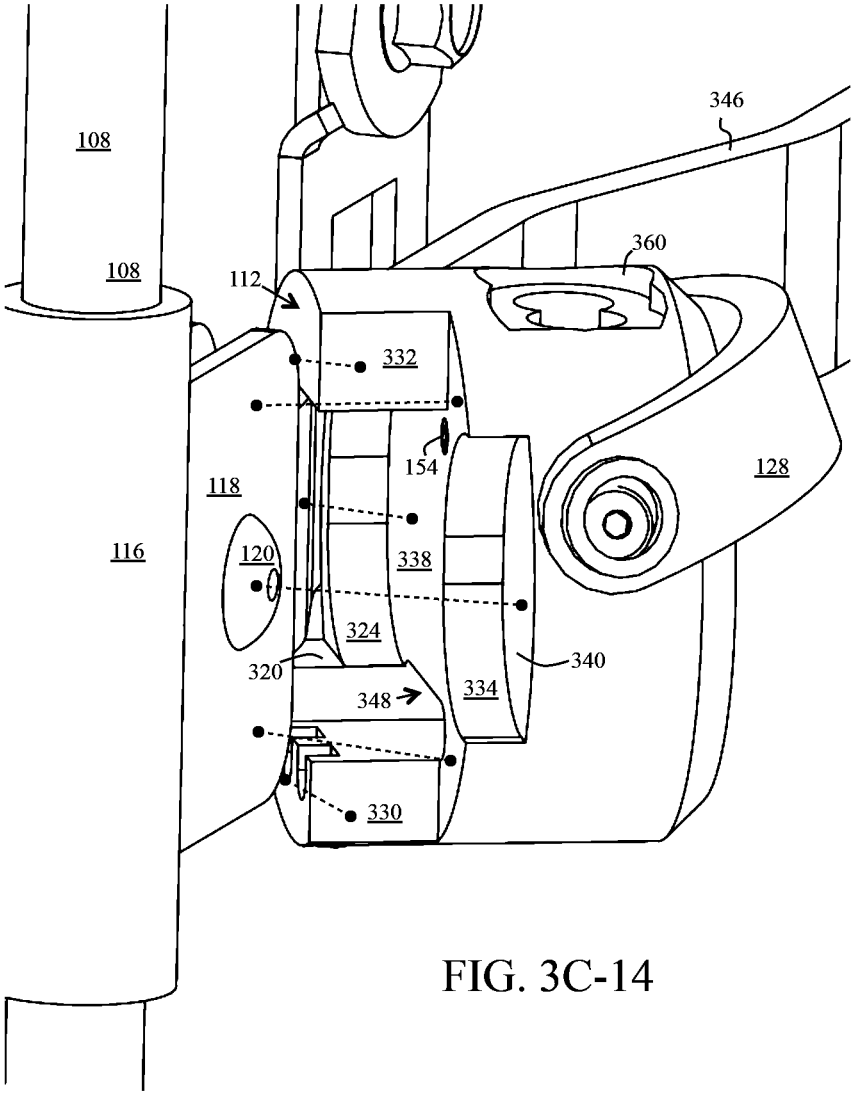
Figures 3, 3C, 4, 5, 6, 7, 8, 9, 10, 11, 12, 13, 14, 15:
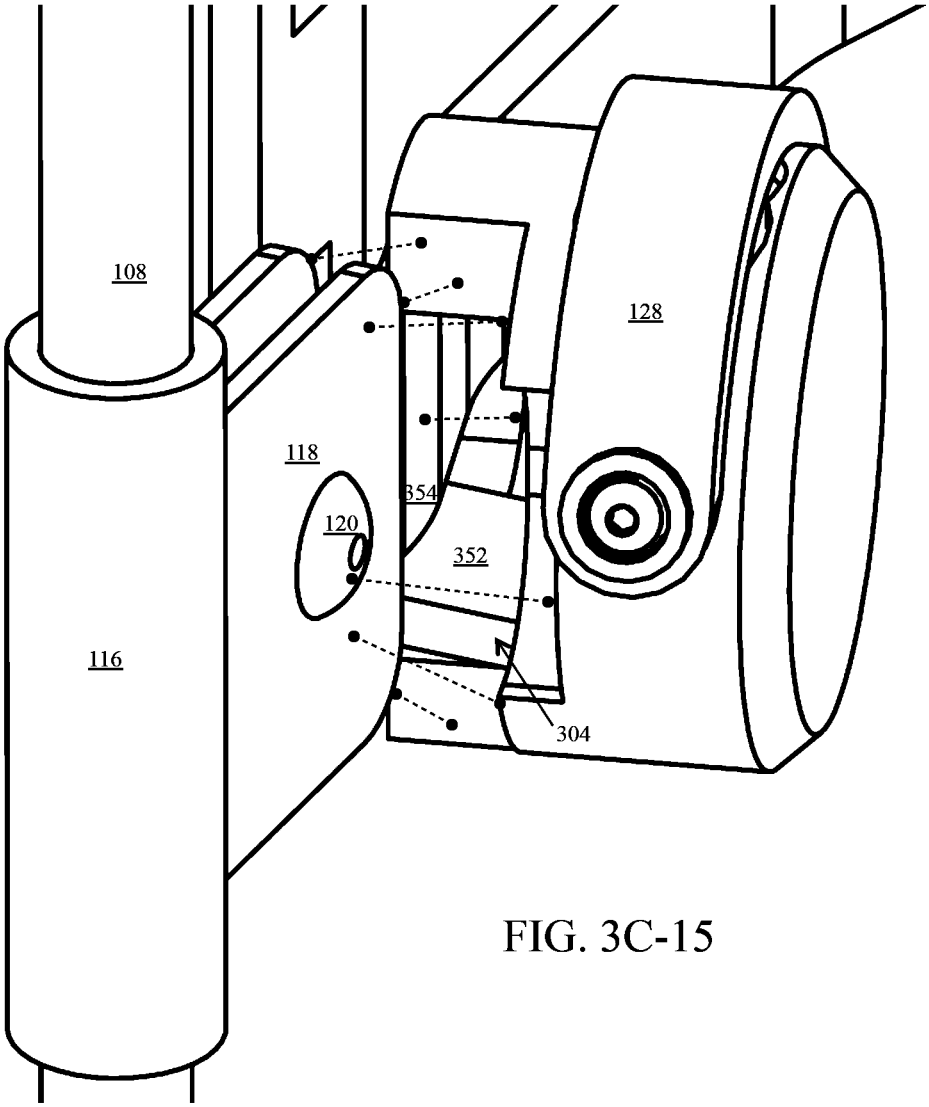
Figures 3, 3C, 4, 5, 6, 7, 8, 9, 10, 11, 12, 13, 14, 15, 16:
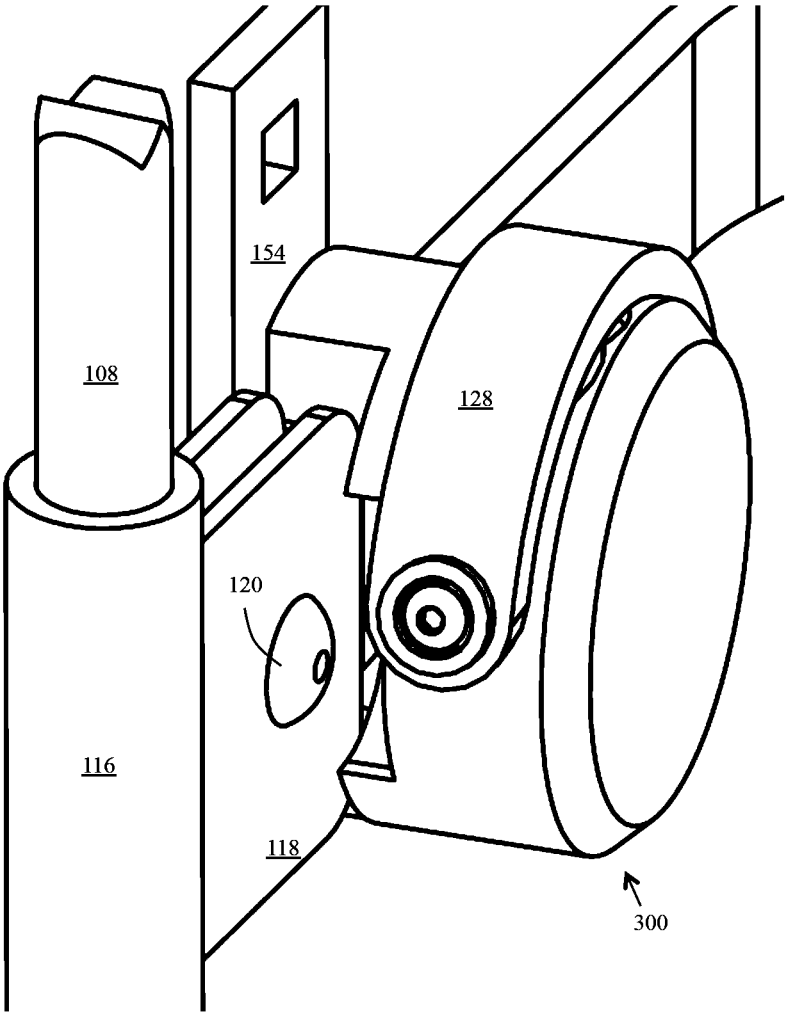
Figures 3, 3C, 4, 5, 6, 7, 8, 9, 10, 11, 12, 13, 14, 15, 16, 17:
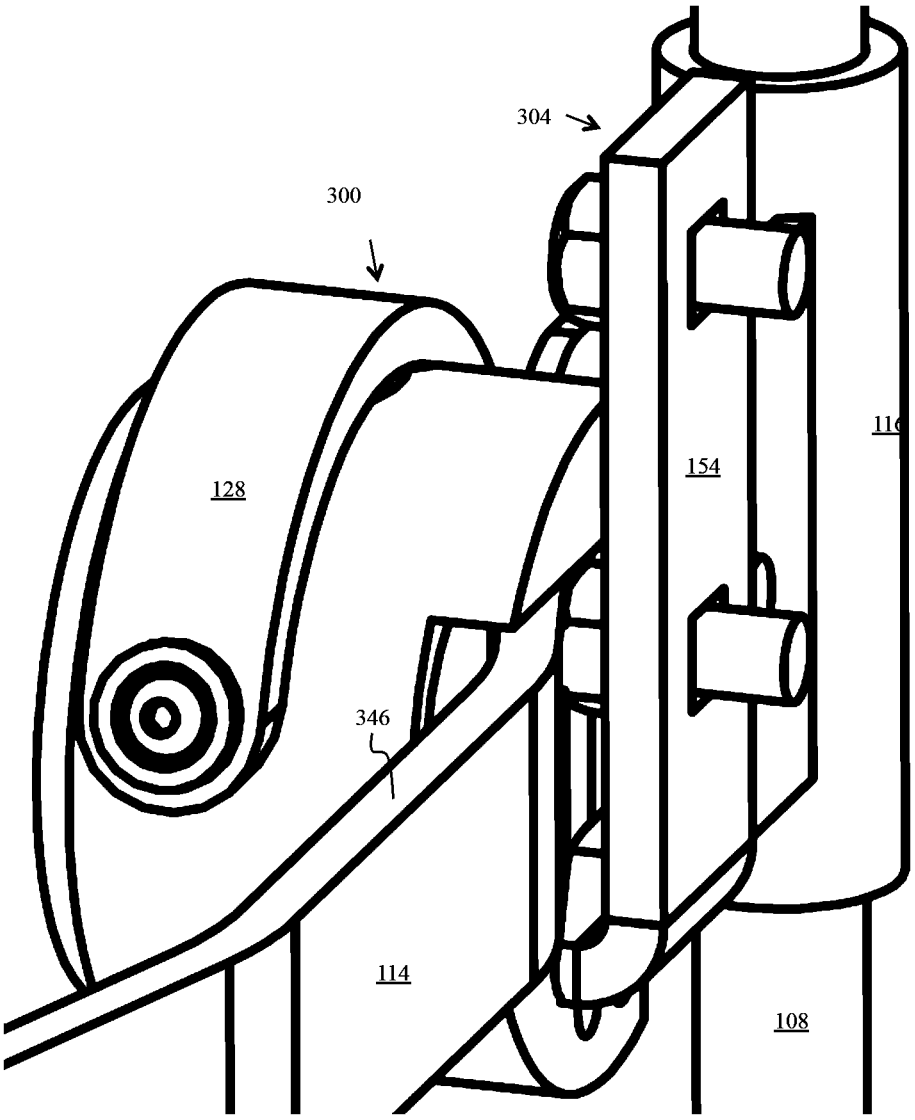
Figure 3D:
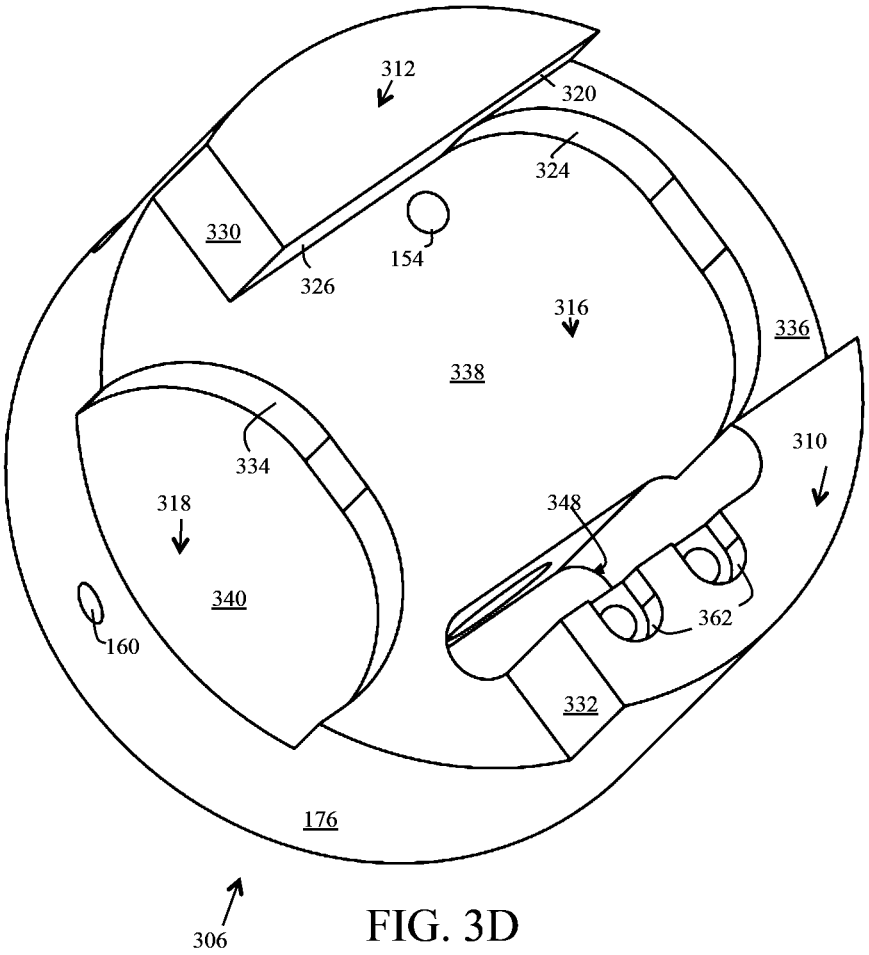

FIG. 3A-1 to 3D are non-limiting, exemplary illustrations of a lock device, including various views of a casing thereof in accordance with one or more embodiments of the present invention. Lock device 300 illustrated in FIGS. 3A-1 to 3D includes similar corresponding or equivalent components, interconnections, functional, and or cooperative relationships as lock devices 100 and 200 that are shown in FIGS. 1A-1 to 2B-16, and described above. Therefore, for the sake of brevity, clarity, convenience, and to avoid duplication, the general description of FIGS. 3A-1 to 3D will not repeat every corresponding or equivalent component, interconnections, functional, and or cooperative relationships that has already been described above in relation to lock devices 100 and 200 that are shown in FIGS. 1A-1 to 2B-16.

FIGS. 3A-1 to 3A-6 are non-limiting, exemplary illustrations of a lock device 300, including various views of a casing thereof associated with a lock and a hasp assembly in accordance with one or more embodiments of the present invention. In particular, FIGS. 3A-1 to 3A-6, and 3B-1 are non-limiting, exemplary illustrations of a fully assembled lock device 300 in accordance with the present invention that is associated with hinge mechanism 110 of lock assembly 106 of cargo door 104 via a hasp assembly 304. Accordingly, instead of or in addition to using the above described lock devices 100 and 200 with hasp assembly 102, lock device 300 may also be used to provide protection (or added protection) with respect to hinge mechanism 110 of lock assembly 106 while fully securing cargo door 104 whether used alone as illustrated or with any one of the lock devices 100 or 102 that may be coupled with the hasp assembly 102.

As further illustrated in FIGS. 3A-1 to 3B-1, lock device 300 includes a casing 302 and optional cover 128 that covers over core 130 associated with casing 126. In order to unlock casing 302 from hasp assembly 304 to unlock and open lock assembly 106 (FIG. 3A-6) to open cargo door 104, cover 128 is first moved to open position (FIG. 3A-2) and core 130 is unlocked from casing 302 using key 132 as described above in relation to lock devices 100 and 200. Once core 130 partially slides out or is removed as described above, lock device 300 may be removed away from hasp assembly 304 (FIGS. 3A-5 and 3A-6) to open cargo door 104 as described above in relation to lock devices 100 and 200.

FIG. 3B-1 is a non-limiting exemplary illustration of a fully assembly lock device 300 in accordance with an embodiment of the present invention, with FIG. 3B-2 illustrating an exploded view thereof. FIGS. 3C-1 to 3C-17 are various view of casing 302 of lock device 300, including various sectional views thereof. FIG. 3D is a non-limiting exemplary illustration of a casing 306, which is an "upside down" version of casing 302 in accordance with the present invention.

As illustrated in FIGS. 3A-1 to 3C-17, in this non-limiting, exemplary embodiment of the present invention, casing 302 of lock device 300 is comprised of a generally cylindrical configuration having a bottom side 308 that has a topography that is generally a negative topography of surfaces of hinge mechanism 110 of lock assembly 106 with which the bottom side 308 associates. The topography of the bottom side 308 is defined by a plurality of offset surfaces (310, 312, 314, 316, and 318) that define raised edges (320, 322, 324, 326, 330, 332, and 334), with the offset surfaces and resulting raised edges forming reliefs (336, 338, and 340).

Reliefs 336, 338, and 340 have sufficient depth to accommodate protruding portions of the surfaces of the hinge mechanism 110 of lock assembly 106 with which the bottom side 308 associates and to allow casing 302 to mount in a proper orientation onto hinge mechanism 110 of locking assembly 106 to allow for proper shackle 174 interlock with hasp assembly 304. Further, the resulting raised edges (320, 322, 324, 326, 330, 332, and 334) having sufficient height to abut against and block access to lateral edges 161 of surfaces of the hinge mechanism 110 of lock assembly 106.

As indicated above, bottom side 308 of casing 302 includes plurality of offset surfaces (310, 312, 314, 316, and 318) at varying elevations along a height 344 of casing 302 that define variations in thickness of casing 302 and form a plurality of raised edges (320, 322, 324, 326, 330, 332, and 334). The offset surfaces and the resulting raised edges form a plurality of reliefs 336, 338, and 340 at varying elevations along height 344 of casing 302.

In particular, a first offset surface 314 of the plurality of offset surfaces in relation to highest elevation first and second offset surfaces 310 and 312 form first and second raised edges 320 and 322 of the plurality of raised edges, defining a first and second anti-tampering edges and a first relief 316 of the plurality of reliefs. First offset surface 336 is situated away from a geometric center of casing 302, away from a radial center and towards a periphery curved side 176 of casing 302, near a lateral distal end of a bottom side cavity 348. As best illustrated in FIG. 3C-14 to 3C-17, first and second raised edges 320 and 322 abut against lateral edges 346 of lock handle 114 to prevent tampering and prying of casing 302 and also, block lock handle 114 from moving along path 122, and first relief 316 accommodates a portion of body of lock handle 114.

A second offset surface 316 of the plurality of offset surfaces in relation to first offset surface 314 forms a third raised edge 324. Second offset surface 316 in relation to first highest elevation offset surfaces 310 forms a fourth raised edge 330, and in relation to second highest elevation offset surface 312 forms a fifth raised edge 326 and a sixth raised edge 332. The respective third, fourth, fifth, and sixth raised edges 324, 330, 326, and 332 generally block access to and prevent tampering with lateral edges 346 of lock handle, with second offset surface 316 defining a second relief 338 of the plurality of reliefs and protecting a remaining portion of lock handle 114 (best illustrated in FIGS. 3C-14 to 3C-17). The expanse of the second offset surface 316 generally covers a general mid-portion of bottom side 308 of casing 302.

A third offset surface 318 of the plurality of offset surfaces in relation to second offset surface 316 forms a seventh raised edge 334 of the plurality of raised edges, defining a third relief 340 of the plurality of reliefs that accommodates lock hinge pin 120 (best illustrated in FIGS. 3C-14 to 3C-17). As further illustrated, third offset surface 318 is generally situated opposite first offset surface 336.

As further illustrated in FIGS. 3A-1 to 3C-17, bottom side 308 further includes a bottom side cavity 348 extending in part way along a height 344 of the casing 302, commencing from second offset surface 316 for accommodating hasp assembly 304. Bottom side cavity 348 includes side walls, with a first side wall 328 having a blind-hole 157, and a second, opposite side wall 342 a through-hole 153. Bottom side cavity 348 is situated away from a geometric center of casing 302, away from a radial center and towards periphery curved side 176 of casing 302. Dimensions and the overall geometric configuration of bottom side cavity 348 may vary commensurate with the overall geometric configuration of hasp assembly 304.

As illustrated in FIGS. 3A-1 to 3C-17, hasp assembly 304 may comprise of a single piece hasp with an interlocking section and a connection section. Hasp interlock section includes an interlocking hole and the hasp connection section includes at least one connection hole. A span of the interlocking section of the hasp is of sufficient length to clear lock assembly when the hasp is coupled with the enclosure and further, have sufficient remaining clearance length to engage the casing. Hasp assembly is coupled with cargo door 104 near hinge mechanism of the lock assembly as illustrated. That is, the hasp is coupled with cargo door 104 near the hinge mechanism of lock assembly, behind lock handle and adjacent a hinge of the lock handle, with the interlocking section of the hasp extending beyond lock handle oriented above or underneath the lock handle. For above clearance, an "upside down" version of casing illustrated in FIG. 3D as casing 306 may be used. Interlocking section of the hasp is inserted within the bottom side cavity of the casing, with the casing covering over a part of the lock handle, the lock hinge, and lock hinge pin, with core 130 within casing interlocking the casing with the hasp interlocking section (via shackle 174). It should be noted that height 344 of the casing is determined by a distance from which lock assembly 106 is installed away from the closure, the overall thickness of lock assembly 106 itself, and a span 352 of interlocking section 350 of the hasp 304. Hasp 304 also includes a connection section 354, which combined with interlock section 350 form a generally "L" shaped configuration. Casing 302 must also have a sufficient height 344 to accommodate a variety of reliefs at different elevations, which intimately accommodate surface topography of lock assembly 106.

As further illustrated, casing 302 also includes side hole 158 for receiving core 130, with side hole 158 commencing at a recessed portion 360 of curved side 176 so to enable a standard, conventional core 130 to fit within and shackle 174 of core 130 engage with blind-hole 157. In other words, because bottom side cavity 348 is shifted or moved away, further closer to the curved side 176 (away from the geometric center of casing 302), compelling core 130 to be positioned deeper into hole 153 of casing 302 so that shackle 174 can reach into the blind-hole. It should be noted that this shifting of bottom side cavity 348 closer to the edge of casing 302 and further away from the geometric center thereof enables manufacture of a shorter cross-sectional axis 366 of casing 302, while maintaining the reach and coverage of casing 302 over the hinge mechanism 110. The casing 302 further includes a set of recesses 362 adjacent to and above bottom side cavity 348, which accommodate locking pins 166 of casing 302.

FIG. 4A-1 to 4D-11 are non-limiting, exemplary illustrations of a lock device, including various views of a casing thereof in accordance with one or more embodiments of the present invention. A portable lock device 400 illustrated in FIGS. 4A-1 to 4D-11 includes similar corresponding or equivalent components, interconnections, functional, and or cooperative relationships as lock devices 100, 200, and 300 that are shown in FIGS. 1A-1 to 3D, and described above. Therefore, for the sake of brevity, clarity, convenience, and to avoid duplication, the general description of FIGS. 4A-1 to 4D-10 will not repeat every corresponding or equivalent component, interconnections, functional, and or cooperative relationships that has already been described above in relation to lock devices 100, 200, and 300 that are shown in FIGS. 1A-1 to 3D.

FIGS. 4A-1 to 4A-11 are non-limiting, exemplary illustrations of a portable lock device 400, including various views of a casing 402 thereof associated with lock assembly 106 and a portable hasp 404 in accordance with one or more embodiments of the present invention. In particular, FIGS. 4A-1 to 4A-11 are non-limiting, exemplary illustrations of a fully assembled portable lock device 400 in accordance with the present invention that is detachably associated with hinge mechanism 110 of lock assembly 106 of cargo door 104 by portable hasp 404. That is, portable hasp 404 is detachably associated with lock assembly 106 by portable casing 402 of portable lock device 400. Accordingly, instead of or in addition to using the above described lock devices 100 and 200 with hasp assembly 102, portable lock device 400 may also be used to provide protection (or added protection) with respect to the hinge mechanism 110 of lock assembly while fully securing cargo door 104 whether used alone as illustrated or with any one of the lock devices 100 or 102 that may be coupled with the hasp assembly 102. Further and as important, portable lock device 400 and portable hasp 404 detachably secure and lock and provide a protective cover for the handle and hinge portions of the lock assembly but without altering, damage, or requirement for modification of the door and without being fixedly mounted onto the door.

As further illustrated in FIGS. 4A-1 to 4A-11, portable lock device 400 includes a casing 402 and optional cover 128 that covers over core 130 associated with casing 126. In order to unlock casing 402 from portable hasp 404 to unlock and open lock assembly 106 to open cargo door 104 (FIG. 4A-11), cover 128 is first moved to open position (FIG. 4A-2) and core 130 is unlocked from casing 302 using key 132 as described above in relation to lock devices 100, 200, and 300. Once core 130 partially slides out or is removed as described above, lock device 400 may be removed away from hasp 404 (FIG. 4A-8), and the hasp 404 may be removed from the hinge mechanism 110 (FIG. 4A-11) to open cargo door 104 as described above in relation to lock devices 100, 200, and 300.

In order to use portable lock device 400 and portable hasp 404 to secure lock assembly 106, the portable hasp 404 is moved (as illustrated by arrow 409 in FIG. 4A-10) to be positioned around hinge mechanism 110 as best illustrated in FIGS. 4A-7 and 4A-10 with one hand while with the other hand portable lock device 400 is mounted onto portable hasp 404. Thereafter, while holding both portable lock device 400 and portable hasp 404 (FIG. 4A-7), core 130 thereof is used to secure both to lock assembly 106. It should be noted that both portable hasp 404 and portable lock device 400 "hang" onto hinge mechanism 110 otherwise, lock device 400 or hasp 404 have no fixed connection with door or lock assembly.

Figures 1, 4A:
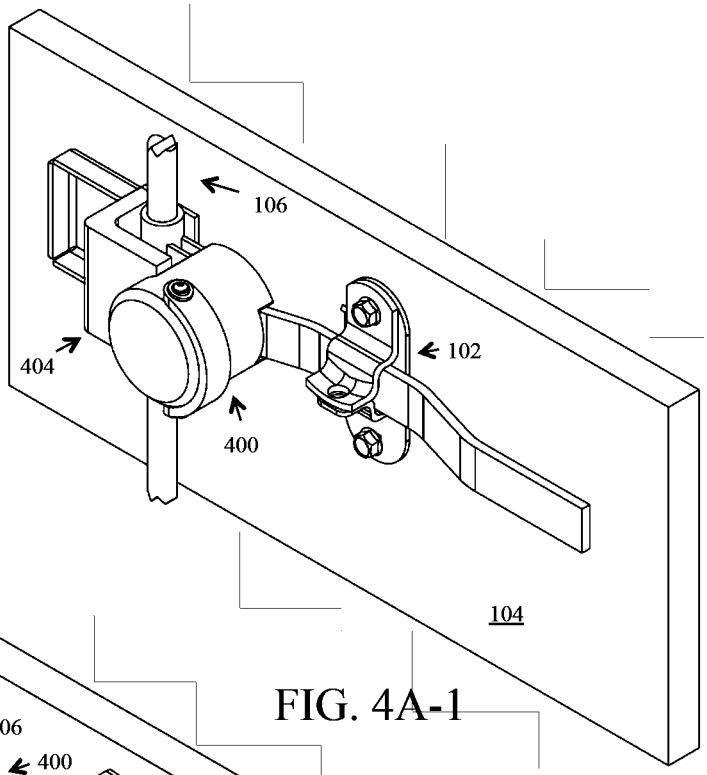
Figures 2, 4A:
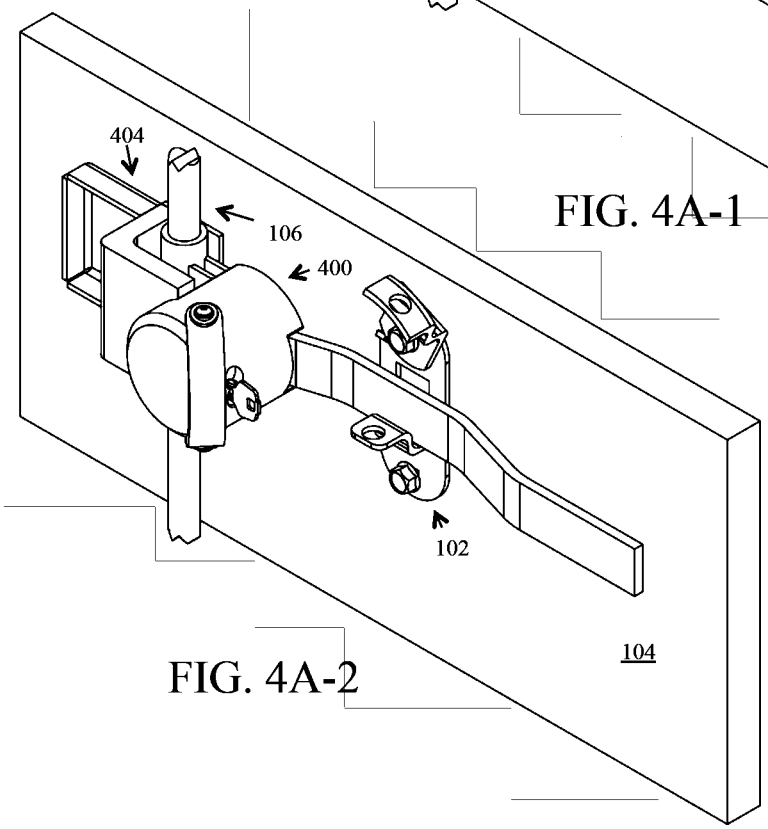
Figures 3, 4A:
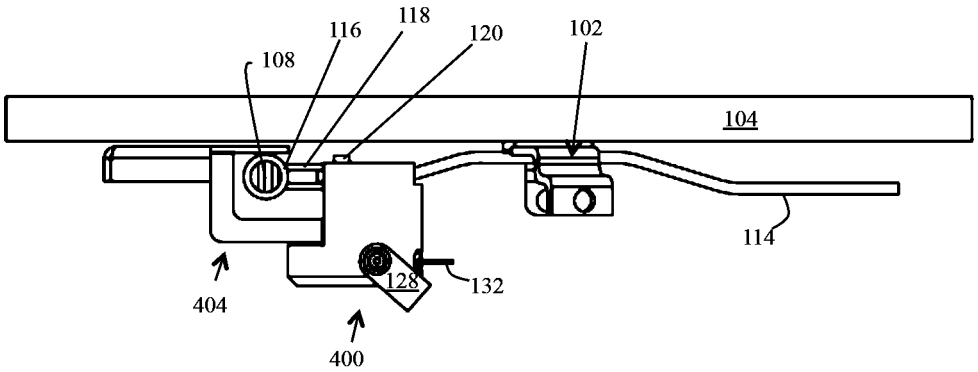
Figures 4, 4A:
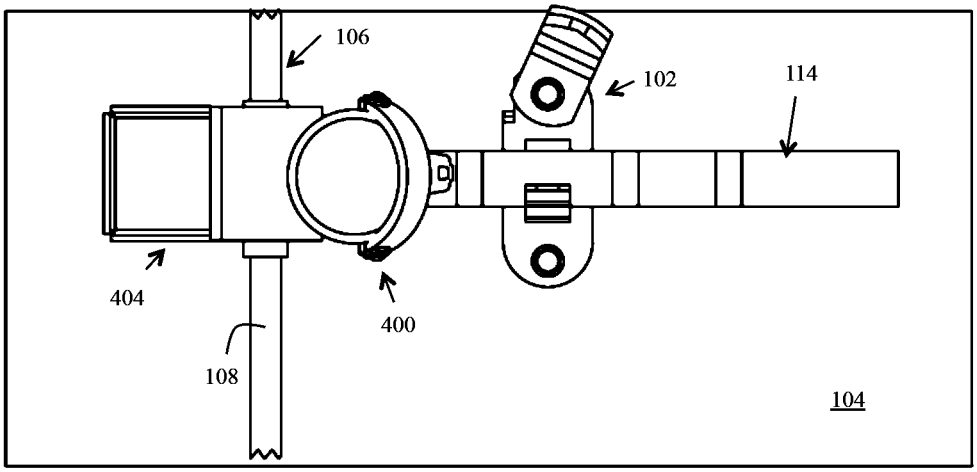
Figures 4, 4A, 5:
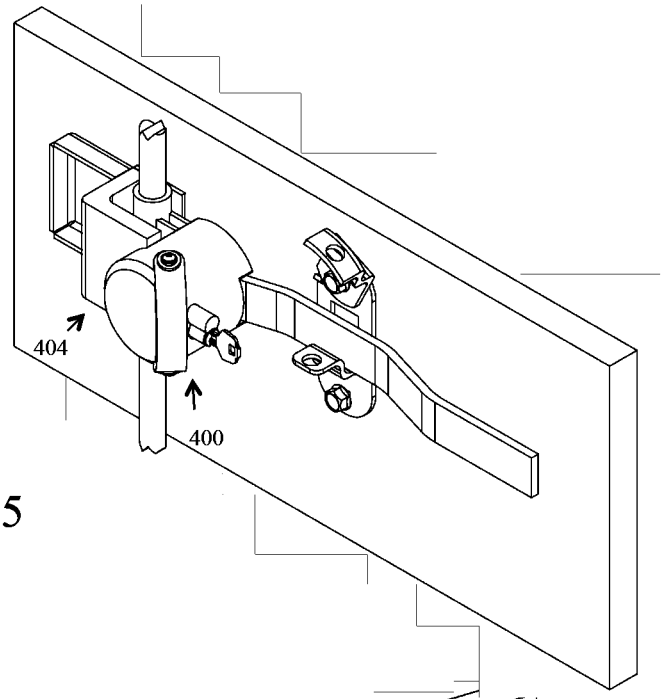
Figures 4, 4A, 5, 6:
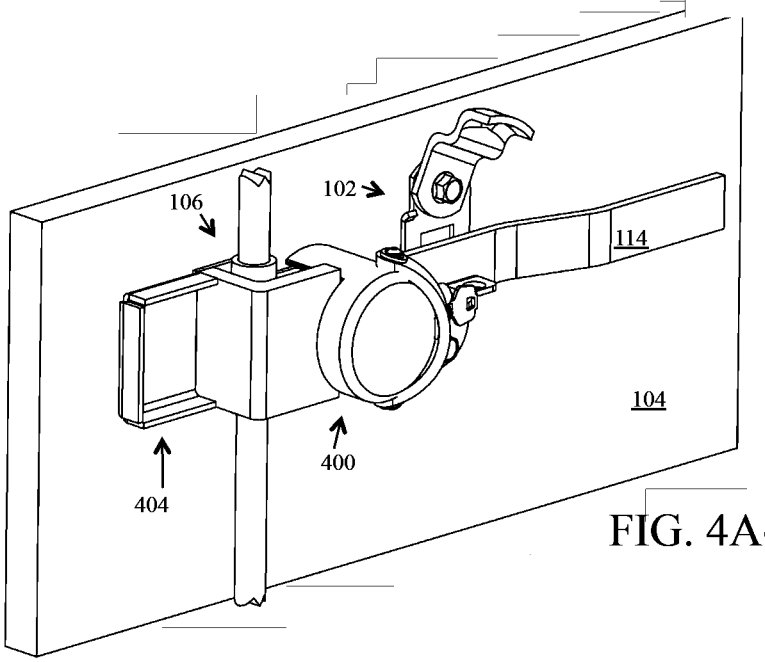
Figures 4, 4A, 5, 6, 7:
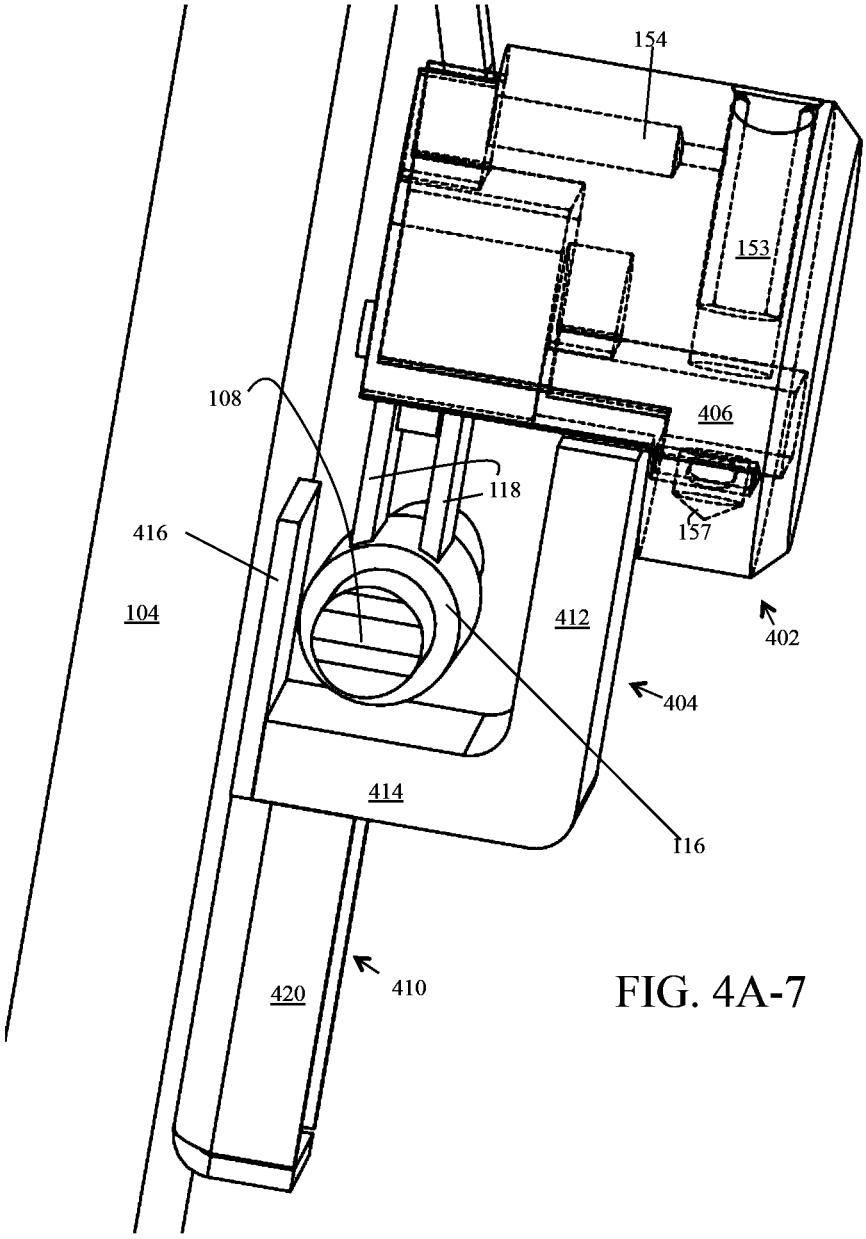
Figures 4, 4A, 5, 6, 7, 8:
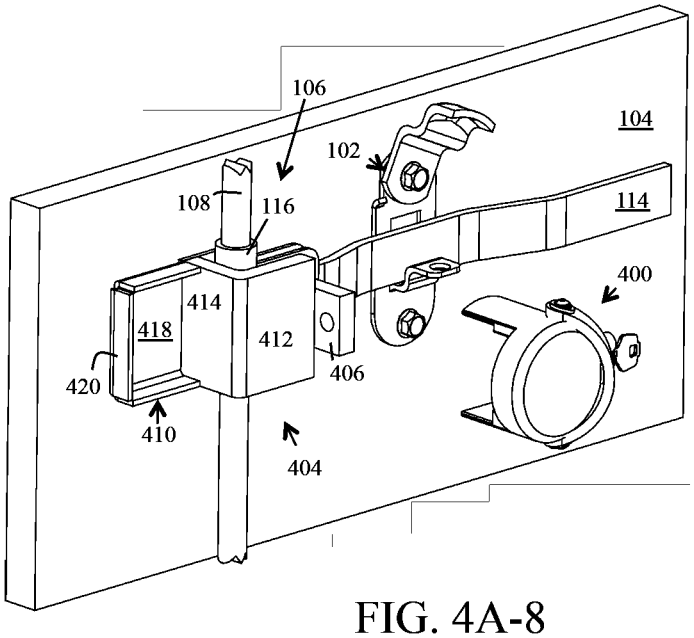
Figures 4, 4A, 5, 6, 7, 8, 9:
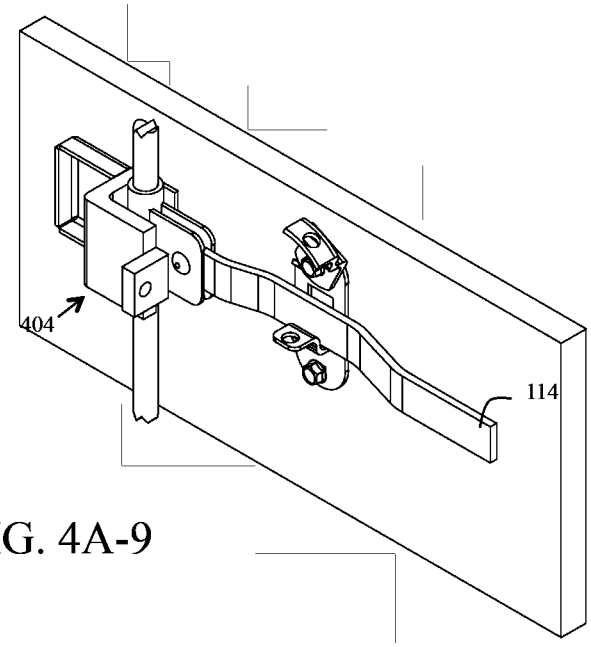
Figures 4, 4A, 5, 6, 7, 8, 9, 10:
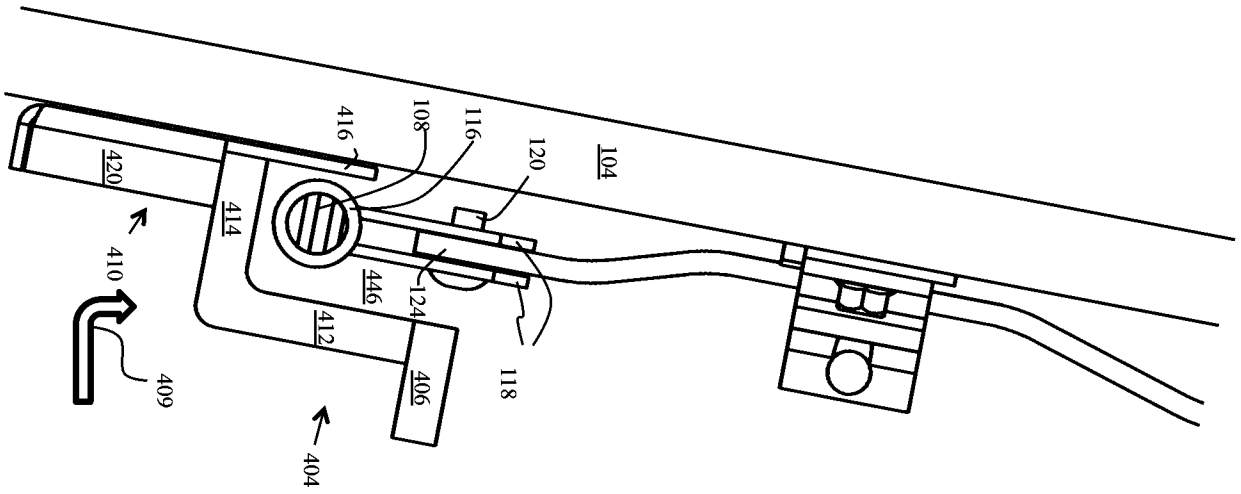
Figure 4B:
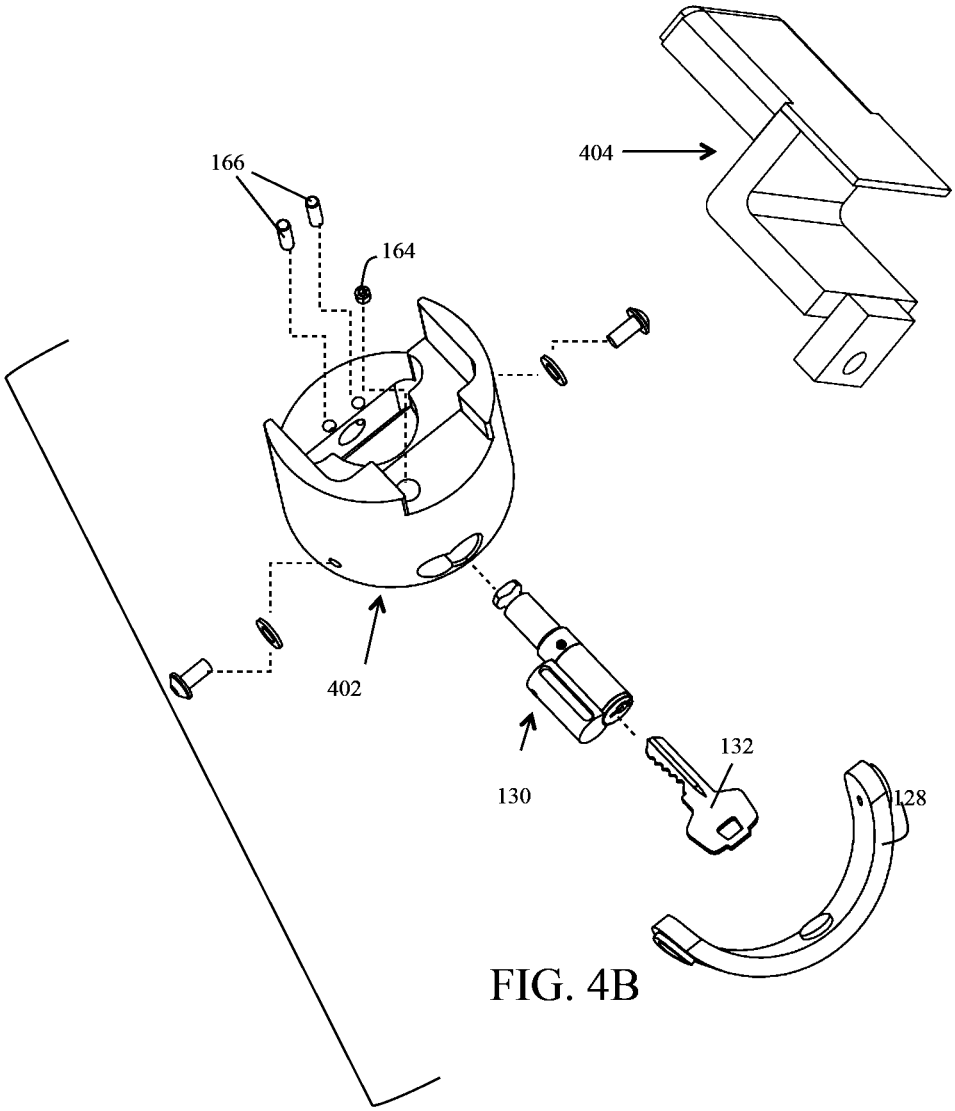
Figures 1, 4C:
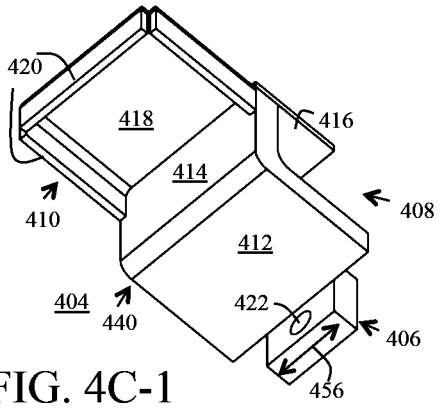
Figures 2, 4C:
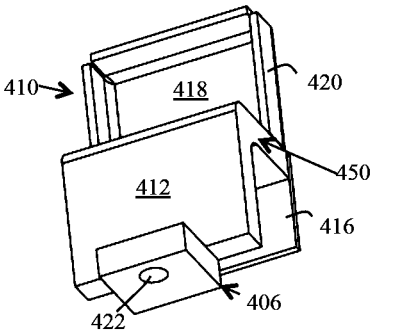
Figures 3, 4C:
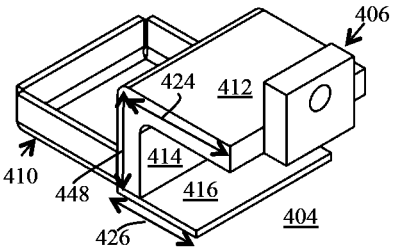
Figures 4, 4C:
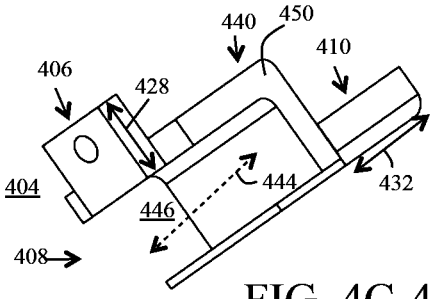
Figures 4, 4C, 5:
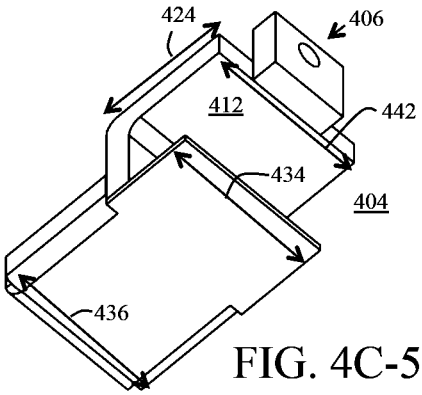
Figures 4, 4C, 5, 6:
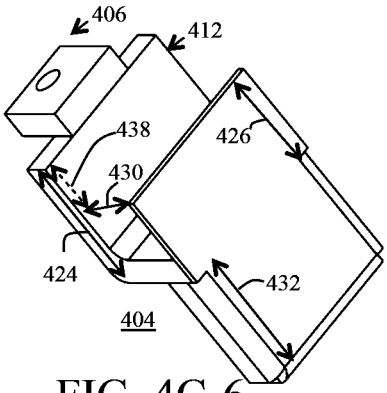
Figures 4, 4C, 5, 6, 7:
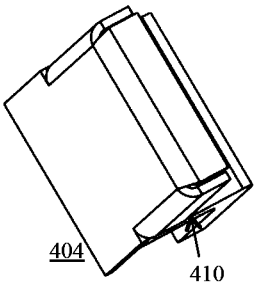
Figures 4, 4C, 5, 6, 7, 8:
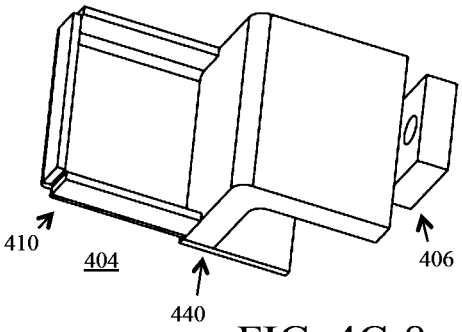
Figures 4, 4C, 5, 6, 7, 8, 9:
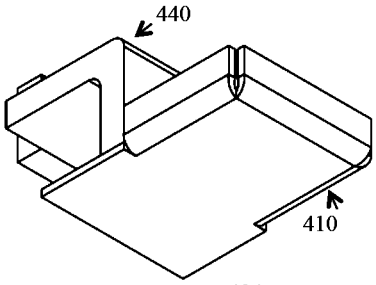
Figures 4, 4C, 5, 6, 7, 8, 9, 10:
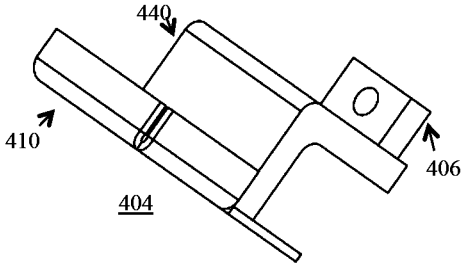
Figures 4, 4C, 5, 6, 7, 8, 9, 10, 11:
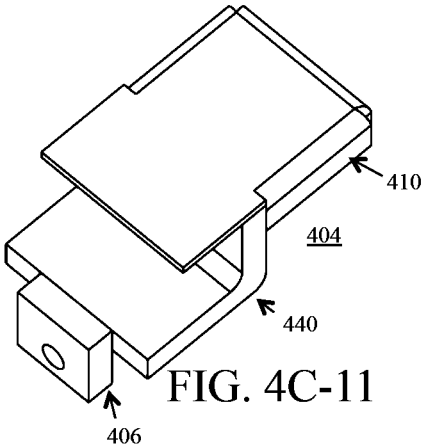
Figures 4, 4C, 5, 6, 7, 8, 9, 10, 11, 12:
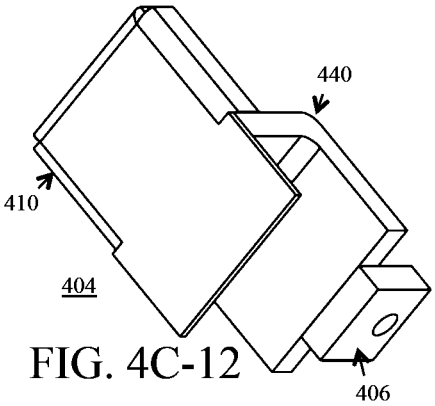
Figures 4, 4C, 5, 6, 7, 8, 9, 10, 11, 12, 13:
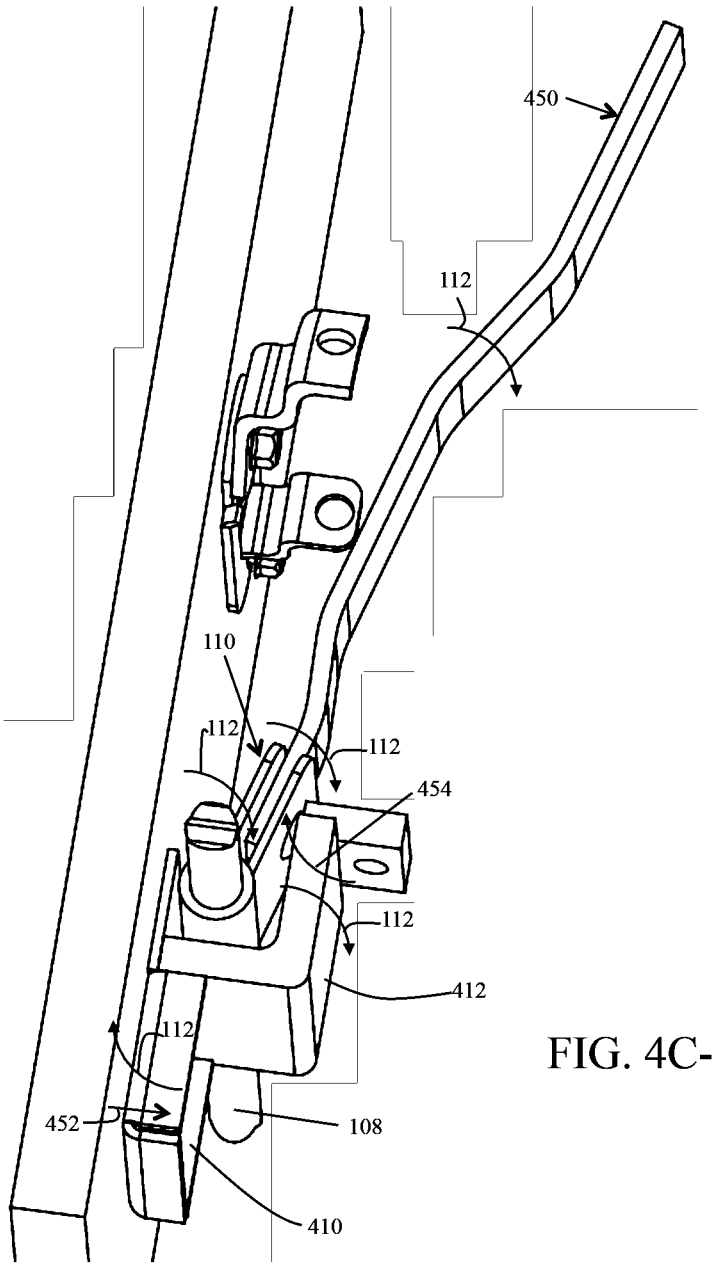

FIG. 4B is a non-limiting exemplary illustration of an exploded view of lock device 400 and hasp 404 in accordance with the present invention. FIGS. 4C-1 to 4C-13 are various view of portable hasp 404 of lock device 400 in accordance with an embodiment of the present invention. FIGS. 4D-1 to 4D-11 are non-limiting exemplary illustration of a casing 402, including various sectional views thereof in accordance with an embodiment of the present invention.

As further illustrated in FIGS. 4A-1 to 4C-13, and 4D-9 to 4D-11, in this non-limiting, exemplary embodiment of the present invention, portable hasp 404 of portable lock device 400 is comprised of an accommodating section 408 that generally accommodates hinge mechanism 110, a lock section for interlocking with lock device 400, and an anti-tampering section 410. As best illustrated in FIGS. 4A-10, the accommodating section 408 has sufficient expanse to accommodate the cylindrical portion 116 and part of the hinging portion 118 (including and up to hinge pin 120) of the hinge mechanism 110. The remaining part of the hinge mechanism 110 is protected and covered by casing 402 with which portable hasp 404 is associated (detailed below).

The accommodating section 408 may comprise of a base 416 and a guard 440 having a first portion 412 that may be parallel base 416 and a second portion 414 that may be oriented perpendicular base 416 and first portion 412. Configuration of base 416 and guard 440 form a channel 446 (also illustrated in FIG. 4A-10) of width 430 of the accommodating section 408 with sufficient depth 444 to maneuver to and surround hinge mechanism 110.

In general, width 426 of base 416 may be shorter than width 424 of first portion 412 of guard 440 by an amount 438, but length 434 of base 416 and length 442 of first portion 412 of guard 440 may be generally equal. Width 448 of second portion 414 may generally be shorter than width 424 of first portion 412, with first and second portions 412 and 414 sharing the same length 442 at bent 450, which may be at an angle of about 90 degrees.

Anti-tampering section 410 is comprised of blocking piece 418 and reinforcements 420 for improved structural integrity by increasing the strength of blocking piece 418 and the overall strength of anti-tamper section 410. The anti-tamper section 410 (including blocking piece 418 and number and positioning of reinforcements 420) may comprise of any configuration so long as it has sufficient expanse to prevent too much rotation of the portable hasp 404, as best illustrated in FIG. 4C-13.

As illustrated in FIG. 4C-13, if force 450 (e.g., torque) is applied on lock handle 114 to rotate it along path 112, lock handle 114 will also rotate hinge mechanism 110 and hence, lock bar 108 of lock assembly 106 along path 112 as indicated. With portable hasp 404 detachably held in place as illustrated (generally when interlocked with lock device 400, but not shown for clarity), even if lock handle 114 is forced to be moved within channel 446 of accommodating section 408, hinging portion 118 of hinge mechanism 110 will eventually abut against first portion 412 of guard 440. With continued application of greater force 450, torque experienced by hinge mechanism 110 and hence, guard 440 and anti-tampering section 410 may become larger and along path 112. However, the cargo door 104 would block anti-tampering section 410 from moving along path 112, providing a counter force 452, urging guard 440 to apply a force along path 454 countering the applied force 450 along path 112 and thus, preventing prying and tampering with lock assembly 106.

Referring back to FIGS. 4C-1 to 4C-12, blocking piece 418 of anti-tampering section 410 includes a width 432 and length 436, forming a generally rectangular shape with reinforcement 420 connected to one side, allowing for a flat "bottom" side surface that detachably associates (or abut against) with a flat surface of the cargo door 104. As further illustrated, portable hasp 404 further includes locking section 406 with dimensions of length 428 and width 456 commensurate with bottom side cavity 458 of casing 402. Locking section 406 further includes an interlock hole 422 that receives shackle 174 of core 130.

As further illustrated in FIGS. 4A-1 to 4D-11, in this non-limiting, exemplary embodiment of the present invention, casing 402 of portable lock device 400 is comprised of a generally cylindrical configuration having a bottom side 460 that has a topography that is generally a negative topography of surfaces of hinge mechanism 110 and lock handle 114 of lock assembly 106 with which the bottom side 460 associates. The topography of the bottom side 460 is defined by a plurality of offset surfaces (462, 464, 466, 468, 470, and 472) that define raised edges (474, 476, 478, 480, 482, 484, 486, and 488), with the offset surfaces and resulting raised edges forming reliefs (490, 492, 494, and 496).

Reliefs 490, 492, 494, and 496 have sufficient depth to accommodate protruding portions of the surfaces of hinge mechanism 110 of lock assembly 106 with which the bottom side 460 associates and to allow casing 402 to mount in a proper orientation onto the hinge mechanism 110 of locking assembly 106 to allow for proper shackle 174 interlock with hasp assembly 404. Further, the resulting raised edges (474, 476, 478, 480, 482, 484, 486, and 488) having sufficient height to abut against and block access to lateral edges 161 of surfaces of the hinge mechanism 110 of lock assembly 106.

As indicated above, bottom side 460 of casing 402 includes plurality of offset surfaces (462, 464, 466, 468, 470, and 472) at varying elevations along a height 498 of casing 402 that define variations in thickness of casing 402 and form a plurality of raised edges (474, 476, 478, 480, 482, 484, 486, and 488). The offset surfaces and the resulting raised edges form a plurality of reliefs 490, 492, 494, and 496 at varying elevations along height 498 of casing 402.

In particular, a first offset surface 466 of the plurality of offset surfaces in relation to highest elevation first and second surfaces 462 and 464 form first and second raised edges 476 and 474 of the plurality of raised edges, defining a first and second anti-tampering edges and a first relief 490 of the plurality of reliefs. In this instance, offset surface 466 accommodates retainer hole 154. First offset surface 466 is situated away from a geometric center of casing 402, away from a radial center and towards a periphery curved side 176 of casing 402, parallel longitudinal axis of bottom side cavity 458. As best illustrated in FIG. 4D-9 to 4D-10, first and second raised edges 476 and 474 abut against lateral edges 346 of lock handle 314 to prevent tampering and prying of casing 402 and also, block lock handle 114 from moving along path 122, and first relief 490 accommodates a portion of body of lock handle 114.

A second offset surface 468 of the plurality of offset surfaces in relation to first offset surface 466 forms a third raised edge 478 that is oriented parallel bottom side cavity 458. Second offset surface 468 in relation to a first portion 462*a* of first highest elevation offset surface 462 forms a first portion 482*a* of a fourth raised edge 482. Second offset surface 468 in relation to a second portion 462*b* of first highest elevation offset surfaces 462 forms a second portion 482*b* of fourth raised edge 482.

Second offset surface 468 in relation to a first portion 464*a* of second highest elevation offset surfaces 464 forms a first portion 480*a* of a fifth raised edge 480. Second offset surface 468 in relation to a second portion 464*b* of second highest elevation offset surfaces 464 forms a second portion 480*b* of a fifth raised edge 480.

Respective first portions 482*a* and 480*a* of respective fourth and fifth raised edges 482 and 480 are oriented laterally, generally parallel bottom side cavity 458. Respective second portions 482*b* and 480*b* of respective fourth and fifth raised edges 482 and 480 are oriented laterally, perpendicular bottom side cavity 458.

The respective third, fourth, and fifth, raised edges 478, 482, and 480 generally block access to and prevent tampering with lateral edges 346 of lock handle 114, with the second offset surface 468 defining a second relief 492 of the plurality of reliefs and protecting a remaining portion of lock handle 114 (best illustrated in FIGS. 4D-9 and 4D-10). The expanse of the second offset surface 468 generally covers a general mid-portion of bottom side 308 of casing 302.

A third offset surface 470 of the plurality of offset surfaces in relation to second offset surface 468 forms a sixth raised edge 484 of the plurality of raised edges, defining a third relief 494 of the plurality of reliefs that accommodates lock hinge pin 120 (best illustrated in FIGS. 4D-9 to 4D-11).

A fourth offset surface 472 of plurality of offset surfaces in relation to the second offset surface 468 and highest elevation offset surfaces 462 and 464 forms seventh and eighth raised edges 488 and 486 of plurality of raised edges, defining a fourth relief 496 of the plurality of reliefs that accommodates first portion 412 of guard 440 of portable hasp 404.

As further illustrated in FIGS. 4A-1 to 4D-11, bottom side 460 further includes a bottom side cavity 458 extending in part way along a height 498 of the casing 402, commencing from fourth offset surface 472 defining first side wall 401, second offset surface 468, defining lateral walls 403 and 405, and third offset surface defining second side wall 407. First side wall 401 has a blind-hole 157, and a second, opposite side wall 407 a through-hole 153. Bottom side cavity 348 is situated away from a geometric center of casing 402, away from a radial center and towards periphery curved side 176 of casing 402. Dimensions and the overall geometric configuration of bottom side cavity 458 may vary commensurate with the overall geometric configuration of locking section 406 of portable hasp 404.

Figures 1, 4D:
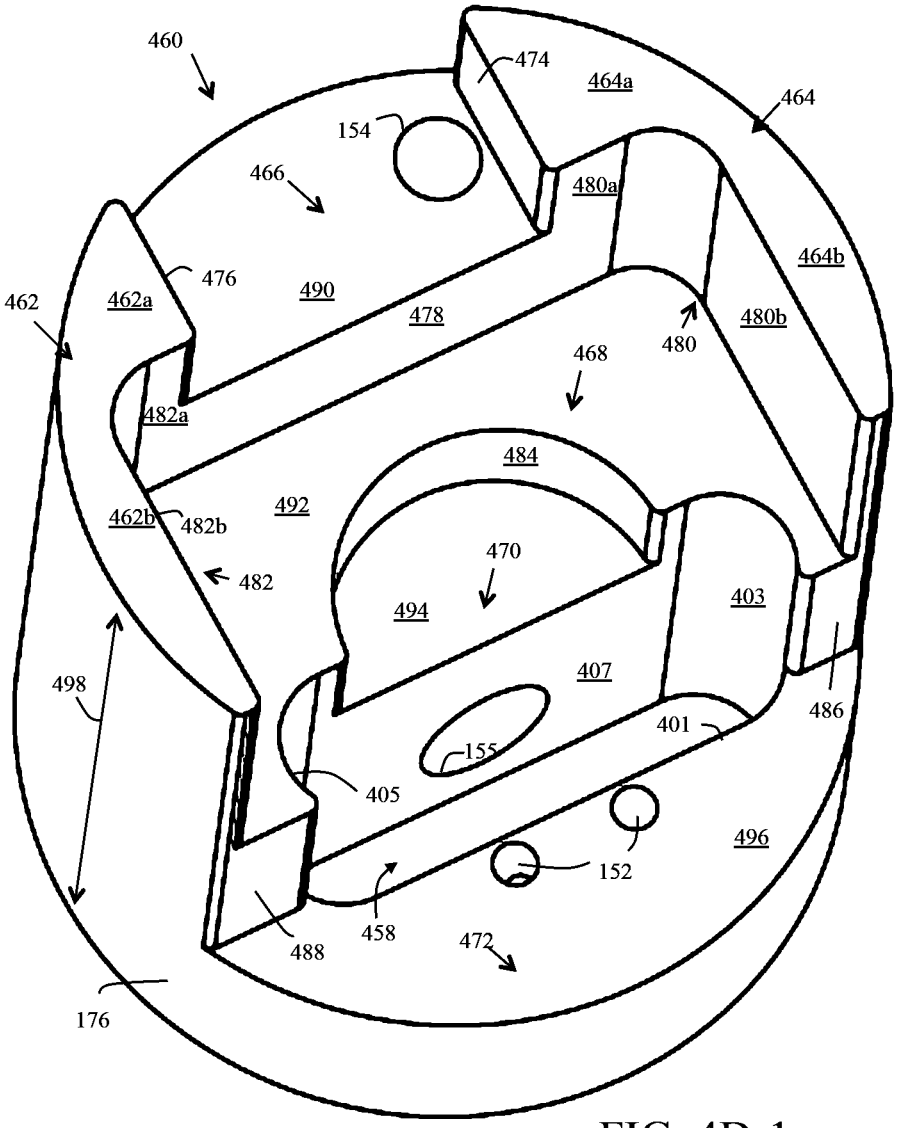
Figures 2, 4D:
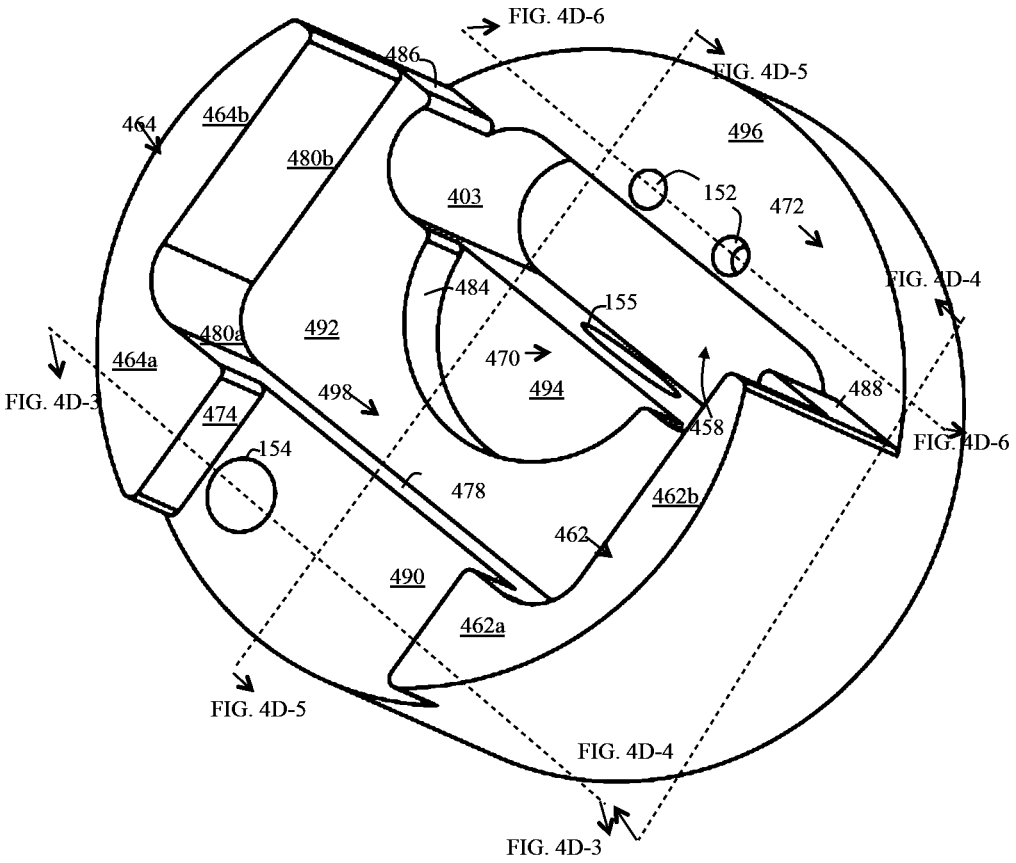
Figures 3, 4D:
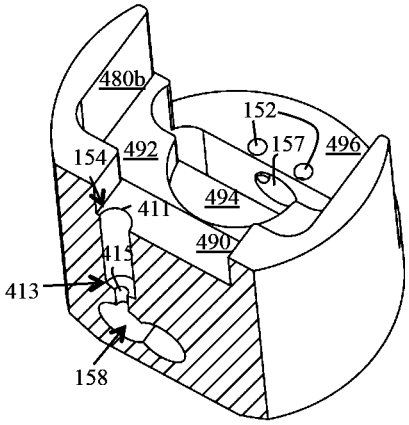
Figures 4, 4D:
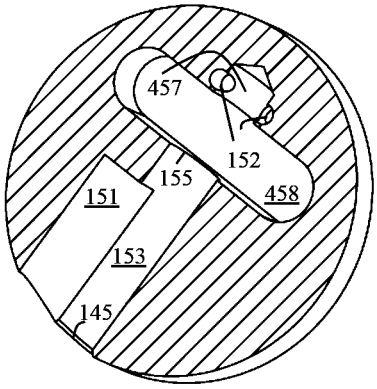
Figures 4, 4D, 5:
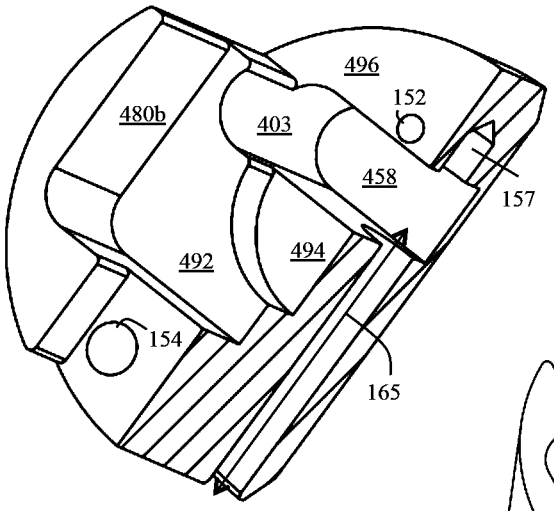
Figures 4, 4D, 5, 6:
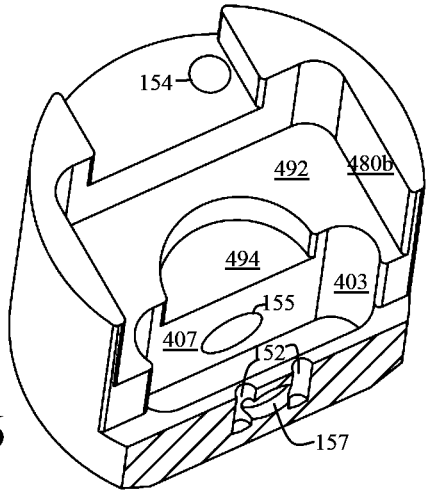
Figures 4, 4D, 5, 6, 7:
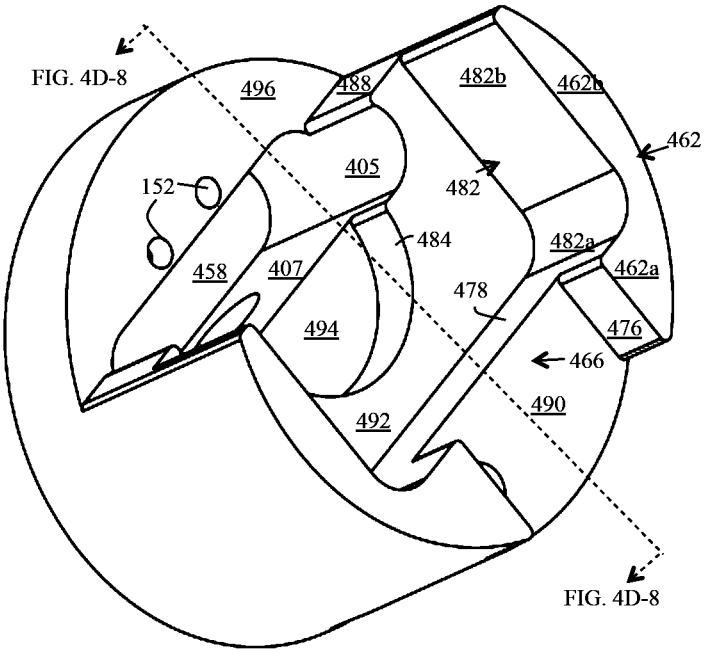
Figures 4, 4D, 5, 6, 7, 8:
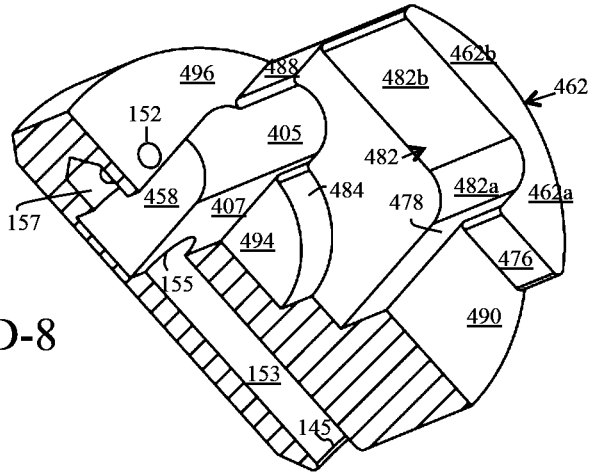
Figures 4, 4D, 5, 6, 7, 8, 9:
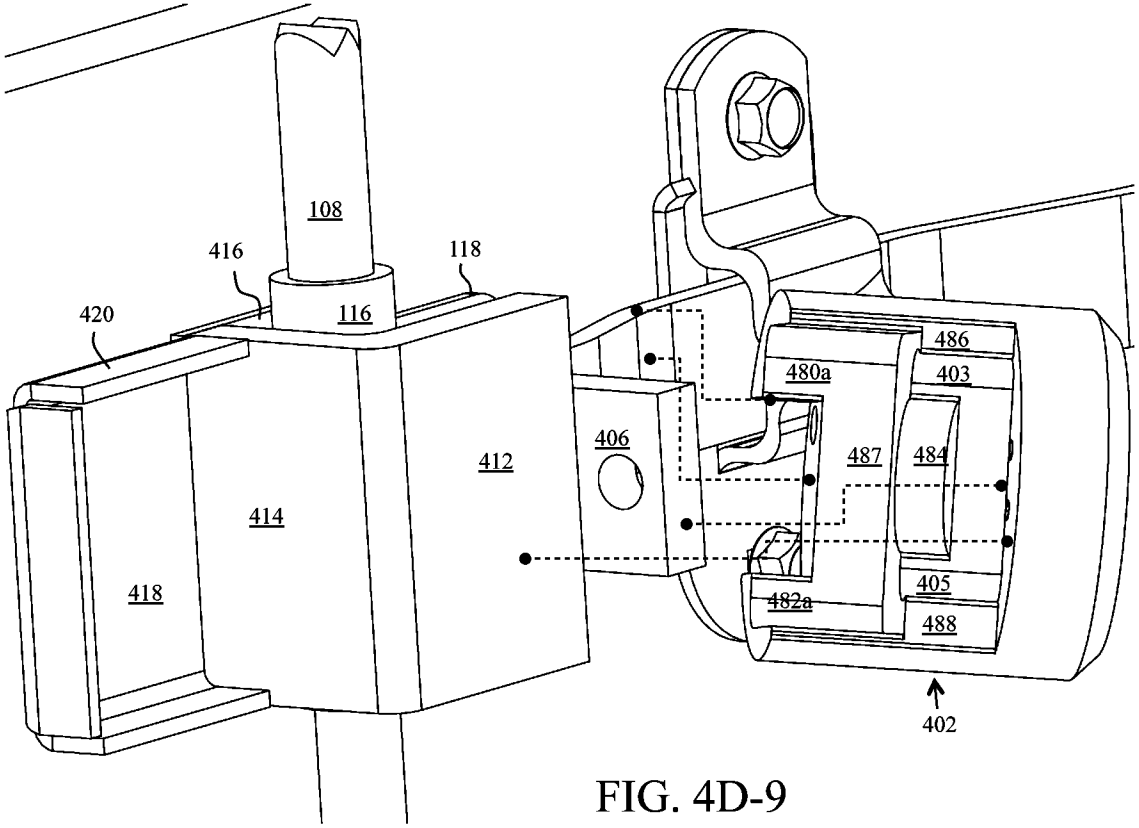
Figures 4, 4D, 5, 6, 7, 8, 9, 10:
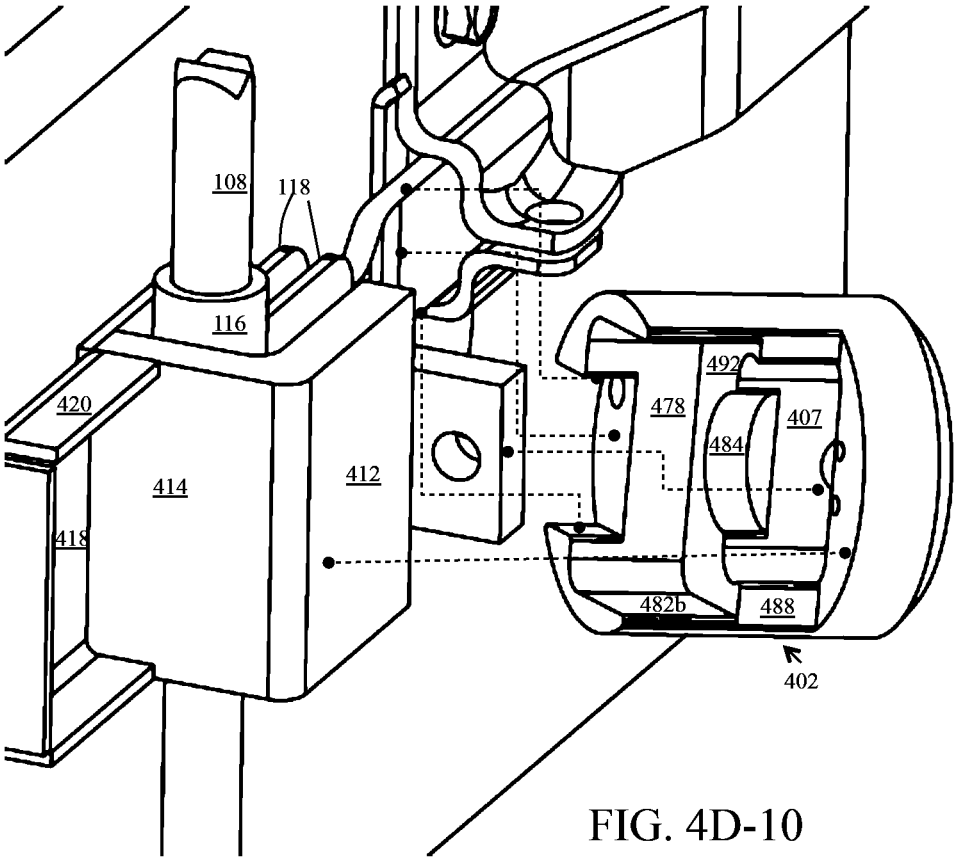
Figures 4, 4D, 5, 6, 7, 8, 9, 10, 11:
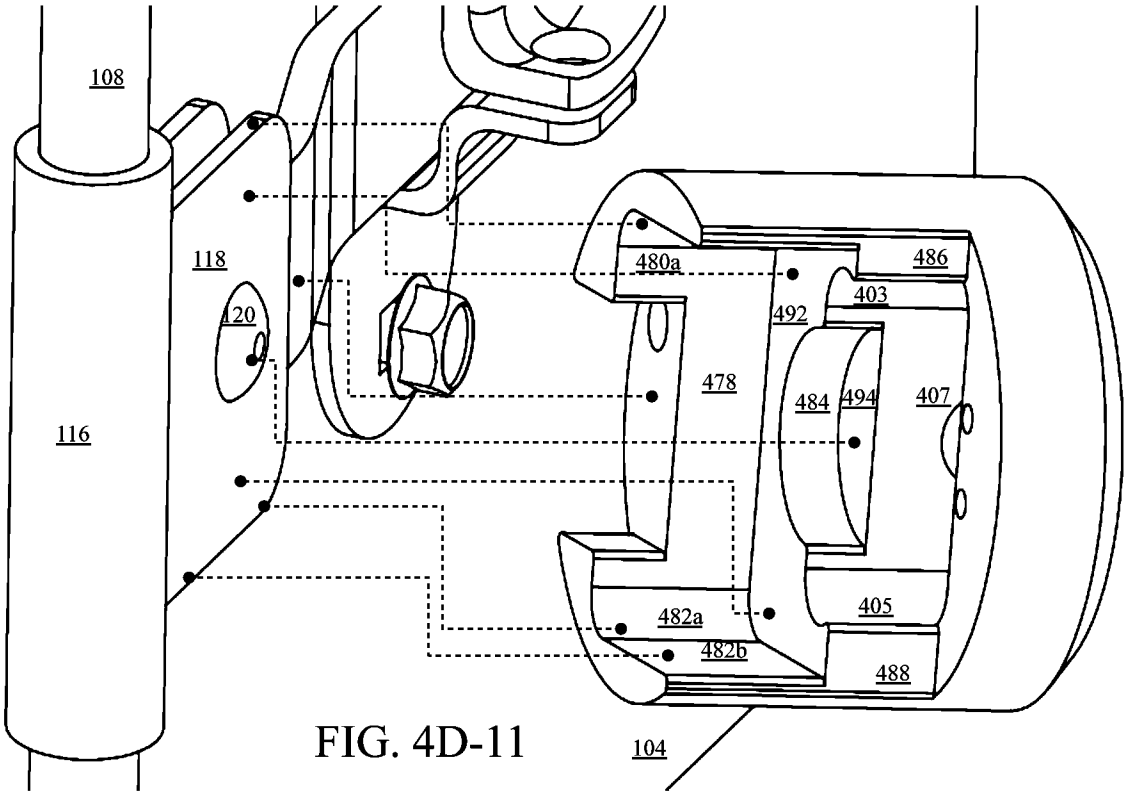

As further illustrated in FIG. 4D-3, casing 402 further includes a retaining hole 154 with an opening 411 at offset surface 490 that leads to side hole 158. The retaining hole 154 receives a retainer 164 (in a form of a non-limiting, exemplary retainer screw) to maintain core 130 within side hole 158. It should be noted that the retainer hole 154 and opening 411 thereof is positioned as illustrated, which protects the retainer 164 from being tampered and removed. It should further be noted that retainer 164 used may be a short screw with the distal end 413 of retainer hole 544 (prior to leading to the side hole 158) having threaded portion 415 that enables the use of a short retainer screw to fasten within that portion of retainer hole 154.

FIG. 5A-1 to 5E-15 are non-limiting, exemplary illustrations of a lock device, including various views of a casing thereof in accordance with one or more embodiments of the present invention. A lock device 500 illustrated in FIGS. 5A-1 to 5E-15 includes similar corresponding or equivalent components, interconnections, functional, and or cooperative relationships as lock devices 100, 200, 300, and 400 that are shown in FIGS. 1A-1 to 4D-11, and described above. Therefore, for the sake of brevity, clarity, convenience, and to avoid duplication, the general description of FIGS. 5A-1 to 5E-15 will not repeat every corresponding or equivalent component, interconnections, functional, and or cooperative relationships that has already been described above in relation to lock devices 100, 200, 300, and 400 that are shown in FIGS. 1A-1 to 4D-11.

FIGS. 5A-1 to 5A-9 are non-limiting, exemplary illustrations of a lock device 500 in relation to hasp assembly 504 and lock assembly 506 of a first type of roll-up cargo door 508 in accordance with one or more embodiments of the present invention. FIGS. 5A-10 and 5A-11 are non-limiting, exemplary enlarged illustrations of hasp assembly 504 in relation to lock assembly 506 of a first type of roll-up cargo door 508 in accordance with one or more embodiments of the present invention, with FIGS. 5B-1 to 5B-3 illustrating lock device 500 and hasp assembly 504 in relation to hook 512 of lock assembly 506.

Referring to FIGS. 5A-1 and 5A-11, the illustrated lock assembly 506 is very well known and conventional, and is one of many types that are mainly used with a typical roll-up cargo door container 508. In general, most roll-up cargo door containers 508 in closed position are secured with a truck bed 510 and are actually vertically rolled-up and away from the truck bed 510 to an open position, allowing access to container. Lock assembly 506 includes a hook 512 that hooks onto and is secured within hook openings 514 and 516 (generally positioned on the tuck bed) to securely maintain the roll-up cargo door container 508 in closed position so that the door 508 does not roll-up during drive.

To open roll-up cargo door 508, a latch 516 is moved along reciprocating path 518, then lock handle 520 is moved along reciprocating path 522 to move and free hook 512 from hook openings 514 and 516, with the roll-up cargo door container 508 free to roll up and open access to the container. Lock device 500, including hasp assembly 504 in accordance with the present invention are used to lock-in and secure hook 512 within hook openings 514 and 516, and block the hook 512 from being moved out of hook openings 514 and 516 to thereby prevent unauthorized access to container.

Figures 1, 5A:
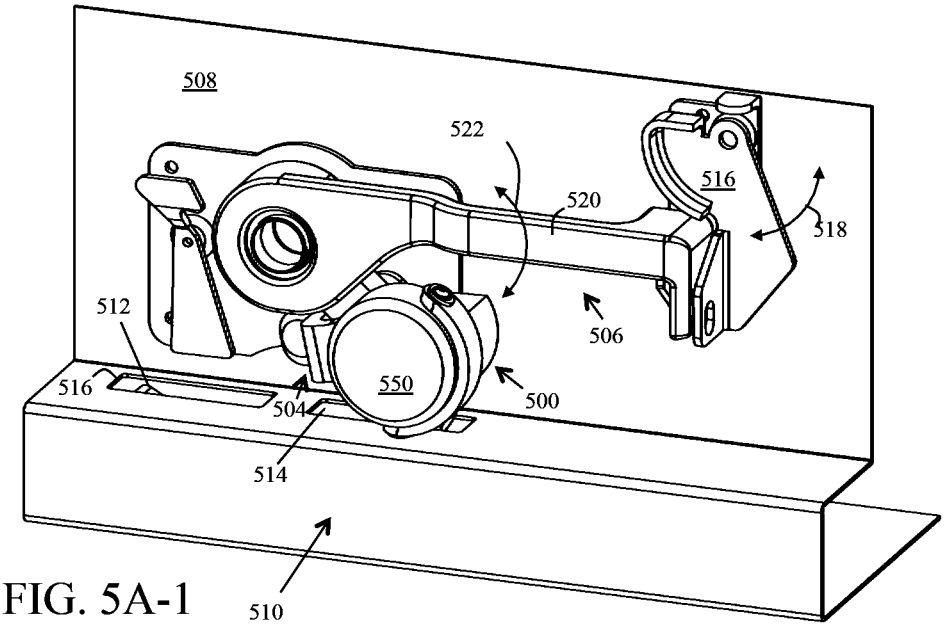
Figures 2, 5A:
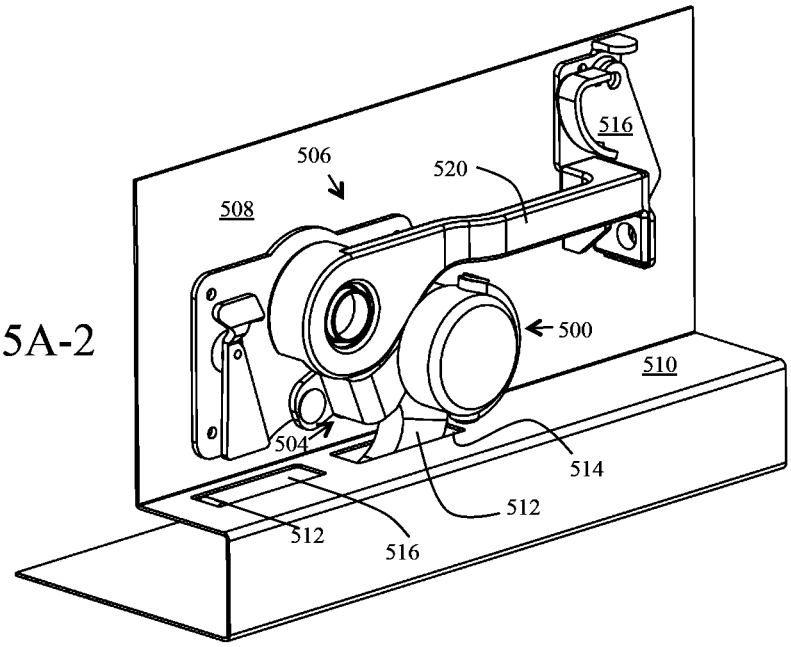
Figures 3, 5A:
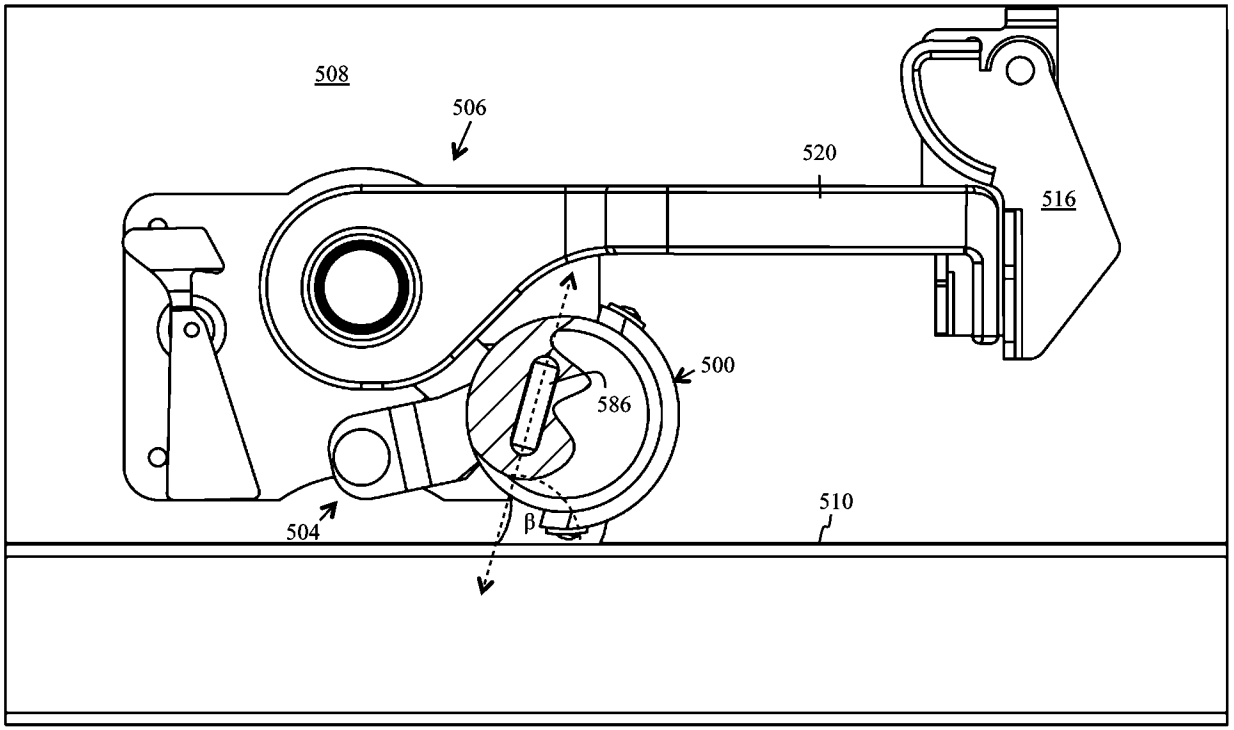
Figures 4, 5A:
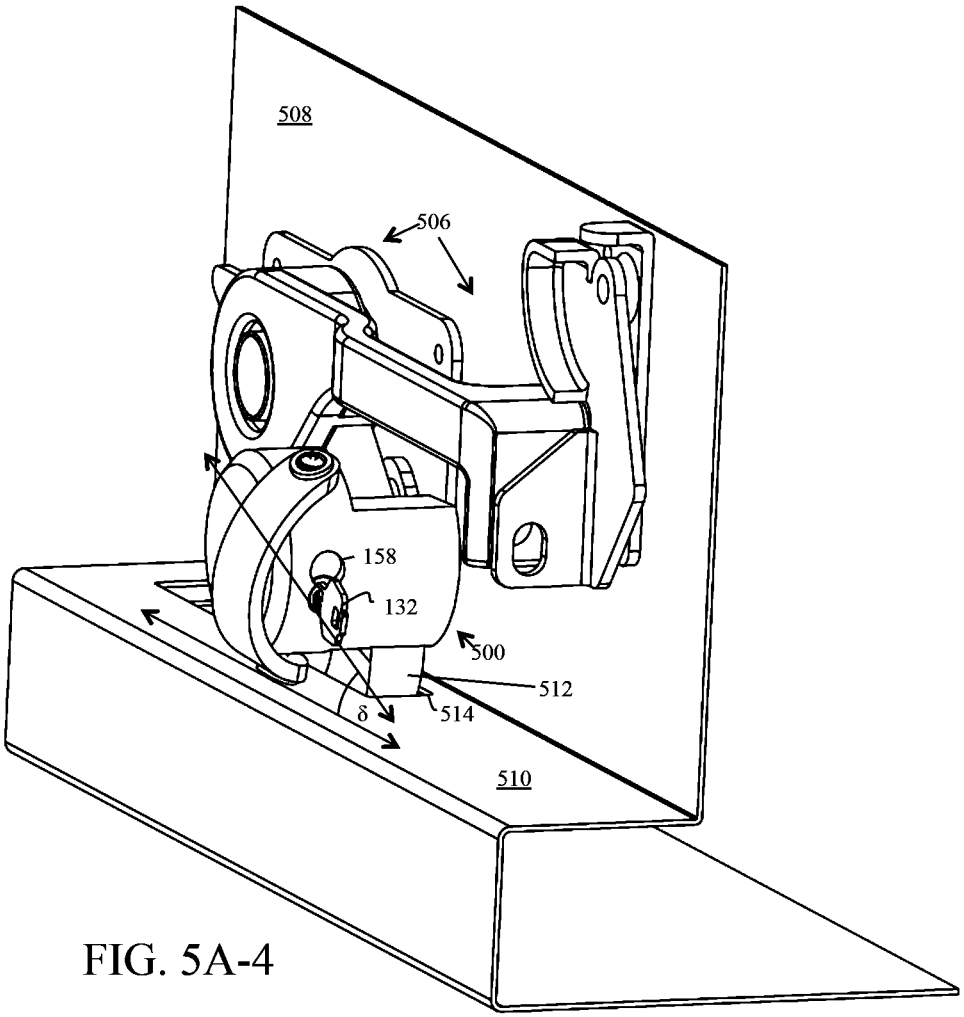
Figures 5, 5A:
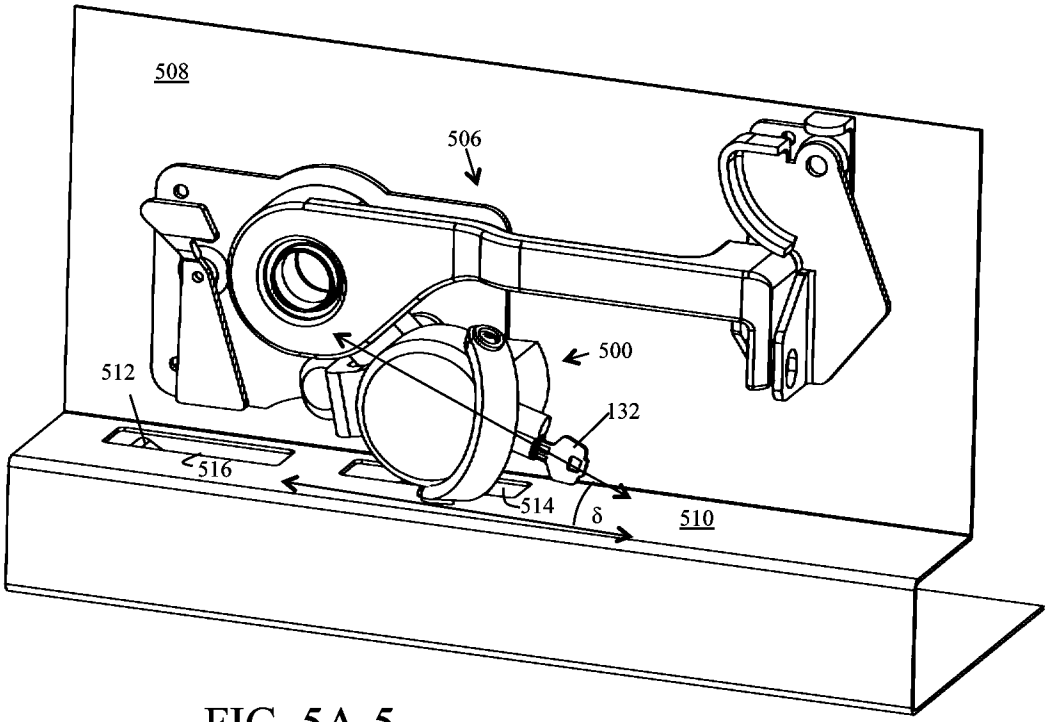
Figures 5, 5A, 6:
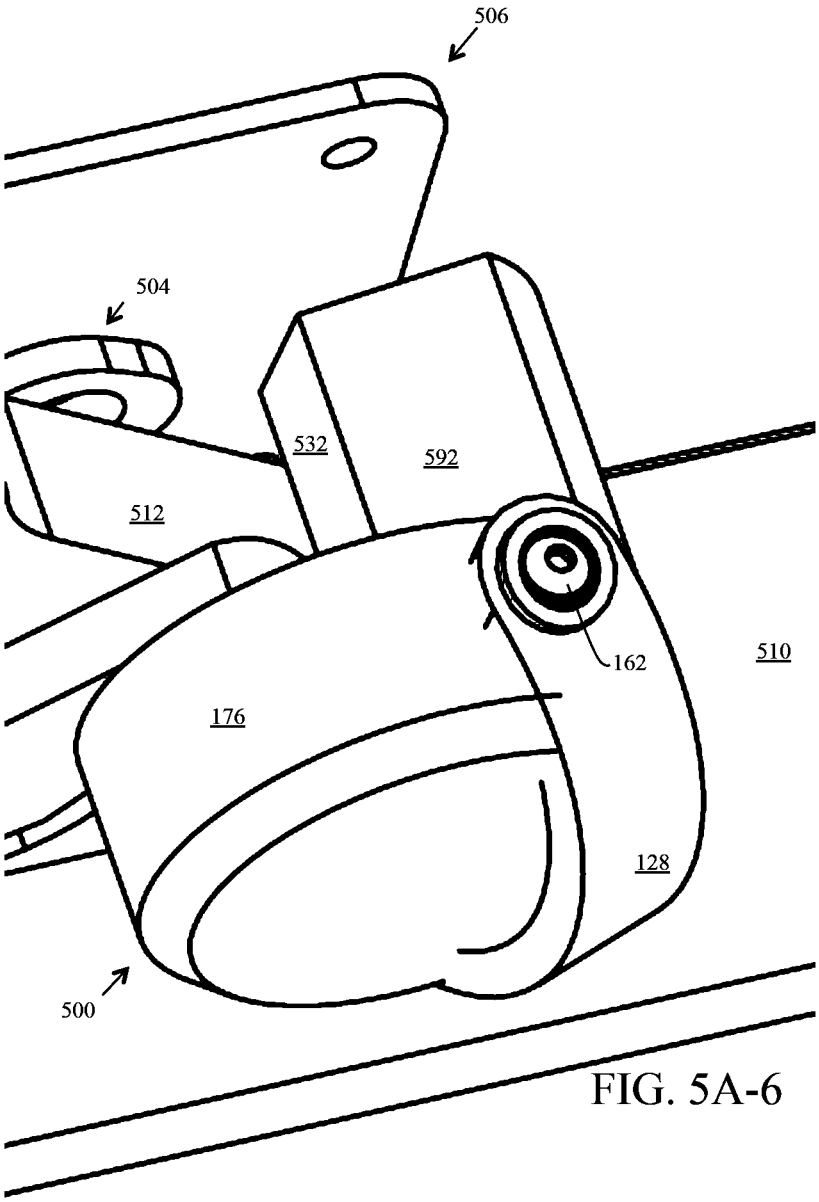
Figures 5, 5A, 6, 7:
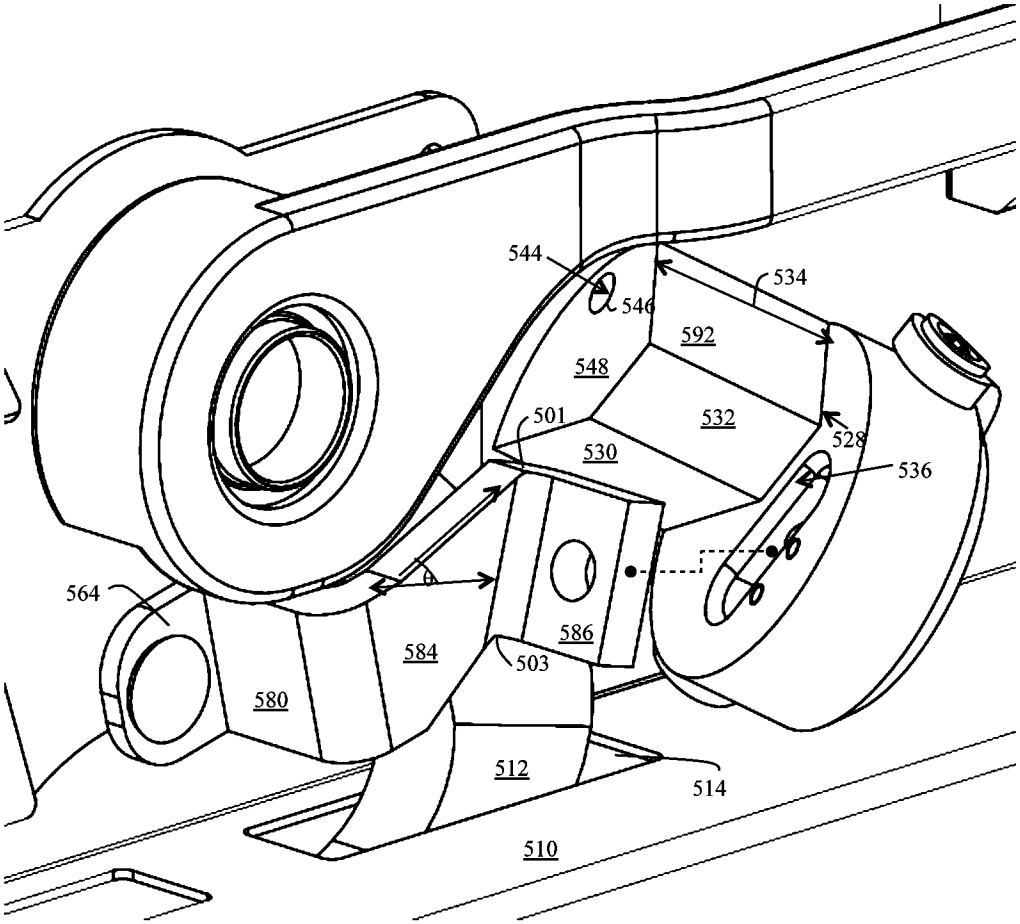
Figures 5, 5A, 6, 7, 8:
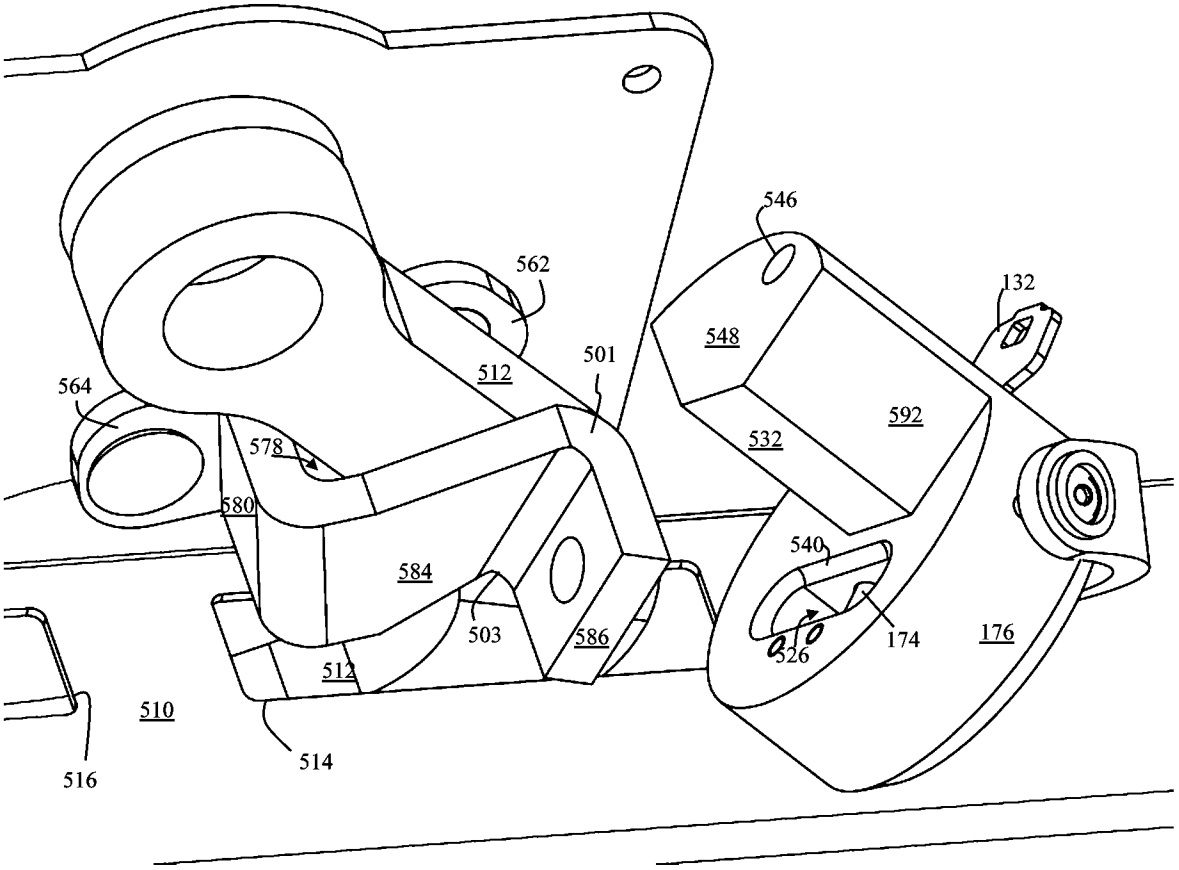
Figures 5, 5A, 6, 7, 8, 9:
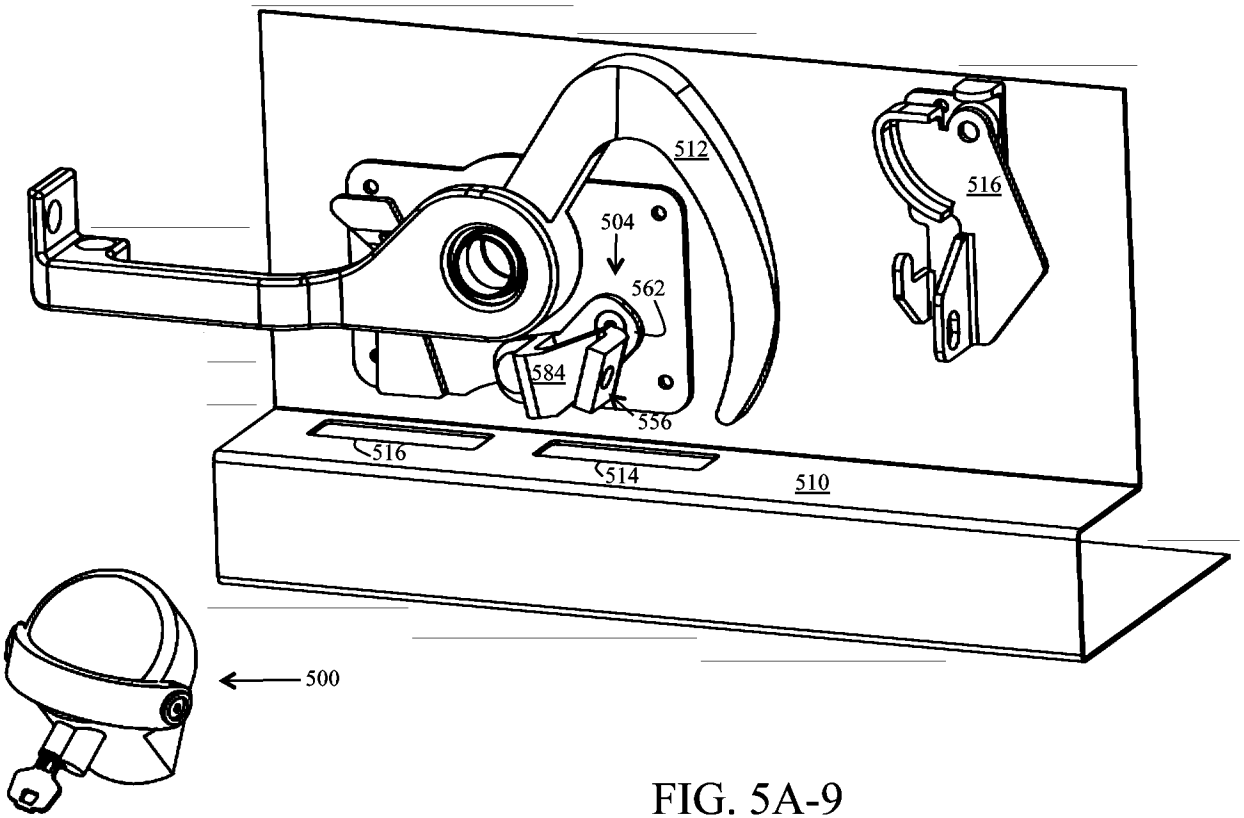
Figures 5, 5A, 6, 7, 8, 9, 10:
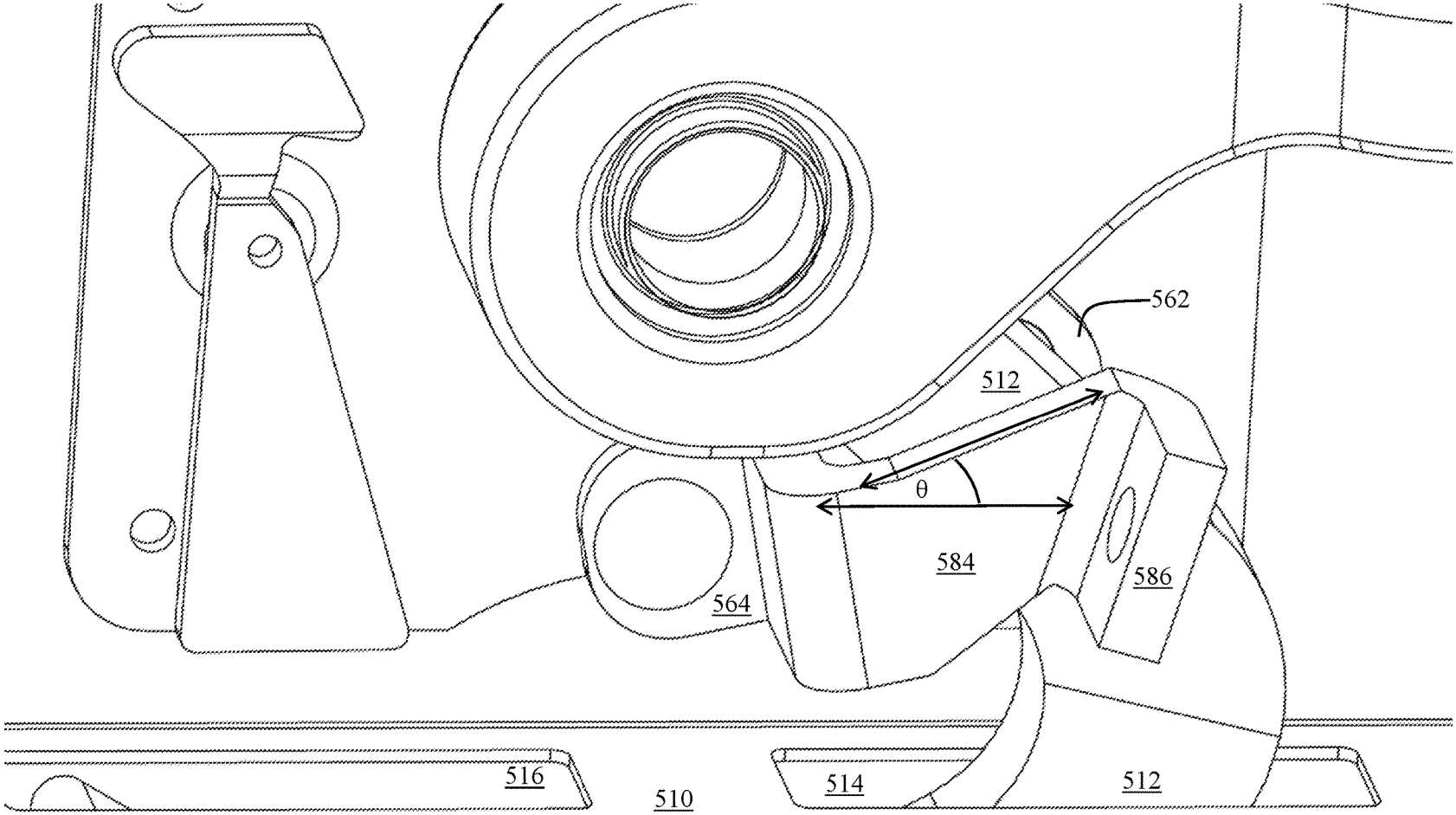
Figures 5, 5A, 6, 7, 8, 9, 10, 11:
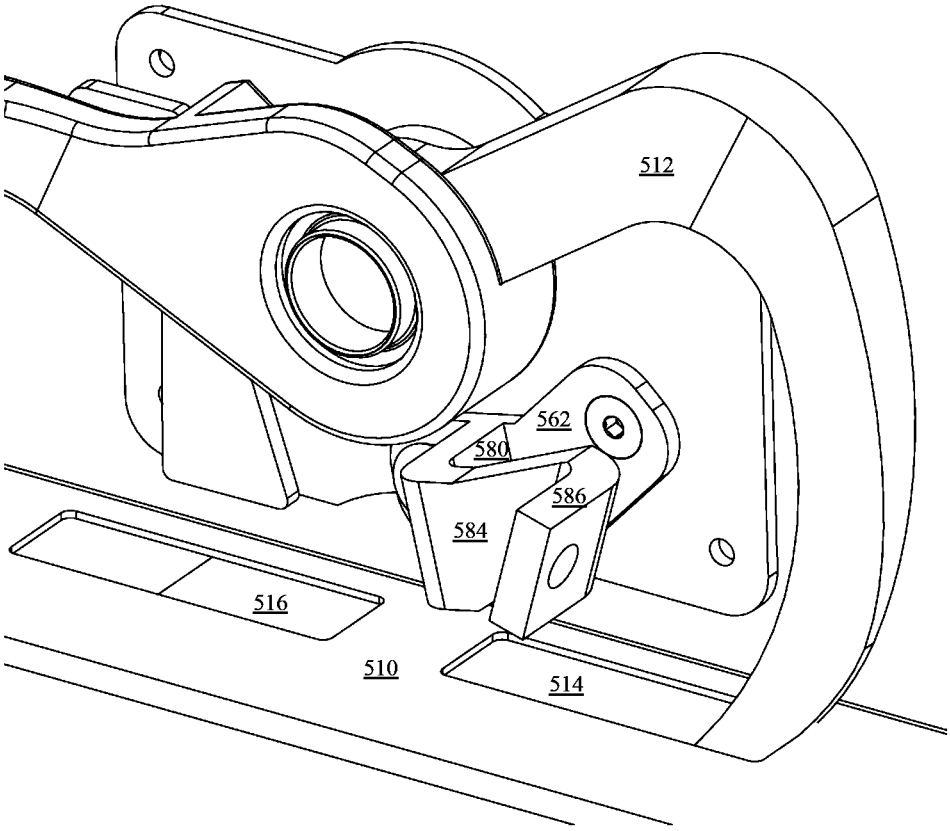
Figures 1, 5C:
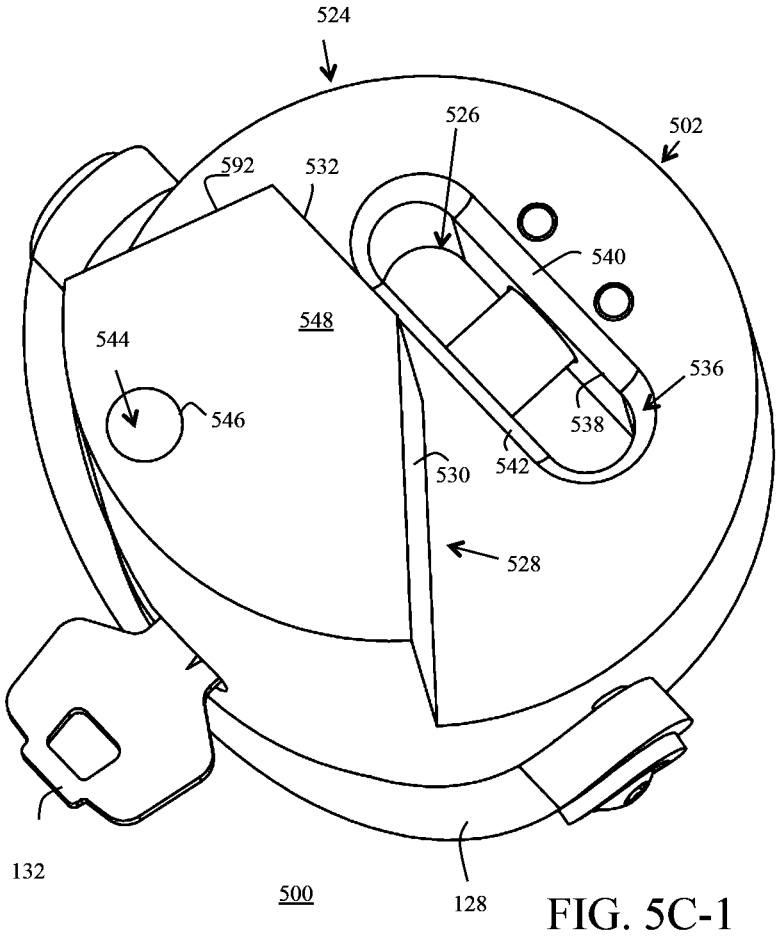
Figures 2, 5C:
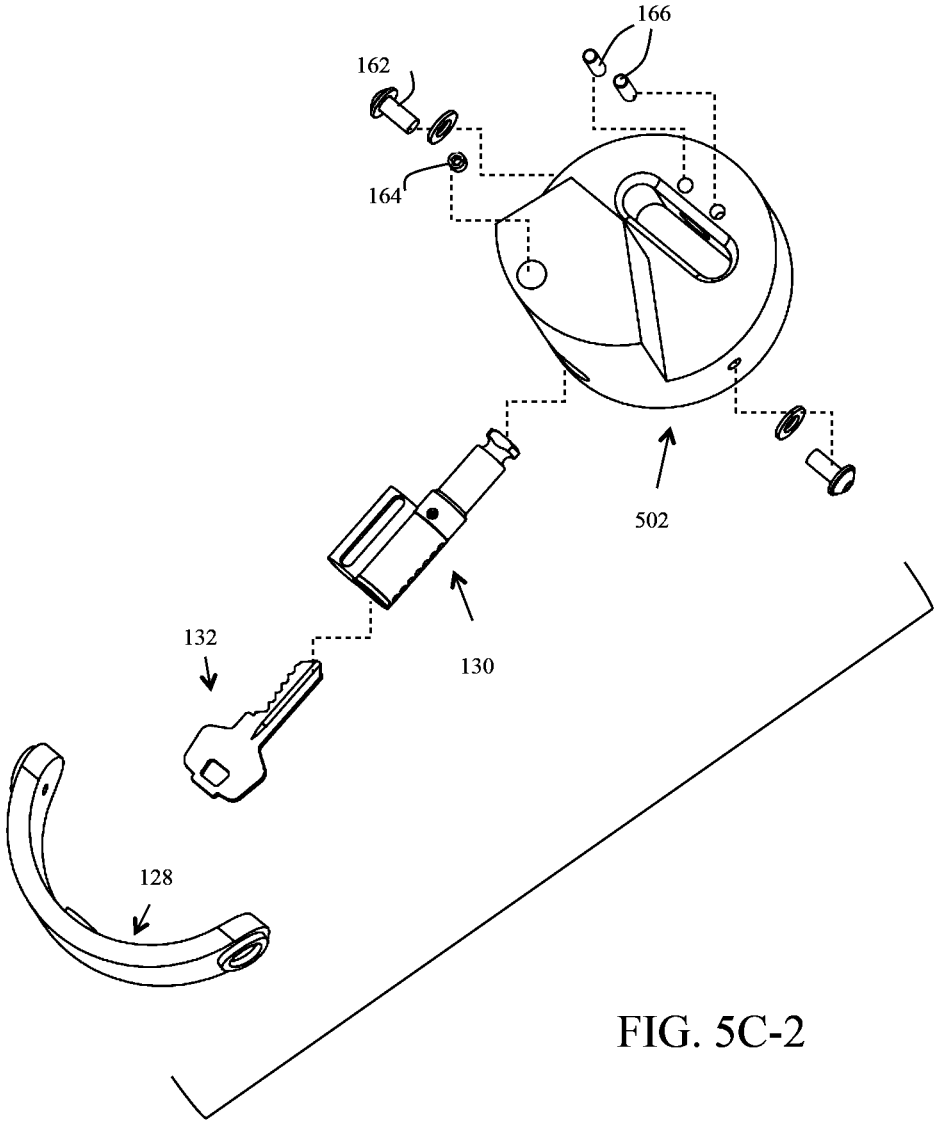
Figures 1, 5D:
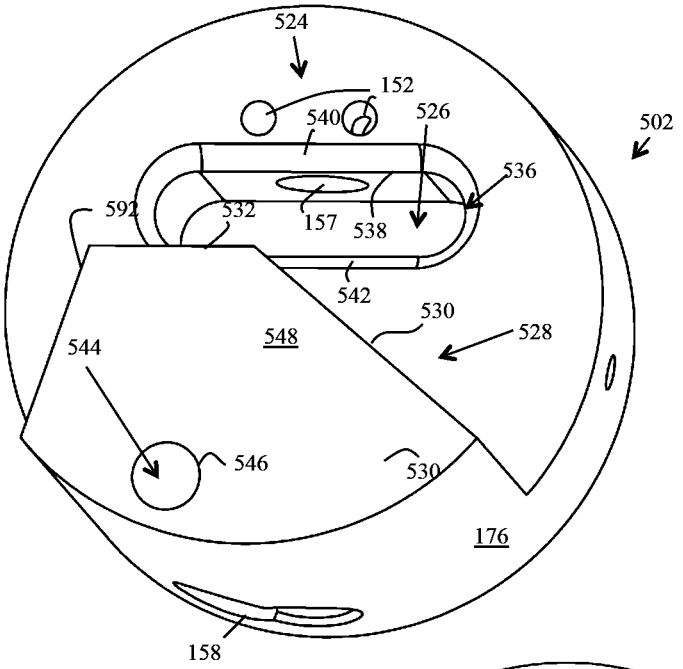
Figures 2, 5D:
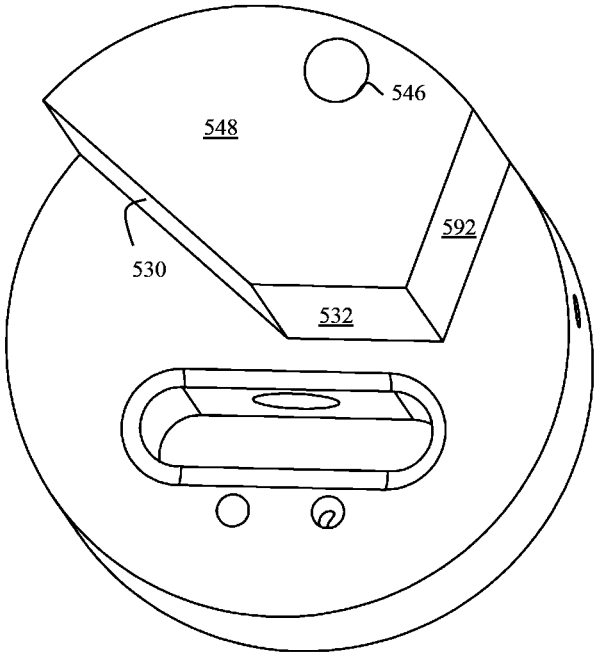
Figures 3, 5D:
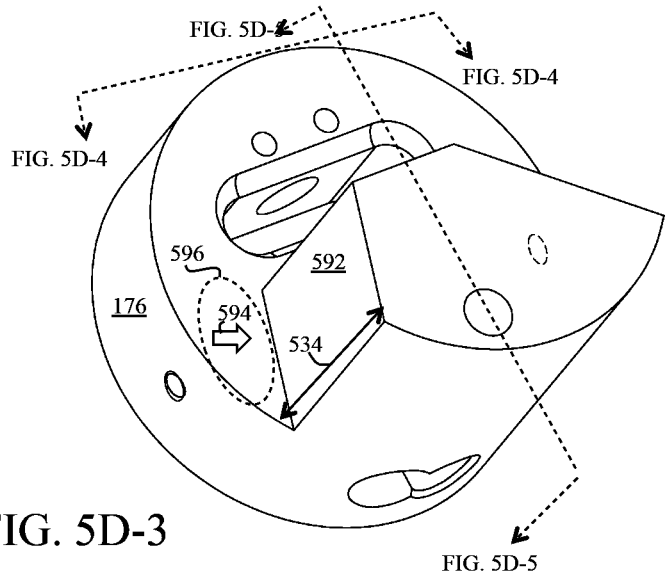
Figures 4, 5D:
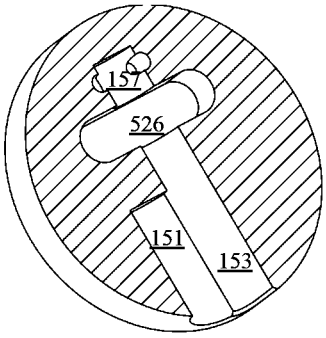
Figures 5, 5D:
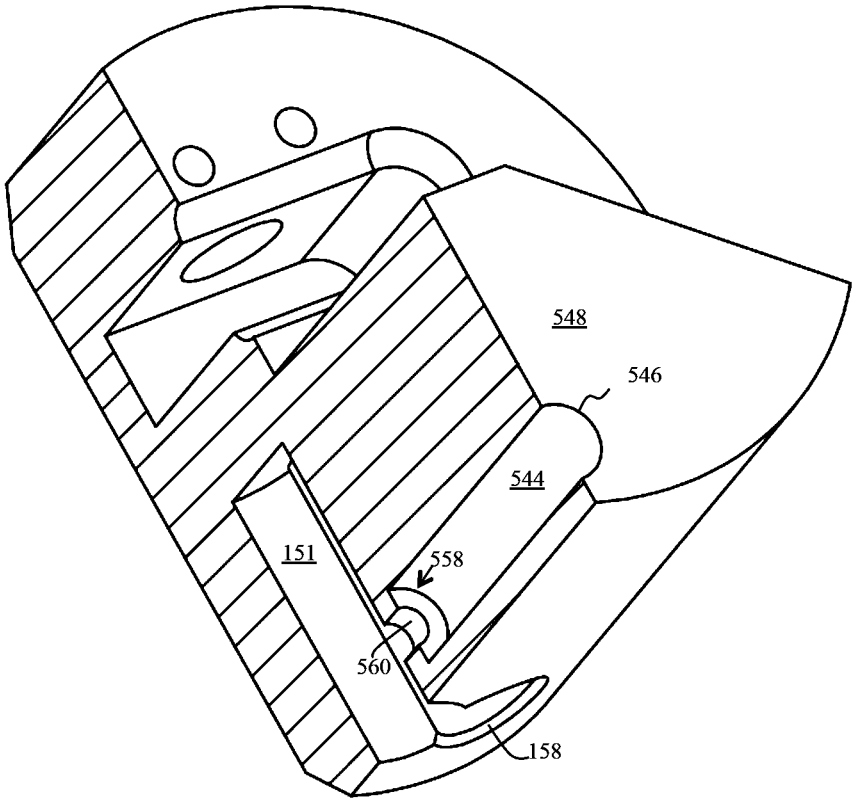
Figures 5, 5D, 6:
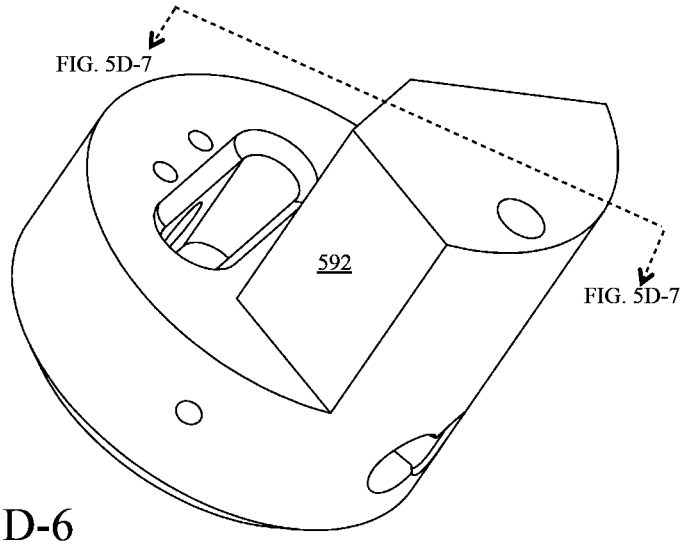
Figures 5, 5D, 6, 7:
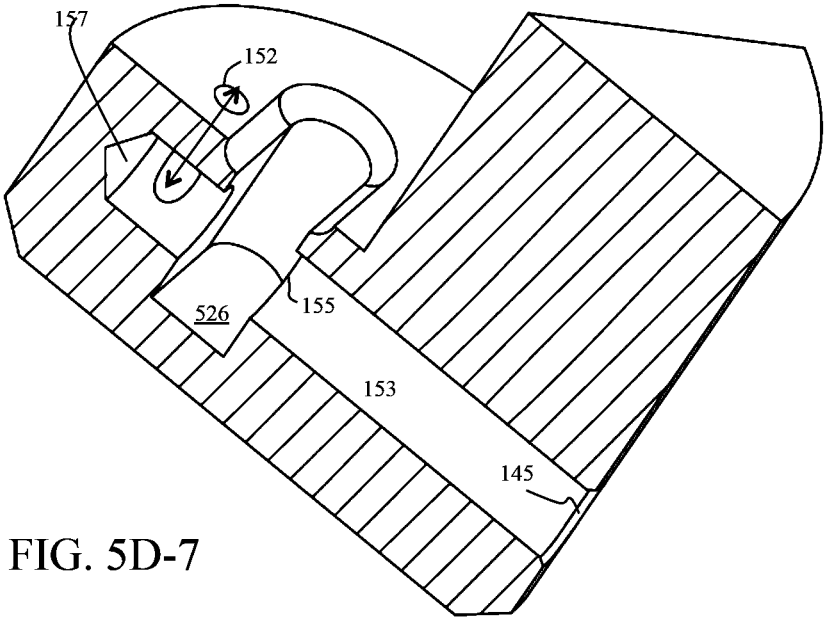
Figures 5, 5D, 6, 7, 8:
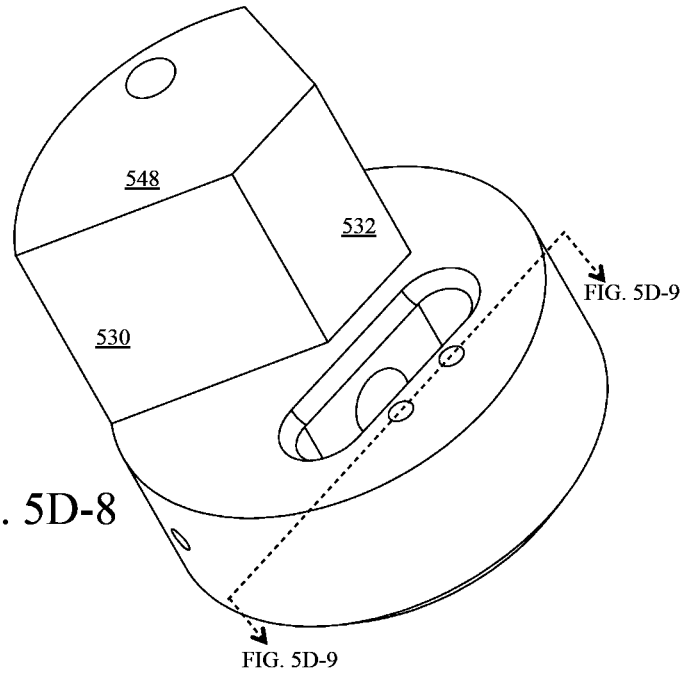
Figures 5, 5D, 6, 7, 8, 9:
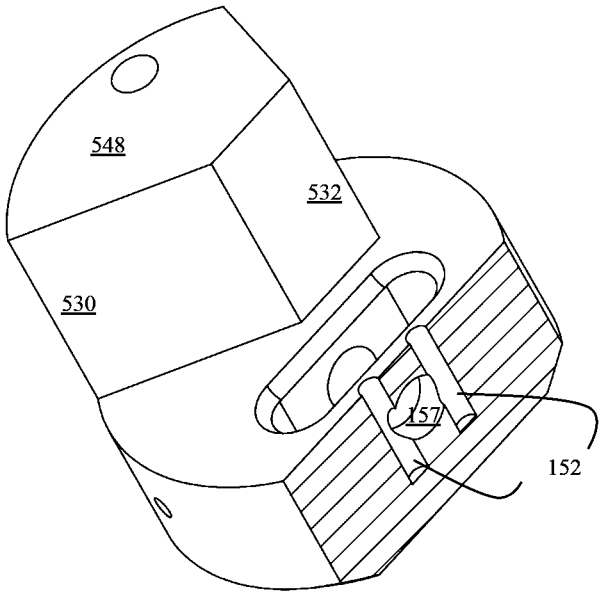
Figures 5, 5D, 6, 7, 8, 9, 10:
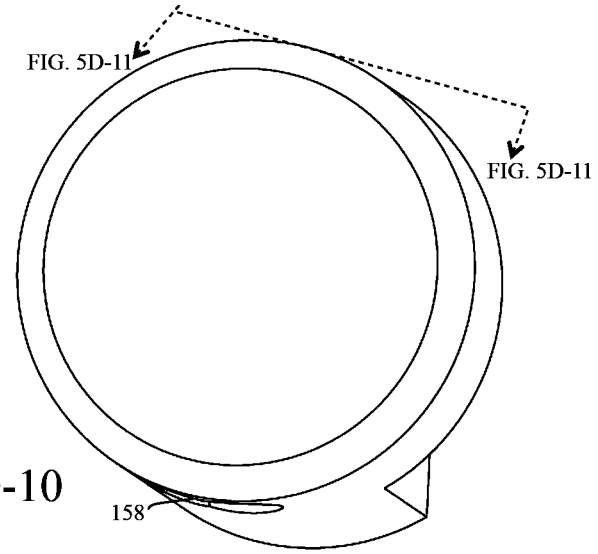
Figures 5, 5D, 6, 7, 8, 9, 10, 11:
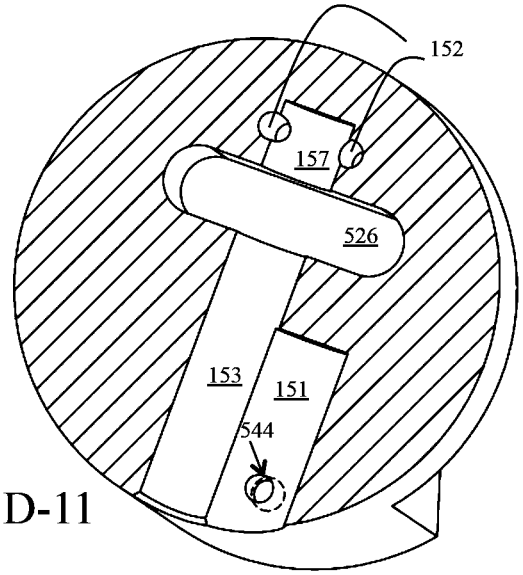
Figures 1, 5E:
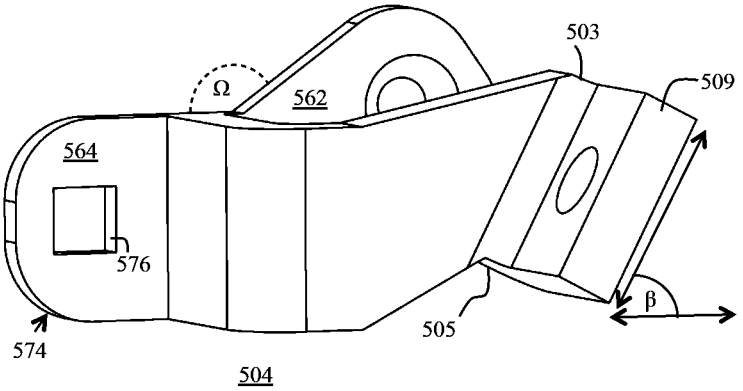
Figures 2, 5E:
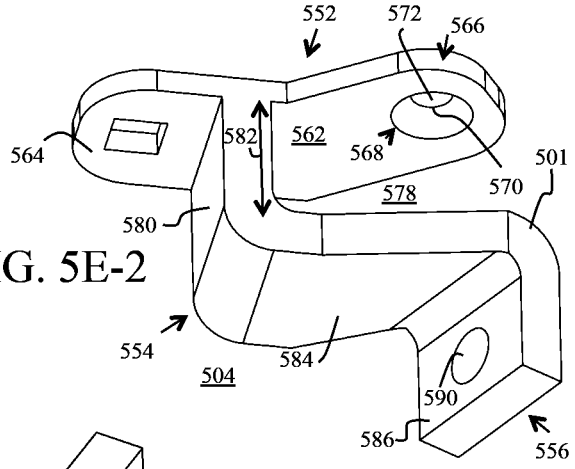
Figures 3, 5E:
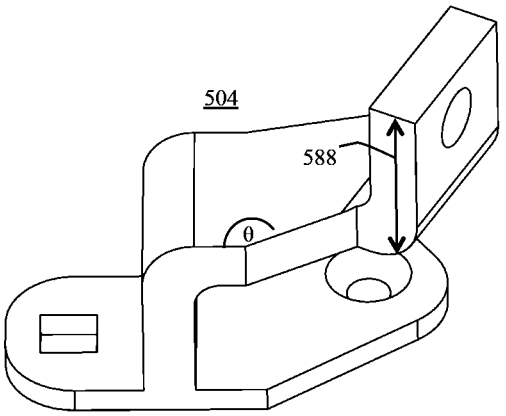
Figures 4, 5E:
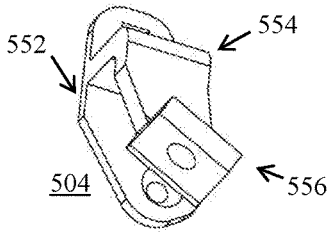
Figures 5, 5E:
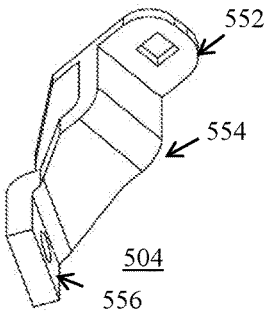
Figures 5, 5E, 6:
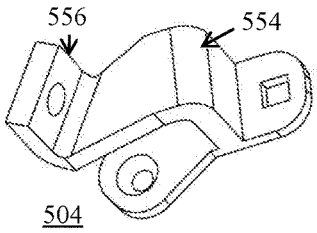
Figures 5, 5E, 6, 7:
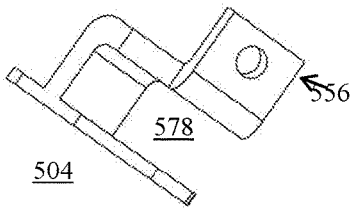
Figures 5, 5E, 6, 7, 8:
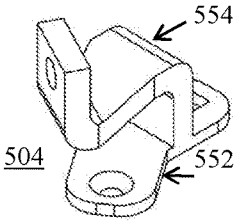
Figures 5, 5E, 6, 7, 8, 9:
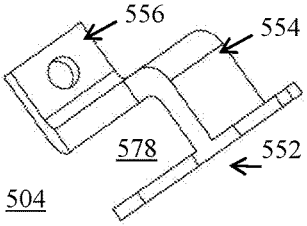
Figures 5, 5E, 6, 7, 8, 9, 10:
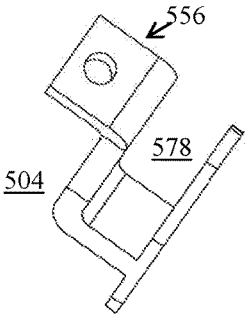
Figures 5, 5E, 6, 7, 8, 9, 10, 11:
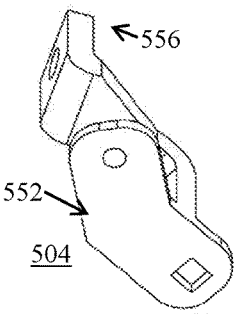
Figures 5, 5E, 6, 7, 8, 9, 10, 11, 12:
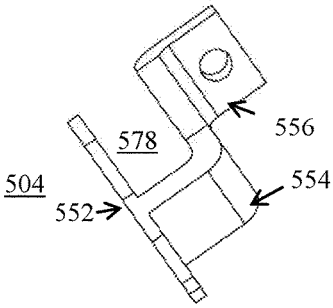
Figures 5, 5E, 6, 7, 8, 9, 10, 11, 12, 13:
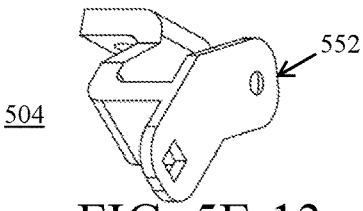
Figures 5, 5E, 6, 7, 8, 9, 10, 11, 12, 13, 14:
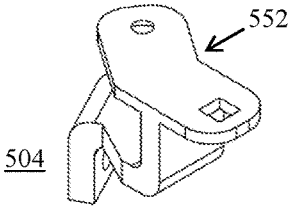
Figures 5, 5E, 6, 7, 8, 9, 10, 11, 12, 13, 14, 15:
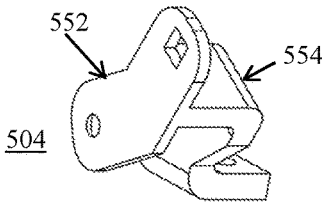
Figure 6A:
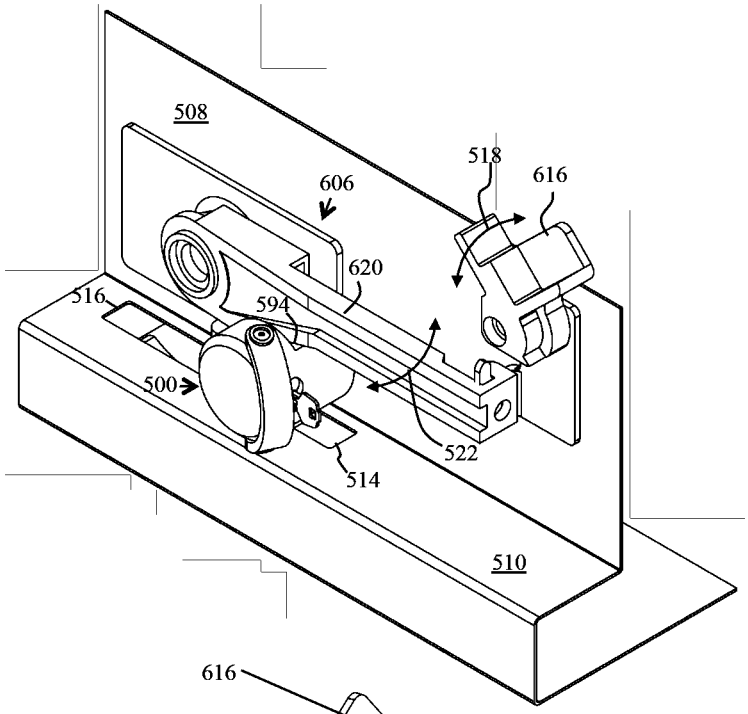
Figures 1, 6B:
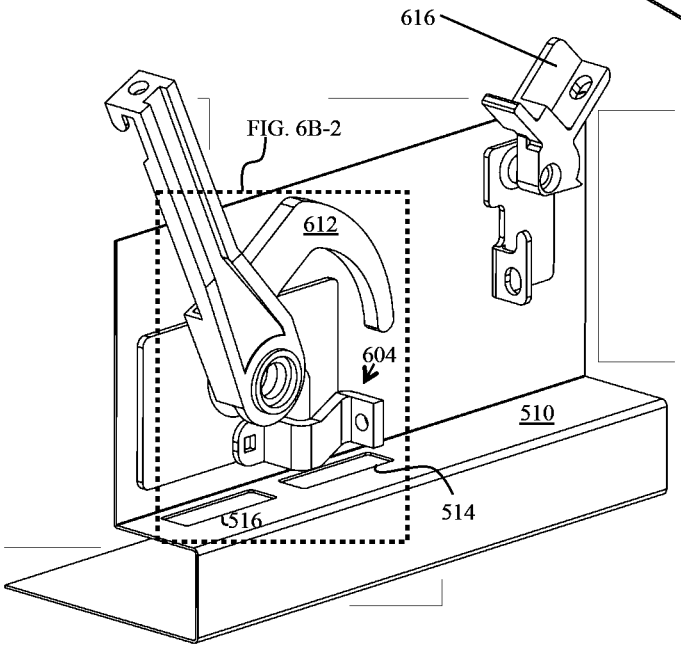
Figures 2, 6B:
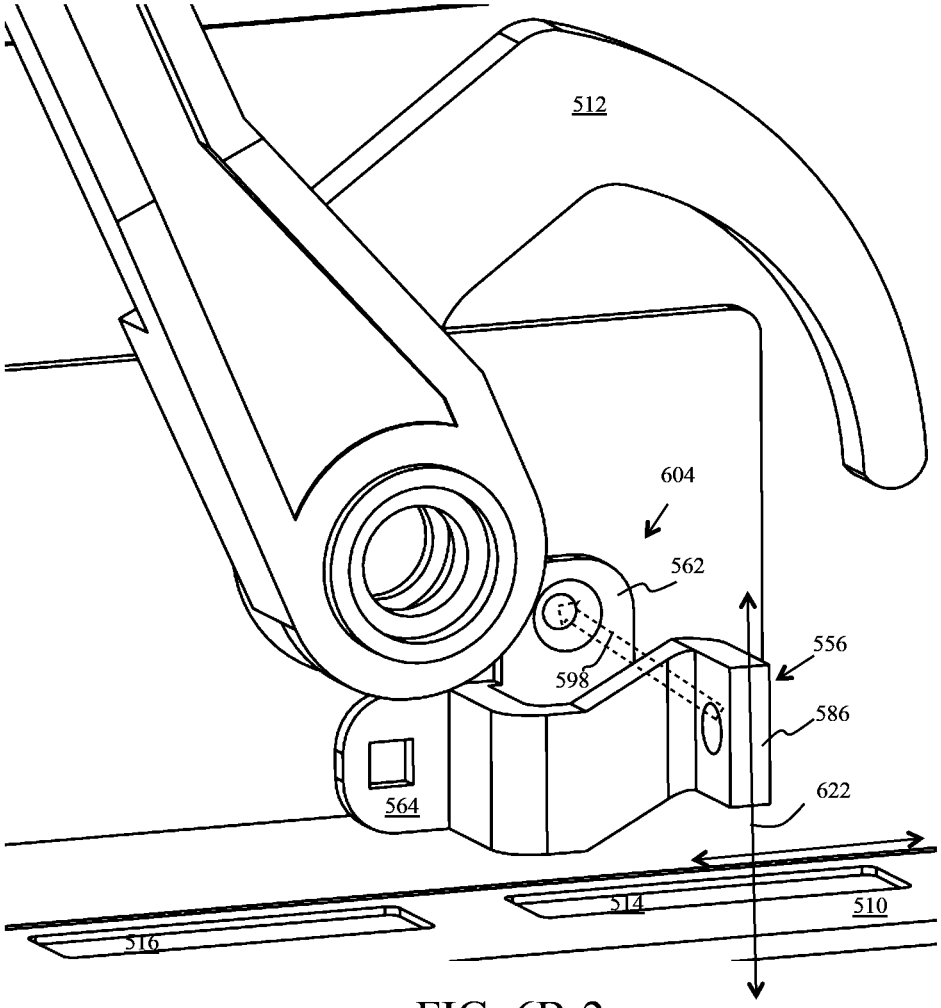
Figures 1, 6C:
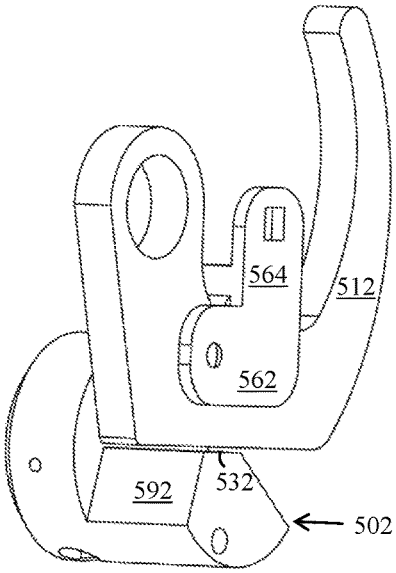
Figures 2, 6C:
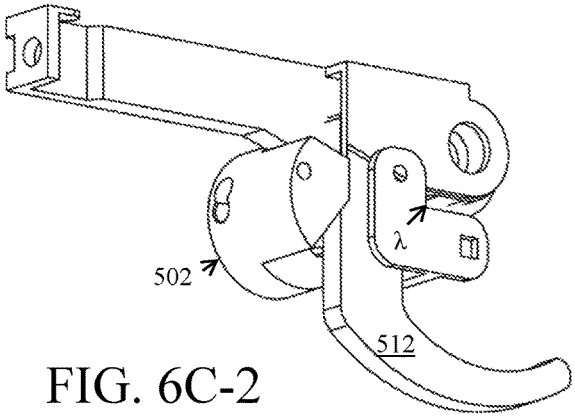
Figures 3, 6C:
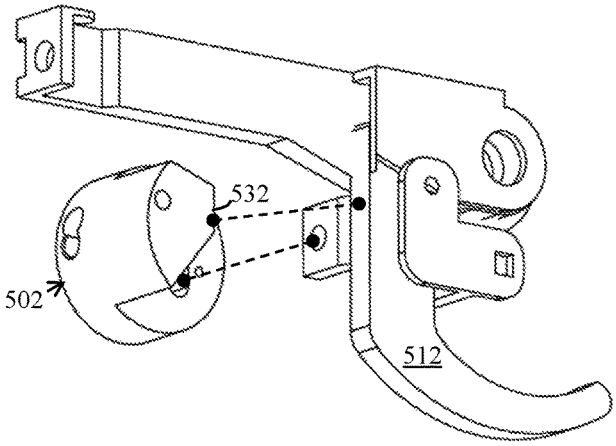
Figures 4, 6C:
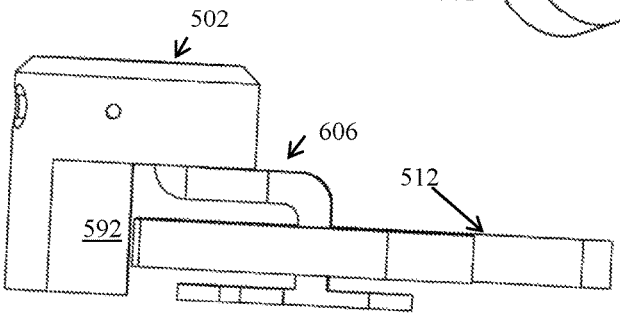
Figures 1, 6D:
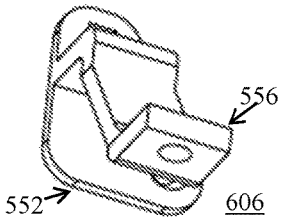
Figures 2, 6D:
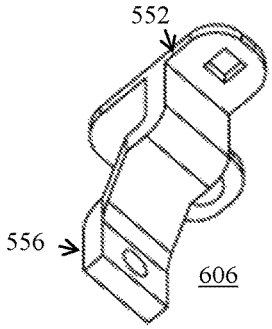
Figures 3, 6D:
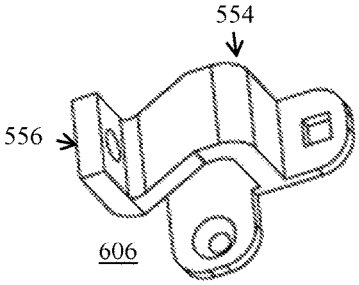
Figures 4, 6D:
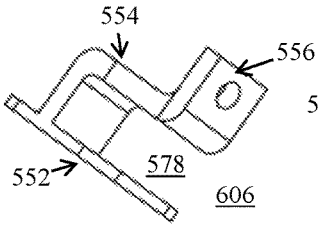
Figures 5, 6D:
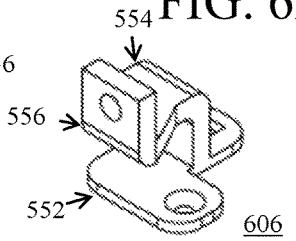
Figures 6, 6D:
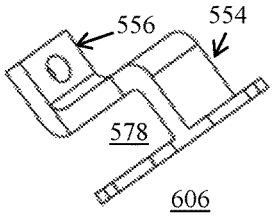
Figures 6, 6D, 7:
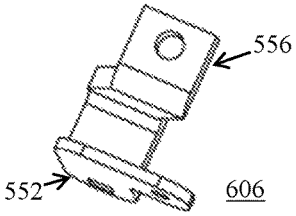
Figures 6, 6D, 7, 8:
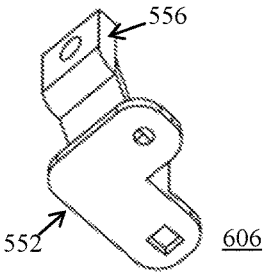
Figures 6, 6D, 7, 8, 9:
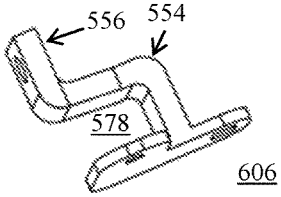
Figures 6, 6D, 7, 8, 9, 10:
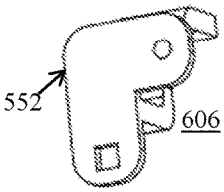
Figures 6, 6D, 7, 8, 9, 10, 11:
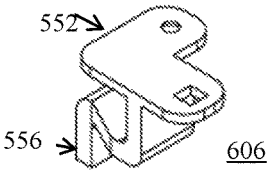
Figures 6, 6D, 7, 8, 9, 10, 11, 12:
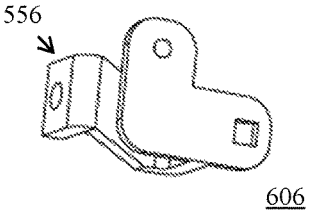

As illustrated in FIGS. 5A-1 to 5B-3, lock device 500 includes casing 502 and optional cover 128 that covers over core 130 associated with casing 502 (with cover and core removed for FIGS. 5B-1 to 5B-3). In order to unlock casing 502 from hasp assembly 504 to unlock and open lock assembly 506 to open cargo door 508, cover 128 is first moved to open position (FIG. 5A-4), core 130 is unlocked from casing 126 using key 132, and as best illustrated in FIG. 5A-5, the core 130 slides out only partially while still remain within casing 502 as shown. Once core 130 partially slides out, casing 502 may be removed away from hasp assembly 504 (progressively illustrated in FIGS. 5A-6 to 5A-11) to open cargo door 508.

FIGS. 5C-1 to 5D-11 are a non-limiting, exemplary illustration of various views, including sectional views of a casing of a lock device shown in FIGS. 5A-1 to 5B-3 in accordance with one or more embodiments of the present invention. As illustrated, the casing 502 is comprised of a generally cylindrical configuration having a bottom side 524 that includes a bottom side cavity 526 and a member 528 that protrudes from the bottom side 524, which is used to obstruct a movement of a hook 512 of lock assembly 506. The member 528 includes one or more blocking side 530, 532 for preventing lock assembly 506 to move from a closed position to open position. In this non-limiting, exemplary instance, blocking side is the larger lateral side surface 530 that blocks the hook 512 from moving from a closed to an open position. A height 534 of the member 528 measured from bottom side 524 is of sufficient length to enable a remaining body of the casing 502 (e.g., the disc like portion, including bottom side portion 524 of the casing 502) to clear lock assembly 506.

Bottom side cavity 526 has a beveled peripheral edge 536 forming a recessed opening 538 into bottom side cavity 526. The recessed opening 538 accommodates a distal end bends 501 of a locking section 556 of hasp assembly 504. More specifically, the recessed opening 538 allows room for the lateral curved edges 503 and 505 of the distal end bend 501 of the locking section 556 of the hasp 504. The beveled periphery edges 536 also function as a chamfer. It should be noted that a first side edge 540 of bottom side cavity 526 has a wider beveled edge than the other side 542.

As further illustrated, casing 502 further includes a retaining hole 544 with an opening 546 at a top 548 of member 528 that leads to side hole 158. The retaining hole 544 receives a retainer 164 (in a form of a non-limiting, exemplary retainer screw) to maintain core 130 within side hole 158. It should be noted that the retainer hole 544 and opening 546 thereof is positioned as illustrated, which protects the retainer 164 from being tampered and removed. In other words, the body of casing 502 blocks and prevents such an act as the top side 550 (which is exposed) has no such hole. In other words, the position of the retainer hole 544 at bottom side 524 on top 548 of member 528 prevents access to retainer 164. It should further be noted that retainer 164 used may be a short screw with the distal end 558 of retainer hole 544 (prior to leading to the side hole 158) having threaded portion 560 that enables the use of a short retainer screw to fasten within that portion of retainer hole 544.

FIGS. 5E-1 to 5E-15 are non-limiting, exemplary illustrations of a hasp assembly 504 used with lock device 500 and lock assembly 506 in accordance with an embodiment of the present invention. As illustrated, haps assembly 506 may comprise of a connection section 552, an accommodating section 554, and a locking section 556. The connection section 552 may include a first connection portion 562 and a second connection portion 564. First connection portion 562 is oriented at an angle Ω in relation to second connection portion 564. A first distal end 566 of first connection portion 562 includes a first hole 568 that accommodates a fastener to facilitate coupling hasp 506 onto an enclosure. First hole 568 has a recessed opening 570, forming a countersink hole 572 for clearance issues in relation to hook 512 of lock assembly 506.

Connection section 552 of hasp 504 has certain thickness and therefore, when installed onto a conventional lock assembly 506, hasp 504 must be able to allow components of lock assembly 506 (such as the moving hook 512) to move in and out of channel 578 of hasp 506 without being obstructed (FIGS. 5A-9 to 5A-11, and FIGS. 5B-1 to 5B-3). In other words, the moving hook 512 must clear hasp connection section 552. Accordingly, fastener and hole that is covered over and protected by the casing is a flat-head type fastener that allows hook 512 component of lock assembly 512 to operate without it being obstructed by hasp assembly 506. Therefore, the fastener hole is also comprised of a countersink hole 572 to clear the fastener from the moving path of the hook.

Second connection portion 564 has a first lateral side 574 that is shorter in length than a second lateral side 576 of second connection portion 564. When installing hasp 506, second lateral side 576 is preferably installed so that it is parallel the truck bed. This positioning will allow locking distal portion 586 of the locking section 556 of hasp 506 to be oriented at an angle β (shown in FIG. 5A-3), which means casing 502 must be rotated and mounted by the angle δ (best shown in FIGS. 5A-4 and 5A-5)) and hence, side hole 158 of casing 502 will be oriented at angle δ in relation to truck bed 510. A distal end 574 of the second connection portion 564 includes a second hole 576 (for a carriage bolt—square shaped) for coupling connection section 552 with enclosure 508. Accordingly, the connection section includes a first distal end with a first hole, and a second distal end with a second hole, with the first distal and the first hole oriented at an angle in relation to the second distal end and the second hole.

Although the use of more than two fastener holes are possible, it is however preferable to have two fastener holes for ease of installation with the least amount of labor without sacrificing security. It should be noted that since the connection section 552 of the hasp 504 is coupled with a plate of lock assembly 506 and door 508, a corresponding set of holes must also be drilled into the plate as well as the door and therefore, it is preferred to have a maximum of two holes rather than more.

Regarding the position of first and second holes 568 and 576, at least one fastener hole position of connection section 552 must be covered over by casing 502 to prevent access and prying. Accordingly, at the very least, one of the two fastener holes 568 and 576 must be protected (covered over)

by casing 502. Accordingly, casing 502 secures lock assembly 506 as well as protecting fasteners of the hasp 504 itself from tampering. Therefore, the actual shape or configuration of connection section 552 is partly dictated by security considerations where fastener holes are spread far apart rather than next to each other, which provide a greater footprint for a stronger, more solid and firm standing connection with the enclosure. Additionally, the fastener holes are at an angle in relation to one another (with at least one being covered over and protected by the casing). Added advantage of the positioning and orientation of the fastener holes is a stronger, firmer mounting connection, which provides a greater resistance against tampering as a result of applied external forces. The fastener holes being non-aligned (their center not being inline) increases resistance against applied linear and or torsion forces on casing 502 where casing 502 may be tampered with by for example, rotation (in plane rotation) by the application of a torque.

Accommodating section 554 in combination with connection section 552 form channel 578 within which hook 512 of lock assembly 506 is maintained when hook 512 is at a closed position. Channel 578 has a channel base 580 with a width 582 that is sufficiently wide to accommodate various thickness hook component, but also allow for unobstructed operation of lock assembly 506. Channel base 580 generally protrudes vertically from second connection portion 564 of connection section 552. A channel wall 584 is generally oriented parallel with first connection section 562, a combination of which form lateral walls of channel 578, with channel wall 584 oriented at an angle θ to channel base 580 (also shown in FIGS. 5A-7 and 5A-10).

Channel wall 584 angles upwards (away from truck bed) to provide sufficient space between lower edge of curved side 176 of casing 502 (when locked with the hasp 504) and the bed of the truck. Accordingly, channel wall 584 is angled rather than spanning straight across. Accordingly, the "upward" angle θ of channel wall 584 raises locking elevation of casing 502 away from truck bed 510, providing for easy locking and unlocking of casing 502 in relation to lock assembly 506 without casing 502 contacting truck bed. It should be noted that angle θ of channel wall 584 should be sufficiently high to raise casing 502, clearing the truck bed, but not so high that it would prevent handle 520 from moving into fully closed position. Accordingly, there is sufficient space between the upper lateral edge of the hasp 504 and the handle 520 of the lock assembly 506 for casing 502 to engage the hasp 504.

The lock section 556 is bent away from connection section 552 at an angle β. This maintains side hole 158 of casing 502 at an angle towards truck bed 510 making it more difficult to tamper. The locking distal portion 586 of locking section 556 is oriented to extend away from the door and to clear lock assembly 506. Length 588 of locking distal portion 586 must be sufficient to accommodate a locking aperture 590 and have sufficient span for insertion into bottom side cavity 526 of casing 502 (i.e., length 588 must be of sufficient span to accommodate casing 502). It should be noted that the smaller the locking distal portion 588, the better as it would require smaller casing 502 without sacrificing security. The larger casing 502 use more material and are heavier and therefore, not preferred. Therefore, the expanse of the locking distal portion 586 of locking section 556 should be minimal, defined by minimal space for locking aperture 590 and minimal mass for the bend of locking distal portion 586 in relation to channel wall 584.

Locking distal portion 586 of locking section 556 is angled (tilted) to orient side hole 158 of casing 502 downward towards the truck bed 510, making it difficult against "drill attacks." Accordingly, when fully installed, opening 145 of through-hole 153 and longitudinal axis 165 of side hole 158 of casing 502 is not parallel truck bed 510, but is angled or sloped, with opening of side hole 158 facing "downward" more towards truck bed 510. The slight angle or tilting of the opening makes drilling out core 130 very difficult as the angle of attack of the drill bid is generally collinear core axis. That is, the effective angle of attack of the drill would force the drill itself to contact the truck bed, which would make the drilling very difficult. It should be noted that this feature is optional and is available with some conventional hook locks. Accordingly, the locking distal portion 586 of locking section 556 of hasp 504 need not be at an angle or tilted in relation to the horizontal (or the truck bed 510).

FIGS. 6A to 6D-12 are non-limiting, exemplary illustrations of a lock assembly and hasp assembly in accordance with one or more embodiments of the present invention. Both the lock and hasp assemblies illustrated in FIGS. 6A to 6D-12 includes similar corresponding or equivalent components, interconnections, functional, and or cooperative relationships as lock devices 100, 200, 300, 400, and 500 that are shown in FIGS. 1A-1 to 5E-15, and described above. Therefore, for the sake of brevity, clarity, convenience, and to avoid duplication, the general description of FIGS. 6A to 6D-12 will not repeat every corresponding or equivalent component, interconnections, functional, and or cooperative relationships that has already been described above in relation to lock devices 100, 200, 300, 400, 500 that are shown in FIGS. 1A-1 to 5E-15.

FIGS. 6A to 6D-12 are non-limiting, exemplary illustrations of a hasp assembly that may be used with lock device 500 shown in FIGS. 5A-1 to 5D-11 in accordance with one or more embodiments of the present invention. Lock assembly 606 illustrated in FIGS. 6A to 6C-4 (just as lock assembly 506) is very well known and conventional, and is one of many different types that are mainly used with a typical roll-up cargo door container 508. Lock assembly 606, as with lock assembly 506, also includes a hook 612 that hooks onto and is secured within hook openings 514 and 516 (generally positioned on the tuck bed 510) to securely maintain the roll-up cargo door container 508 in closed position so that the door 508 does not roll-up during drive.

To open roll-up cargo door 508, a latch 616 is moved along reciprocating path 518, then lock handle 620 is moved along reciprocating path 522 to move and free hook 612 from hook openings 514 and 516 (FIG. 6B-1), with the roll-up cargo door container 508 free to roll up and open access to the container. Lock device 500, including hasp assembly 604 in accordance with the present invention are used to lock-in and secure hook 612 within hook openings 514 and 516, and block the hook 612 from being moved out of hook openings 514 and 516 to thereby prevent unauthorized access to container. However, in this embodiment, it is blocking side 532 of casing 502 that blocks hook 512 of the lock assembly 606 from being moved to open position due to make and model of lock assembly 606. The blocking side 532 is the general mid-side or the middle side surface that blocks hook 512 from moving from a closed to an open position. Smaller lateral side 592 of member 528 of casing 502 allows a lower edge 594 of handle 620 to move into a fully closed position. Side 592, is position further in, away from curved side 176 of casing 502 (shown by arrow 594), which provides a space (shown by the approximate oval dashed area 596) that allows casing 502 to be positioned further away from the truck bed 510, clearing the truck bed 510 and allowing the handle 620 to fully close.

Hasp assembly 604 is similar to hasp 504 with the exception that hasp 604 is comprised of a first connection portion 562 that is oriented at an angle λ (e.g., 90 degree) in relation to the second connection portion 564. The generally "L" configuration enables the countersink hole 568 at the distal end 566 of hasp 604 to clear channel wall 584 for easy insertion of fasteners without the channel wall 584 blocking the insertion path (shown as arrow 598). Further, the lock section 556 and in particular, distal lock section 586 is not angled in relation to the horizontal, but is generally, vertically oriented. The generally vertical orientation (as shown by arrow 622 in FIG. 6B-2) of lock section 556 enables the side hole 158 (and hence, its axial length) to be parallel with the horizontal truck bed rather than at an angle without sacrificing security because lock device 500 associates with the lock assembly 605 at a lower position, which would inherently prevent "drill attacks."

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. For example, it should be noted that the roundness or the curve of some of the interior "transition" portions of the walls (or the corner walls) are due to the milling process and therefore, should not be limiting and may comprise of other configurations such as sharp corner walls. All raised edges may be chamfered along a top interior side for comfort against the skin of the user when handling any of the disclosed lock devices. Any of the disclosed casings may easily be configured for one of right or left installations operations or configured to operate in an inverted orientation (upside down). Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in paragraph six of 35 U.S.C. Section 112. In particular, the use of "step of," "act of," "operation of," or "operational act of" in the claims herein is not intended to invoke the provisions of paragraph six of 35 U.S.C. 112.

What is claimed is:

1. A casing, comprising:
a single piece, including:
a first portion having a generally cylindrical configuration with a top side, a first height and a side opening, including a bottom side that has a bottom side cavity;
the first height is defined from the top side of the first portion to the bottom side of the first portion; and
a second portion having a member that protrudes from the bottom side of the first portion;
the member extends at a second height from the bottom side of the first portion;
the second height defined from the bottom side of the first portion to a top of the member is equal to or greater than the first height of the first portion.

2. The casing as set forth in claim 1, wherein:
the casing is configured for one of right-handed and left handed operations.

3. The casing as set forth in claim 1, further comprising:
side apertures for coupling a cover with the casing that when closed, covers over the side opening.

4. A casing, comprising:
a single piece, having:
a first portion having a generally cylindrical configuration with a top side, first height and a side opening, including a bottom side that has a bottom side cavity;
the first height is defined from the top side of the first portion to the bottom side of the first portion; and
a second portion having a member that protrudes from the bottom side of the first portion;
the member extends at a second height from the bottom side of the first portion;
the second height defined from the bottom side of the first portion to a top of the member is equal to or greater than the first height of the first portion;
wherein: the member obstructs a movement of a lock assembly while the second height enables the first portion to clear the lock assembly.

5. The casing as set forth in claim 4, wherein:
the member includes a side that prevents the movement of the lock assembly from a closed position to an open position.

6. The casing as set forth in claim 4, wherein:
the bottom side cavity has a beveled peripheral edge forming a recessed opening into the bottom side cavity.

7. The casing as set forth in claim 4, further includes:
a retaining hole with an opening at a top of the member that leads to a side hole.

8. A hasp, comprising:
a single piece having:
a connection section, an accommodating section, and a locking section;
the connection section includes:
a first connection portion that has a first opening and a second connection portion that has a second opening;
the first connection portion and the first opening are oriented at a first angle in relation to the second connection portion and the second opening wherein the first connection portion and the second connection portion form a non-linear, connection section;
the accommodating section in combination with the connection section forms a channel;
the accommodating section includes:

a channel defined by the first connection portion of the connection section oriented parallel a single channel wall that extends parallel along the first connection portion only, and a single channel base;

the single channel base protrudes generally perpendicular from the connection section between the first connection portion and the second connection portion of the connection section; and the single channel wall extends from the single channel base parallel first connection portion only but at a second angle, with a distal end of the single channel wall near the lock section being at a different elevation from the single channel base;

the lock section having a locking opening;

the lock section extending generally perpendicular from the distal end of the channel wall, but at a third angle, away from connection section.

9. The hasp as set forth in claim 8, wherein:

the accommodating section of the hasp houses a component of a lock assembly.

10. The casing as set forth in claim 1, wherein:

the bottom side cavity has a beveled peripheral edge forming a recessed opening into the bottom side cavity, with a first side of peripheral edge having a wider beveled edge than a second side of peripheral edge.

11. The casing as set forth in claim 1, wherein:

the member has a side for obstructing a movement of an article while the second height enables the first portion to clear the article.

* * * * *